US012662174B2

(12) United States Patent
Woo et al.

(10) Patent No.: US 12,662,174 B2
(45) Date of Patent: Jun. 23, 2026

(54) SYSTEM AND METHOD FOR IDENTIFYING A COMPROMISED OR DAMAGED SECTION OF A CONDUCTIVE BODY EXTENDING ALONG A ROUTE

(71) Applicant: Transportation IP Holdings, LLC, Norwalk, CT (US)

(72) Inventors: Derek Kevin Woo, Melbourne, FL (US); Alexander Sotelo, Long Beach, CA (US); Chris Schuchmann, Melbourne, FL (US); Timothy Brown, Erie, PA (US); Brian Staton, Palm Bay, FL (US)

(73) Assignee: Transportation IP Holdings, LLC, Norwalk, CT (US)

( * ) Notice: Subject to any disclaimer, the term of this patent is extended or adjusted under 35 U.S.C. 154(b) by 393 days.

(21) Appl. No.: 17/699,924

(22) Filed: Mar. 21, 2022

(65) Prior Publication Data

US 2022/0204061 A1 Jun. 30, 2022

Related U.S. Application Data

(63) Continuation-in-part of application No. 16/882,149, filed on May 22, 2020, now Pat. No. 11,305,798,
(Continued)

(51) Int. Cl.
*B61L 27/00* (2022.01)
*B61K 9/10* (2006.01)
(Continued)

(52) U.S. Cl.
CPC ..... *B61L 23/044* (2013.01); *B61K 9/10* (2013.01); *B61L 3/10* (2013.01); *B61L 15/0018* (2013.01);
(Continued)

(58) Field of Classification Search
CPC ..... B62K 9/00; B61K 9/10
See application file for complete search history.

(56) References Cited

U.S. PATENT DOCUMENTS 2,059,160 A 10/1936 Wintsch et al.
2,628,335 A 2/1953 Drake et al.
(Continued)

FOREIGN PATENT DOCUMENTS

CN 101351373 A 1/2009
CN 102556118 6/2014
(Continued)

OTHER PUBLICATIONS

Chinese Office Action issued in connection with related CN Application No. 201380071077.1 on Feb. 6, 2016—English Translation.
(Continued)

*Primary Examiner* — Jess Whittington
(74) *Attorney, Agent, or Firm* — K&L Gates LLP

(57) ABSTRACT

An examining system includes one or more application devices onboard a vehicle system. The application devices may electrically conduct an examination signal into one or more conductive bodies extending along a route and may include a catenary, a third rail, and/or a cable. The examining system may include one or more detection units that may be disposed onboard the vehicle system and that may monitor one or more electrical characteristics of the one or more conductive bodies in response to the examination signal being conducted into the one or more conductive bodies. The examining system may include an identification unit that may examine the one or more electrical characteristics of the one or more conductive bodies monitored by the one or more detection units to identify a compromised or damaged section of the one or more conductive bodies.

27 Claims, 16 Drawing Sheets

Related U.S. Application Data which is a continuation of application No. 15/717,207, filed on Sep. 27, 2017, now Pat. No. 10,689,016, which is a continuation-in-part of application No. 15/148,570, filed on May 6, 2016, now abandoned, which is a continuation-in-part of application No. 14/527,246, filed on Oct. 29, 2014, now Pat. No. 9,481,384, which is a continuation-in-part of application No. 14/016,310, filed on Sep. 3, 2013, now Pat. No. 8,914,171, said application No. 15/717,207 is a continuation-in-part of application No. 14/221,624, filed on Mar. 21, 2014, now abandoned, which is a continuation of application No. PCT/US2013/054300, filed on Aug. 9, 2013.

(60) Provisional application No. 62/425,887, filed on Nov. 23, 2016, provisional application No. 62/161,626, filed on May 14, 2015, provisional application No. 61/729,188, filed on Nov. 21, 2012, provisional application No. 61/681,843, filed on Aug. 10, 2012, provisional application No. 61/860,469, filed on Jul. 31, 2013, provisional application No. 61/860,496, filed on Jul. 31, 2013.

(51) Int. Cl.

| | |
|---|---|
| ***B61L 3/10*** | (2006.01) |
| ***B61L 15/00*** | (2006.01) |
| ***B61L 23/04*** | (2006.01) |
| ***B61L 27/20*** | (2022.01) |
| *B61L 25/02* | (2006.01) |
| *B61L 27/40* | (2022.01) |

(52) U.S. Cl.

CPC ..... *B61L 15/0027* (2013.01); *B61L 15/0062* (2024.01); *B61L 23/042* (2013.01); *B61L 27/20* (2022.01); *B61L 25/025* (2013.01); *B61L 27/40* (2022.01); *B61L 2201/00* (2013.01); *B61L 2205/04* (2013.01)

(56) References Cited

U.S. PATENT DOCUMENTS

| | | | |
|---|---|---|---|
| 3,016,464 | A | 1/1962 | Bailey et al. |
| 3,137,756 | A | 6/1964 | Gunther et al. |
| 3,393,600 | A | 7/1968 | Bess et al. |
| 3,517,307 | A | 6/1970 | Hronik et al. |
| 3,562,419 | A | 2/1971 | Stewart et al. |
| 3,589,815 | A | 6/1971 | Hosterman |
| 3,594,912 | A | 7/1971 | Sauterel |
| 3,604,359 | A | 9/1971 | Doorley et al. |
| 3,633,010 | A | 1/1972 | Svetlichny |
| 3,696,243 | A | 10/1972 | Risely |
| 3,821,558 | A | 6/1974 | Mansfield |
| 3,821,932 | A | 7/1974 | Theurer et al. |
| 3,828,440 | A | 8/1974 | Plasser et al. |
| 3,850,390 | A | 11/1974 | Geiger et al. |
| 3,864,039 | A | 2/1975 | Wilmarth |
| 3,870,952 | A | 3/1975 | Sibley |
| 3,875,865 | A | 4/1975 | Plasser et al. |
| 3,896,665 | A | 7/1975 | Goel |
| 3,924,461 | A | 12/1975 | Stover |
| 3,937,068 | A | 2/1976 | Joy |
| 3,960,005 | A | 6/1976 | Vezina |
| 3,962,908 | A | 6/1976 | Joy |
| 3,987,989 | A | 10/1976 | Geiger |
| 3,995,560 | A | 12/1976 | Mackintosh |
| 4,005,601 | A | 2/1977 | Botello |
| 4,022,408 | A | 5/1977 | Staples |
| 4,040,738 | A | 8/1977 | Wagner |
| 4,044,594 | A | 8/1977 | Davidson et al. |
| 4,069,590 | A | 1/1978 | Effinger |
| 4,100,795 | A | 7/1978 | Panetti |
| 4,117,463 | A | 9/1978 | Norton |
| 4,117,529 | A | 9/1978 | Ehrlich et al. |
| 4,143,553 | A | 3/1979 | Hendricks et al. |
| 4,145,018 | A | 3/1979 | Muratore et al. |
| 4,155,176 | A | 5/1979 | Goel et al. |
| 4,165,648 | A | 8/1979 | Pagano |
| 4,173,073 | A | 11/1979 | Fukazawa et al. |
| 4,174,636 | A | 11/1979 | Pagano |
| 4,181,278 | A | 1/1980 | Pascoe |
| 4,181,430 | A | 1/1980 | Ando et al. |
| 4,198,164 | A | 4/1980 | Cantor |
| 4,207,569 | A | 6/1980 | Meyer |
| 4,222,275 | A | 9/1980 | Marshall et al. |
| 4,229,978 | A | 10/1980 | Marshall et al. |
| 4,235,112 | A | 11/1980 | Kaiser |
| 4,259,018 | A | 3/1981 | Poirier |
| 4,288,855 | A | 9/1981 | Panelli |
| 4,306,694 | A | 12/1981 | Kuhn |
| 4,383,448 | A | 5/1983 | Fujimoto et al. |
| 4,389,033 | A | 6/1983 | Hardman |
| 4,391,134 | A | 7/1983 | Hansmann et al. |
| 4,417,466 | A | 11/1983 | Panelli |
| 4,417,522 | A | 11/1983 | Bock et al. |
| 4,429,576 | A | 2/1984 | Norris |
| 4,430,615 | A | 2/1984 | Calvert |
| 4,886,226 | A | 12/1989 | Frielinghaus |
| 5,188,038 | A | 2/1993 | Shanley |
| 5,459,663 | A | 10/1995 | Franke |
| 5,462,244 | A | 10/1995 | Van Der Hoek et al. |
| 5,623,244 | A | 4/1997 | Cooper |
| 5,627,508 | A | 5/1997 | Cooper et al. |
| 5,713,540 | A | 2/1998 | Gerszberg et al. |
| 5,743,495 | A | 4/1998 | Kenneth et al. |
| 5,786,750 | A | 7/1998 | Cooper |
| 5,867,404 | A | 2/1999 | Bryan |
| 5,956,664 | A | 9/1999 | Bryan |
| 6,044,698 | A | 4/2000 | Bryan |
| 6,064,428 | A * | 5/2000 | Trosino ..... B61L 23/047 348/148 |
| 6,195,020 | B1 | 2/2001 | Brodeur, Sr. et al. |
| 6,262,573 | B1 * | 7/2001 | Wojnarowski ..... G01M 5/0033 324/217 |
| 6,424,150 | B2 | 7/2002 | Kwun |
| 6,533,223 | B1 | 3/2003 | Ireland |
| 6,553,838 | B2 | 4/2003 | Amini |
| 6,742,392 | B2 | 6/2004 | Gilmore et al. |
| 7,036,774 | B2 | 5/2006 | Hickenlooper et al. |
| 7,188,009 | B2 | 3/2007 | Hawthorne |
| 7,389,694 | B1 | 6/2008 | Hay et al. |
| 7,938,008 | B2 | 5/2011 | Owens et al. |
| 8,160,832 | B2 | 4/2012 | Luo et al. |
| 8,264,330 | B2 | 9/2012 | Yeldell et al. |
| 8,305,567 | B2 | 11/2012 | Hesser et al. |
| 8,682,514 | B2 * | 3/2014 | Falk ..... B61L 15/0036 701/19 |
| 8,888,052 | B2 | 11/2014 | Baldwin et al. |
| 9,108,640 | B2 | 8/2015 | Dean |
| 9,162,691 | B2 | 10/2015 | Polivka et al. |
| 2001/0019263 | A1 | 9/2001 | Kwun et al. |
| 2001/0045495 | A1 | 11/2001 | Olson et al. |
| 2002/0065610 | A1 | 5/2002 | Clark et al. |
| 2002/0065629 | A1 | 5/2002 | Clark |
| 2002/0099507 | A1 | 7/2002 | Clark et al. |
| 2002/0113170 | A1 | 8/2002 | Grappone |
| 2002/0148931 | A1 | 10/2002 | Anderson |
| 2003/0020469 | A1 | 1/2003 | Earnest et al. |
| 2003/0038216 | A1 | 2/2003 | Holgate |
| 2003/0070492 | A1 | 4/2003 | Buttle et al. |
| 2003/0128030 | A1 | 7/2003 | Hintze et al. |
| 2003/0142297 | A1 * | 7/2003 | Casagrande ..... B60M 1/28 356/237.2 |
| 2004/0069909 | A1 | 4/2004 | Kane et al. |
| 2004/0095135 | A1 | 5/2004 | Carr et al. |
| 2004/0105608 | A1 | 6/2004 | Sloman |
| 2005/0076716 | A1 | 4/2005 | Turner |
| 2006/0017911 | A1 | 1/2006 | Villar et al. |
| 2006/0076461 | A1 | 4/2006 | DeRose et al. |
| 2006/0098843 | A1 | 5/2006 | Chew |

(56) References Cited

U.S. PATENT DOCUMENTS

| | | | | |
|---|---|---|---|---|
| 2007/0000744 | A1* | 1/2007 | Craig | B60L 5/205 191/2 |
| 2007/0132463 | A1 | 6/2007 | Anderson | |
| 2007/0145982 | A1 | 6/2007 | Anderson et al. | |
| 2007/0163352 | A1 | 7/2007 | Bardenshtein et al. | |
| 2007/0217670 | A1 | 9/2007 | Bar-Am | |
| 2007/0233335 | A1 | 10/2007 | Kumar et al. | |
| 2008/0105791 | A1* | 5/2008 | Karg | B61L 23/044 246/120 |
| 2008/0142645 | A1 | 6/2008 | Tomlinson et al. | |
| 2008/0201089 | A1 | 8/2008 | Carr et al. | |
| 2008/0296441 | A1 | 12/2008 | Andarawis et al. | |
| 2009/0132179 | A1 | 5/2009 | Fu et al. | |
| 2009/0193899 | A1 | 8/2009 | Panetta et al. | |
| 2009/0266166 | A1 | 10/2009 | Pagano | |
| 2009/0266167 | A1 | 10/2009 | Pagano | |
| 2009/0282923 | A1 | 11/2009 | Havira | |
| 2009/0320603 | A1 | 12/2009 | Crocker et al. | |
| 2010/0207620 | A1 | 8/2010 | Gies | |
| 2010/0312493 | A1 | 12/2010 | Chen et al. | |
| 2011/0006167 | A1 | 1/2011 | Tolmei | |
| 2011/0043199 | A1 | 2/2011 | Crocker | |
| 2011/0199607 | A1 | 8/2011 | Kanellopoulos et al. | |
| 2011/0216996 | A1 | 9/2011 | Rogers | |
| 2011/0233293 | A1 | 9/2011 | Kral et al. | |
| 2011/0255077 | A1 | 10/2011 | Rogers | |
| 2011/0276203 | A1 | 11/2011 | Hase | |
| 2011/0284699 | A1* | 11/2011 | Cooper | B61L 3/20 246/28 R |
| 2011/0284700 | A1* | 11/2011 | Brand | B61L 15/0036 246/28 R |
| 2012/0217351 | A1 | 8/2012 | Chadwick et al. | |
| 2012/0319850 | A1* | 12/2012 | Welch | B60M 1/26 374/45 |
| 2013/0015298 | A1 | 1/2013 | Cooper et al. | |
| 2013/0062474 | A1 | 3/2013 | Baldwin et al. | |
| 2013/0284859 | A1 | 10/2013 | Polivka et al. | |
| 2013/0334373 | A1 | 12/2013 | Malone, Jr. et al. | |
| 2014/0129154 | A1 | 5/2014 | Cooper et al. | |
| 2014/0138493 | A1 | 5/2014 | Noffsinger et al. | |
| 2014/0156123 | A1 | 6/2014 | Cooper et al. | |
| 2014/0207317 | A1 | 7/2014 | Noffsinger et al. | |
| 2014/0277824 | A1 | 9/2014 | Kernwein et al. | |
| 2015/0053827 | A1 | 2/2015 | Noffsinger et al. | |
| 2016/0107664 | A1 | 4/2016 | Kull | |
| 2020/0055401 | A1* | 2/2020 | Sun | B60L 5/24 |
| 2020/0101989 | A1* | 4/2020 | Dick | G01N 25/72 |
| 2020/0302592 | A1* | 9/2020 | Ebersohn | G06T 11/60 |
| 2022/0011196 | A1* | 1/2022 | Santamato | G01M 17/08 |
| 2022/0185431 | A1* | 6/2022 | Torre | B63B 79/20 |

FOREIGN PATENT DOCUMENTS

| | | | | |
|---|---|---|---|---|
| DE | 19826764 | A1 | 12/1999 | |
| DE | 102010026433 | A1 | 1/2012 | |
| EP | 1600351 | A1 | 11/2005 | |
| JP | 2002294609 | A | 10/2002 | |
| JP | 1001194609 | A * | 10/2022 | B61L 23/044 |
| WO | 1998058829 | A1 | 12/1998 | |
| WO | 0009377 | | 2/2000 | |
| WO | 0230729 | | 4/2002 | |
| WO | 02060738 | | 8/2002 | |
| WO | 2014193610 | A1 | 12/2014 | |

OTHER PUBLICATIONS

International Search Report and Written Opinion for corresponding PCT/US2013/071237 dated Feb. 27, 2014.

http://www.progressiverailroading.com/mow/article/Maintenance-of-Way-Track-inspection, "Maintenance of Way: Track inspection technology", 7 pgs.

Rose, J.L.; Avioli, M.J.; Song, W.J., "Application and potential of guided wave rail inspection", Insight vol. 44, No. 6., Jun. 2002, 6 pgs.

Sperry Rail Service, Sperry B-Scan Dual Rail Inspection System, For superior technology, training, and reporting, the solution is Sperry, 4 pgs.

Hocking, Rail Inspection, The Eddy Current Solution, 17 pgs.

Innotrack, Project No. TIP5-CT-2006-031415, 43 pgs.

Aharoni, R.; Glikman, Eli; "A Novel high-speed rail inspection system", ScanMaster Systems (IRT) Ltd., Oct. 2002, vol. 7, No. 10, 8 pgs.

Popov, Ing. Alexandr; "Automated Ultrasonic Inspection of Rails", Starmans Electronics, s.r.o., Prague, CZ, www.starmans.net, 5 pgs.

Dick et al., "Multivariate Statistical Model For Predicting Occurrence And Location Of Broken Rails". Transportation Research Record: Journal of the Transportation Research Board, 1825(1), pp. 48-55, 2003.

Hou et al., "A Rail Damage Detection And Measurement System Using Neural Networks", Computational Intelligence or Measurement Systems and Applications, pp. 4-9, Jul. 14-16, 2004.

Brawner et al., "Magnetometer Sensor Feasibility for Railroad and Highway Equipment Detection", Innovations Deserving Exploratory Analysis Programs, HSR Idea Program Final Report; pp. 1-27, Jun. 24, 2006.

Schafer II, D. H. "Effect of Train Length On Railroad Accidents and A Quantitative Analysis of Factors Affecting Broken Rails". Thesis, University of Illinois at Urbana-Champaign 2008.

Chen et al., "Fault Detection And Diagnosis For Railway Track Circuits Using Neuro-Fuzzy Systems", ScienceDirect Control Engineering Practice, pp. 585-596, May 2008.

Ho et al., "Signature Analysis On Wheel-Rail Interaction For Rail Defect Detection", Railway Condition Monitoring, J008 4th IET International Conference On, pp. 1-6, Jun. 18-20, 2008.

Patra et al., "Availability Analysis Of Railway Track Circuit", Proceedings Of The Institution Of Mechanical Engineers, Part F: Journal Of Rail And Rapid Transit, vol. 224 No. 3, pp. 169-177, May 1, 2010.

Kun-Peng et al., "Design Of Transmission System Of Real-Time Broken Rail Detection", Journal of Railway Science and Engineering, Jan. 2013.

Zhang et al., "Train Detection By Magnetic Field Sensing", Sensors and Materials, Issue No. 6, vol. 25, Feb. 4, pp. 423-436, 2013.

WO Invitation to pay Additional Fees dated (PCT/US2013/053124) Apr. 2, 2014.

International Search Report and Written Opinion for corresponding PCT/US2013/053124 dated Jul. 4, 2014.

Maldonado et al., "Autonomous Broken Rail Detection Technology For Use On Revenue Service Trains", U.S. Department of transportation, Federal Railroad Administration, Dec. 2014.

Turner, Steven; "Feasibility of Locomotive-Mounted Broken Rail Detection", Final Report for High-Speed Rail IDEA Project 38; IDEA, Transportation Research Board of the National Academies; Jun. 2004.

Shanthini, M.; "Electromagnetic System for Railroad Track Crack Detection", British Journal of Science, vol. 4, Feb. 2012.

Dick, C., et al.; "Predicting the Occurrence of Broken Rails: A Quantitative Approach", Abstract.

http://ridgetopgroup.actonsoftware.com/acton/rif/2522; Ridgetop Group Announces New Products for Rail Safety Improvements; May 18, 2015; Ridgetop Group Inc.

* cited by examiner

SYSTEM AND METHOD FOR IDENTIFYING A COMPROMISED OR DAMAGED SECTION OF A CONDUCTIVE BODY EXTENDING ALONG A ROUTE

CROSS-REFERENCE TO RELATED APPLICATIONS

This application is a continuation-in-part of U.S. patent application Ser. No. 16/882,149 (filed 22 May 2020), which is a continuation of U.S. patent application Ser. No. 15/717,207 (filed 27 Sep. 2017, now U.S. Pat. No. 10,689,016), which claims priority to U.S. Provisional Application No. 62/425,887 (filed 23 Nov. 2016) and is a continuation-in-part of U.S. application Ser. No. 15/148,570 (filed 6 May 2016), which claims priority to U.S. Provisional Application No. 62/161,626 (filed 14 May 2015) and is a continuation-in-part of U.S. patent application Ser. No. 14/527,246 (filed 29 Oct. 2014, now U.S. Pat. No. 9,481,384), which is a continuation-in-part of U.S. patent application Ser. No. 14/016,310 (filed 3 Sep. 2013, now U.S. Pat. No. 8,914,171), which claims priority to U.S. Provisional Application No. 61/729,188 (filed on 21 Nov. 2012).

U.S. patent application Ser. No. 15/717,207 also is a continuation-in-part of U.S. patent application Ser. No. 14/221,624 (filed 21 Mar. 2014), which claims priority to International Application No. PCT/US13/054300 (filed 9 Aug. 2013), which claims priority to U.S. Provisional Application No. 61/681,843 (filed 10 Aug. 2012), U.S. Provisional Application No. 61/729,188, U.S. Provisional Application No. 61/860,469 (filed 31 Jul. 2013), and U.S. Provisional Application No. 61/860,496 (filed 31 Jul. 2013).

The entire disclosures of all these applications are incorporated herein by reference.

BACKGROUND

Technical Field

Embodiments of the subject matter disclosed herein relate to examining routes traveled by vehicles for damage to the routes and/or to determine information about the routes and/or vehicles.

Discussion of Art

Components that are frequently used can deteriorate over time. For example, routes that are traveled by vehicles, catenaries or powered rails used to supply electric power to some vehicles, other cables or conductive bodies, etc. may become damaged over time with extended use. For example, rails of tracks on which rail vehicles travel may become damaged and/or broken. A variety of known systems are used to examine rail tracks to identify where the damaged and/or broken portions of the track are located. For example, some systems use cameras, lasers, and the like, to optically detect breaks and damage to the tracks. The cameras and lasers may be mounted on the rail vehicles, but the accuracy of the cameras and lasers may be limited by the speed at which the rail vehicles move during inspection of the route. Thus, the cameras and lasers may not be able to be used during regular operation (e.g., travel) of the rail vehicles in revenue service.

Other systems use ultrasonic transducers that are placed at or near the tracks to ultrasonically inspect the tracks. These systems may require very slow movement of the transducers relative to the tracks to detect damage to the track. When a suspect location is found by an ultrasonic inspection vehicle, a follow-up manual inspection may be required for confirmation of defects using transducers that are manually positioned and moved along the track and/or are moved along the track by a relatively slower moving inspection vehicle. Inspections of the track can take a considerable amount of time, during which the inspected section of the route may be unusable by regular route traffic. Other systems use human inspectors who move along the track to inspect for broken and/or damaged sections of track. This manual inspection is slow and prone to errors.

Some systems use wayside devices that send electric signals through the tracks. If the signals are not received by other wayside devices, then a circuit that includes the track is identified as being open and the track is considered to be broken. These systems are limited at least in that the wayside devices are immobile (e.g., fixed in position). The systems cannot inspect large spans of track and/or many devices must be installed to inspect the large spans of track. These systems are also limited at least in that a single circuit could stretch for multiple miles. If the track is identified as being open and is considered broken, it is difficult and time-consuming to locate the exact location of the break within the long circuit. For example, a maintainer must patrol the length of the circuit to locate the problem.

Additionally, other conductive bodies, such as catenaries, cables, or the like, may not easily be inspected from moving vehicles due to potential issues with the integrity of these components not being readily visible from a moving vehicle. This can make inspection of such conductive bodies difficult, time-consuming, and error prone.

Thus, a need may exist for a system and method that are able to more accurately identify deterioration or other issues with the integrity of conductive bodies, such as portions of routes, catenaries, cables, wires, etc.

BRIEF DESCRIPTION

In one example, an examining system is provided that includes one or more application devices that may be disposed onboard a vehicle system traveling along a route. The one or more application devices may be coupled with one or more conductive bodies extending along the route during movement of the vehicle system along the route. The one or more application devices may electrically conduct an examination signal into the one or more conductive bodies. The one or more conductive bodies may include one or more of a catenary, a third rail, or a cable extending along the route. The examining system may include one or more detection units that may be disposed onboard the vehicle system and that may monitor one or more electrical characteristics of the one or more conductive bodies in response to the examination signal being conducted into the one or more conductive bodies. The examining system may include an identification unit that may examine the one or more electrical characteristics of the one or more conductive bodies monitored by the one or more detection units to identify a compromised or damaged section of the one or more conductive bodies.

In another example, a method is provided that may include electrically conducting an examination signal into the one or more conductive bodies from onboard a vehicle as the vehicle traverses a pathway, monitoring one or more electrical characteristics of the one or more conductive bodies via the examination signal, and determining a compromised or damaged section of the one or more conductive bodies based at least in part on the examination signal.

In another example, an examining system may include one or more detection units that may be disposed onboard a vehicle system. The detection unit(s) may couple with one or more conductive bodies that extend along a route while the vehicle system is moving along the route. The one or more detection units may monitor one or more electrical characteristics of the one or more conductive bodies during movement of the vehicle system. The one or more conductive bodies may include one or more of a catenary, a third rail, and/or a cable extending along the route. The examining system also may include an identification unit that may examine the one or more electrical characteristics of the one or more conductive bodies monitored by the one or more detection units to identify a compromised section of the one or more conductive bodies during movement of the vehicle system.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
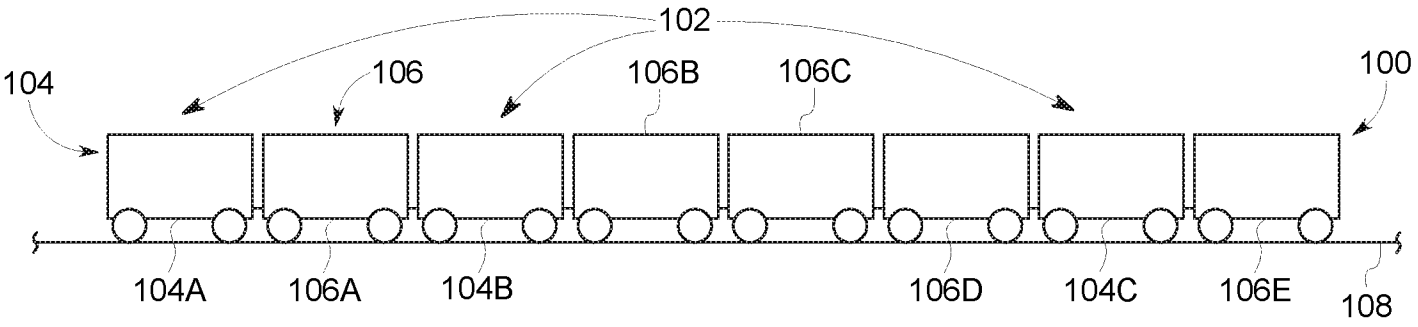
FIG. 1 is a schematic illustration of a vehicle system that includes an embodiment of an examining system.

Embodiments of the inventive subject matter described herein relate to methods and systems for examining conductive bodies. While the embodiments below describe inspection of routes or conductive portions of routes on which vehicles travel, one or more (or all) of the embodiments also may be used to inspect other conductive bodies aside from routes, such as catenaries, cables, wires, or the like. Unless expressly and clearly stated otherwise, embodiments described in connection with inspecting routes also may be used to inspect other bodies, such as catenaries, electrified or powered rails, cables, wires, or the like.

In an embodiment, the vehicle system may examine the conductive body by injecting (conducting) an electrical signal into the conductive body from a first vehicle in the vehicle system as the vehicle system travels along a route and monitoring the conductive body at the same or another, second vehicle that also is in the vehicle system. Detection of the signal at the second vehicle and/or detection of changes in the signal at the second vehicle and/or lack of detection of the signal at the second vehicle may indicate a potentially damaged (e.g., broken or partially broken) section of the conductive body between the first and second vehicles.

In an embodiment, the route may be a track of a rail vehicle system and the first and second vehicle may be used to identify a broken or partially broken section of one or more rails of the track. The electrical signal that is injected into the route may be powered by an onboard energy storage device, such as one or more batteries, and/or an off-board energy source, such as a catenary and/or electrified rail of the route. When the damaged section of the route is identified, one or more responsive actions may be initiated. For example, the vehicle system may automatically slow down or stop. As another example, a warning signal may be communicated (e.g., transmitted or broadcast) to one or more other vehicle systems to warn the other vehicle systems of the damaged section of the route, to one or more wayside devices disposed at or near the route so that the wayside devices can communicate the warning signals to one or more other vehicle systems. In another example, the warning signal may be communicated to an off-board facility that can arrange for the repair and/or further examination of the damaged section of the route.

The term "vehicle" as used herein can be defined as a mobile machine that transports at least one of a person, people, or a cargo. For instance, a vehicle can be, but is not limited to being, a rail car, an intermodal container, a locomotive, a marine vessel, mining equipment, construction equipment, an automobile, a truck, a bus, or the like. A "vehicle system" includes at least one vehicle. For example, a vehicle system may include one vehicle, or it may include two or more vehicles that are interconnected with each other to travel along a route. For example, a vehicle system can include two or more vehicles that are directly connected to each other (e.g., by a coupler) or that are indirectly connected with each other (e.g., by one or more other vehicles and couplers). A vehicle system with two or more vehicles can be referred to as a consist, such as a rail vehicle consist. Optionally, a vehicle system can include two or more vehicles that travel together along one or more routes, but that are not mechanically connected with each other. For example, the vehicles in a vehicle system may be logically linked with each other by wirelessly communicating with each other (e.g., using radios, cellular modems, or the like), directly or indirectly, to coordinate the movements of the vehicles with each other to result in the vehicles moving together along the routes.

"Software" or "computer program" as used herein includes, but is not limited to, one or more computer readable and/or executable instructions that cause a computer or other electronic device to perform functions, actions, and/or behave in a desired manner. The instructions may be embodied in various forms such as routines, algorithms, modules or programs including separate applications or code from dynamically linked libraries. Software may also be implemented in various forms such as a stand-alone program, a function call, a servlet, an applet, an application, instructions stored in a memory, part of an operating system or other type of executable instructions. "Computer" or "processing element" or "computer device" as used herein includes, but is not limited to, any programmed or programmable electronic device that can store, retrieve, and process data. "Non-transitory computer-readable media" include, but are not limited to, a CD-ROM, a removable flash memory card, a hard disk drive, a magnetic tape, and a floppy disk. "Computer memory", as used herein, refers to a storage device configured to store digital data or information which can be retrieved by a computer or processing element. "Controller," "unit," and/or "module," as used herein, can to the logic circuitry and/or processing elements and associated software or program involved in controlling an energy storage system. The terms "signal", "data", and "information" may be used interchangeably herein and may refer to digital or analog forms.

FIG. 1 is a schematic illustration of a vehicle system 100 that includes an embodiment of an examining system 102. The vehicle system includes several vehicles 104, 106 that are mechanically connected with each other to travel along a route. The vehicles 104 (e.g., the vehicles 104A-C) represent propulsion-generating vehicles, such as vehicles that generate tractive effort or power to propel the vehicle system along the route 108. In an embodiment, the propulsion-generating vehicles can represent rail vehicles such as locomotives. The vehicles 106 (e.g., the vehicles 106A-E) represent non-propulsion generating vehicles, such as vehicles that do not generate tractive effort or power. In an embodiment, the non-propulsion-generating vehicles can represent rail cars. Alternatively, the vehicles 104, 106 may represent other types of vehicles (e.g., automobiles, trucks, buses, agricultural vehicles, trailers, etc.). In another embodiment, one or more of the individual propulsion-generating vehicles and/or non-propulsion-generating represent a group of vehicles, such as a consist of locomotives or other vehicles. The vehicle system can include a single vehicle (e.g., a single vehicle system) or multiple vehicles (e.g., a multi-vehicle system). The vehicles in a multi-vehicle system can be mechanically coupled with each other or can remain separate (but coordinate movements so as to travel together as a convoy or swarm).

The route can be a body, surface, or medium on which the vehicle system travels. In an embodiment, the route can include or represent a body that is capable of conveying a signal between vehicles in the vehicle system, such as a conductive body capable of conveying an electrical signal (e.g., a direct current, alternating current, radio frequency, or other signal). While one or more embodiments of the subject matter described herein refers to examining routes to evaluate integrity of the routes (e.g., for damage), not every embodiment of the inventive subject matter is limited to examining routes. One or more embodiments described herein can relate to examining other components to determine the integrity of the components. For example, at least one embodiment relates to examining conductive bodies (e.g., catenaries, electrified or powered rails, cables, wires, buses, etc.). In one embodiment, the system may determine the integrity of the conductive bodies or other electrical characteristic. Suitable electrical characteristics may include, for example, the resistance of the conductive body, the wear level of the conductive body, the amount of cracks, chips, and damage to the conductive body, and the like. Other suitable electrical characteristics may include the distance of a point or segment of the conductive body from a power source, the distance from a load, and the like. Other suitable electrical characteristics may include the data transmission capability for data-over-powerline applications. The data transmission capability may include the signal-to-noise ratio, signal strength, and interference levels. Yet other electrical characteristics may include electrical shorts or intermittent conduction. Intermittent conduction may be a result of a broken conductive component that, when stressed, opens the circuit. As such, a broken rail may be conductive until a vehicle weight is placed on it to push it apart and open the circuit. The controller may determine a nature of the damage based at least in part on the electrical characteristic being measured. Other electrical characteristics may include one or more of increased electrical resistance, a decreased electrical resistance, a drop in voltage, a spike in voltage, or intermittent conductivity.

The examining system can be distributed between or among two or more vehicles of the vehicle system. For example, the examining systems described herein may include two or more sensor components that operate to identify potentially damaged sections of the route, with at least one sensor component disposed on each of two different vehicles in the same vehicle system. The examining system can include hardware circuitry that includes and/or is connected with one or more processors (e.g., integrated circuits, microprocessors, field programmable gate arrays, etc.) that perform and/or direct performance of the operations described in connection with the examining system. This hardware and/or processor(s) can be referred to as a controller.

In the illustrated embodiment, the examining system is distributed between or among two different vehicles. Alternatively, the examining system may be distributed among three or more vehicles. Additionally or alternatively, the examining system may be distributed between one or more propulsion-generating vehicles and one or more non-propulsion-generating vehicles, and is not limited to being disposed onboard a single type of vehicle. As described below, in another embodiment, the examining system may be distributed between a vehicle in the vehicle system and an off-board monitoring location. A suitable off-board system may include a wayside device, in one embodiment. The wayside device may be disposed at, for example, an electrical connection point where the electrified conductive pathway is connected to an offboard source of electrical power, e.g., a supply line from a power substation, a supply line from an offboard power supply or power conditioning circuit, a supply line from a public utility, etc. As another example, the wayside device may be disposed at an insulated junction between one block of electrified conductive pathway and another, adjacent block of electrified conductive pathway.

In operation of one embodiment, the vehicle system travels while a first vehicle electrically injects an examination signal into a component to be examined (e.g., the route or another conductive body). For example, the first vehicle may apply a direct current, alternating current, radio frequency signal, or the like, to the component as an examination signal. The examination signal propagates through or along the component. A second vehicle may monitor one or more electrical characteristics of the component when the examination signal is injected into the component.

In various embodiments, the examining system can be distributed among two separate vehicles in a single vehicle system, among two vehicles each in a different vehicle system, between one or more vehicles and a wayside device, or it may be onboard a single vehicle. In the illustrated embodiment, the examining system has components disposed onboard at least two of the propulsion-generating vehicles. Additionally or alternatively, the examining system may include components disposed onboard at least one of the non-propulsion generating vehicles. For example, the examining system may be located onboard two or more propulsion-generating vehicles, two or more non-propulsion generating vehicles, or at least one propulsion-generating vehicle and at least one non-propulsion generating vehicle.

In operation, during travel of the vehicle system along the route, the examining system electrically injects an examination signal into the component being examined at a first vehicle 104 or 106 (e.g., beneath the footprint of the first vehicle or outside of the footprint). For example, an onboard or off-board power source may be controlled to apply a direct current, alternating current, RF signal, or the like, to a track of the route. The examining system monitors electrical characteristics of the component at a second vehicle of the same vehicle system (e.g., beneath the footprint of the second vehicle or outside of the footprint) to determine whether the examination signal is detected in the component. The voltage, current, resistance, impedance, or other electrical characteristic of the route may be monitored at the second vehicle to determine whether the examination signal is detected and/or whether the examination signal has been altered. If the portion of the component between the first and second vehicles conducts the examination signal to the second vehicle, then the examination signal may be detected by the examining system. The examining system may determine the integrity of the component (e.g., the portion of the component through which the examination signal propagated) is intact and/or not damaged. Optionally, the examining system may not inject an additional signal into the conductive component being examined. Instead, the examining system may monitor the electrical characteristics of the conductive component. For example, current and/or an examination signal may already be conducted through a catenary or electrified rail, and the examining system may examine characteristics of the conductive component based on the current or signal already conducted through the conductive component.

On the other hand, if the portion of the component between the first and second vehicles does not conduct the examination signal to the second vehicle (e.g., such that the examination signal is not detected in the component at the second vehicle), then the examination signal may not be detected by the examining system. The examining system may determine that the component (e.g., the portion of the component disposed between the first and second vehicles during the time period that the examination signal is expected or calculated to propagate through the component) is not intact and/or is damaged. For example, the examining system may determine that the portion of a track, catenary, electrified rail, cable, etc., between the first and second vehicles is broken such that a continuous conductive pathway for propagation of the examination signal does not exist. The examining system can identify the integrity of this section of the component as being compromised, decreased, damaged, potentially damaged, worn, intermittently functioning, etc. In routes that are segmented (e.g., such as rail tracks that may have gaps), the examining system may transmit and attempt to detect multiple examination signals to prevent false detection of a broken portion of the route.

Because the examination signal may propagate relatively quickly through the component (e.g., faster than a speed at which the vehicle system moves), the component can be examined using the examination signal when the vehicle system is moving, such as transporting cargo or otherwise operating at or above a non-zero, minimum speed limit of the route.

Additionally or alternatively, the examining system may detect one or more changes in the examination signal at the second vehicle. The examination signal may propagate through the component from the first vehicle to the second vehicle. But, due to damaged portions of the component between the first and second vehicles, one or more signal characteristics of the examination signal may have changed. For example, the signal-to-noise ratio, intensity, power, or the like, of the examination signal may be known or designated when injected into the component at the first vehicle. One or more of these signal characteristics may change (e.g., deteriorate or decrease) during propagation through a mechanically damaged or deteriorated portion of the component, even though the examination signal is received (e.g., detected) at the second vehicle. The signal characteristics can be monitored upon receipt of the examination signal at the second vehicle. Based on changes in one or more of the signal characteristics, the examining system may evaluate the integrity of the component, such as by identifying a portion of the component that is disposed between the first and second vehicles as being a potentially damaged. For example, if the signal-to-noise ratio, intensity, power, or the like, of the examination signal decreases below a designated threshold and/or decreases by more than a designated threshold decrease, then the examining system may identify the integrity of the component as being decreased or compromised (e.g., damaged).

In response to identifying a section of the component as having compromised integrity, the examining system may initiate one or more responsive actions. For example, the examining system can automatically slow down or stop movement of the vehicle system. The examining system can automatically issue a warning signal to one or more other vehicle systems traveling nearby of the section of the component and where the compromised section of the component is located. The examining system may direct the same or another vehicle (or electronic systems onboard) to use another component for sending signals or obtaining electric power. For example, if a vehicle was obtaining electric current to power one or more devices from a catenary and the conductive pathway between the catenary and the devices is compromised, then the examining system may switch from obtaining power from the catenary to obtaining power from a battery, an engine with alternator or generator, or the like. Conversely, if the vehicle was obtaining electric current to power one or more devices from an onboard battery, generator, or alternator, and the conductive pathway between the battery, generator, or alternator and the devices is compromised, then the examining system may switch from obtaining power from the battery, generator, or alternator to obtaining power from a catenary, utility grid, off-board battery, or the like.

The examining system may automatically communicate a warning signal to a stationary wayside device located at or near the route that notifies the device of the integrity of the component and the location of the examined portion of the component. The stationary wayside device can then communicate a signal to one or more other vehicle systems traveling nearby of the examined section of the component and where the examined section of the component is located. The examining system may automatically issue an inspection signal to an off-board facility, such as a repair facility, that notifies the facility of the examined section of the component and the location of the examined section of the component. The facility may then send one or more inspectors to check and/or repair the examined section of the component. Alternatively, the examining system may notify an operator of the examined section of the component and the operator may then manually initiate one or more responsive actions.

Figure 2:
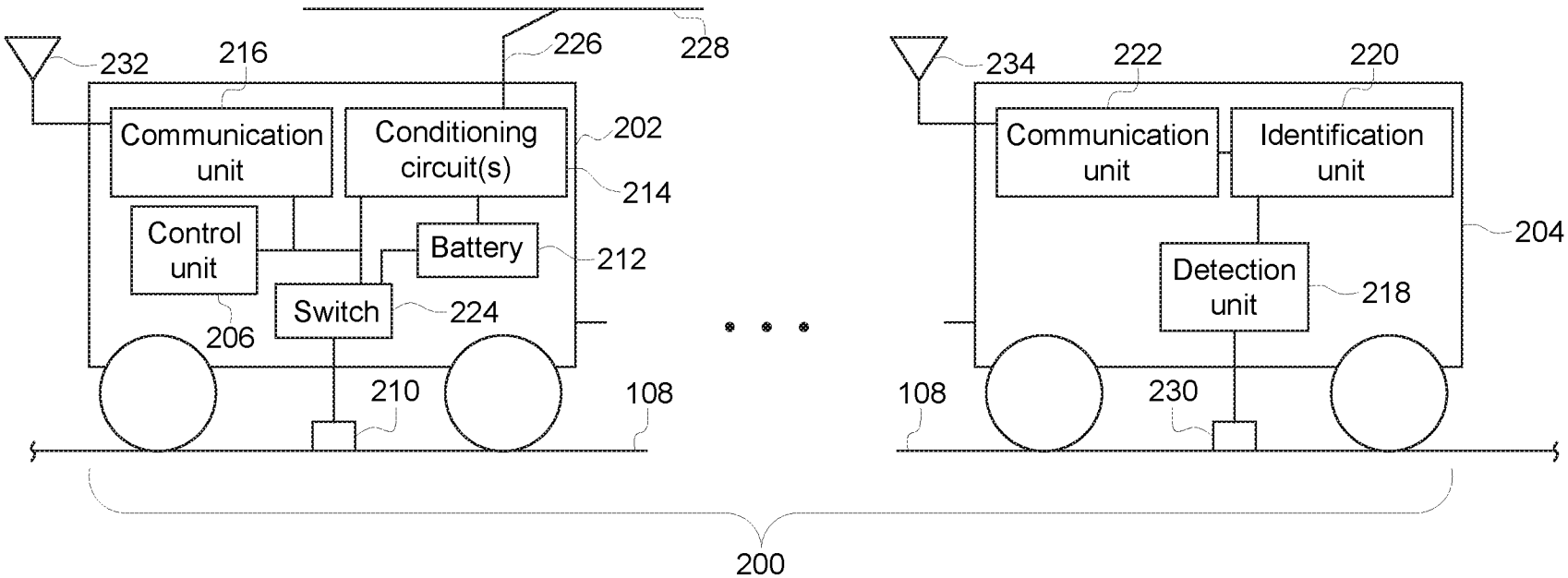
FIG. 2 is a schematic illustration of an embodiment of an examining system.

FIG. 2 is a schematic illustration of an embodiment of an examining system 200. The examining system may represent the examining system shown in FIG. 1. The examining system is distributed between a first vehicle 202 and a second vehicle 204 in the same vehicle system. The vehicles may represent vehicles 104 and/or 106 of the vehicle system shown in FIG. 1. In an embodiment, the vehicles 202, 204 represent two of the propulsion-generating vehicles. Alternatively, one or more of the vehicles shown in FIG. 2 may represent at least one of the non-propulsion-generating vehicles shown in FIG. 1. In another embodiment, the examining system may be distributed among three or more of the vehicles.

The examining system includes several components described below that are disposed onboard the vehicles. For example, the illustrated embodiment of the examining system includes a control unit 206, an application device 210, an onboard power source 212 ("Battery" in FIG. 2), one or more conditioning circuits 214, a communication unit 216, and one or more switches 224 disposed onboard the first vehicle 202. The examining system also includes a detection unit 218, an identification unit 220, a detection device 230, and a communication unit 222 disposed onboard the second vehicle. Alternatively, one or more of the control unit, application device, power source, conditioning circuits, communication unit, and/or switch may be disposed onboard the second vehicle and/or another vehicle in the same vehicle system, and/or one or more of the detection unit, identification unit, detection device, and communication unit may be disposed onboard the first vehicle and/or another vehicle in the same vehicle system.

The control unit controls supply of electric current to the application device. In an embodiment, the application device may contact or couple to one or more conductive bodies or electrical pathways as the vehicle system that includes the vehicle travels. For example, the application device can include a conductive shoe, brush, or other body (e.g., a pad, orthogonal block, rounded block, panel, etc.) that slides along an upper and/or side surface of a component being examined (e.g., rail, track, cable, wire, etc.) such that a conductive pathway is created. In one embodiment, this pathway may extend through both the application device and the conductive body being examined. Additionally or alternatively, the application device can include a conductive portion of a wheel of the first vehicle, such as the conductive outer periphery or circumference of the wheel that engages the component being examined as the first vehicle travels along the route. In another embodiment, the application device may be inductively coupled with the component being examined without engaging or touching the component being examined or another component that engages the route. Suitable application devices may include pantographs and the like, or portions thereof.

The application device may be conductively coupled with the switch, which can represent one or more devices that control the flow of electric current from the onboard power source and/or the conditioning circuits. The switch can be controlled by the control unit so that the control unit can turn on or off the flow of electric current through the application device to the component being examined. In an embodiment, the switch also can be controlled by the control unit to change or vary one or more waveforms and/or waveform characteristics (e.g., phase, frequency, amplitude, and the like) of the electrical current that is applied to the examined component or pathway.

The onboard power source represents one or more devices capable of storing or providing electric energy. Suitable power sources may include one or more batteries, capacitors, flywheels, fuel cells, and the like. In one embodiment, the power source may include a circuit with one or more devices capable of generating electric current. Suitable current generators may include one or more of an alternator, generator, photovoltaic device, turbine, or the like. The power source may be coupled with the switch so that the control unit can control when the electric energy stored in the power source and/or the electric current generated by the power source is conveyed as electric current (e.g., direct current, alternating current, an RF signal, or the like) to the component being examined via the application device.

The conditioning circuit represents one or more circuits and electric components that change characteristics of electric current. For example, the conditioning circuit may include one or more inverters, converters, transformers, batteries, capacitors, resistors, inductors, and the like. In the illustrated embodiment, the conditioning circuit is coupled with a connecting assembly 226 that is configured to receive electric current from an off-board source. For example, the connecting assembly may include a pantograph that engages an electrified conductive pathway 228 (e.g., a catenary) extending along the component being examined such that the electric current from the catenary is conveyed via the connecting assembly to the conditioning circuit. Additionally or alternatively, the electrified conductive pathway may represent an electrified portion of the component being examined (e.g., a third rail, catenary, or the like) and the connecting assembly may include a conductive shoe, brush, portion of a wheel, or other body that engages the electrified portion of the component being examined. Electric current is conveyed from the electrified portion of the component being examined through the connecting assembly and to the conditioning circuit. The conductive pathway may be selectively energized to provide electrical current from an off-board source to a collector or connecting assembly disposed on the vehicle. The third rail may be referred to interchangeably as an 'electrified rail' herein.

The electric current that is conveyed to the conditioning circuit from the power source and/or the off-board source (e.g., via the connecting assembly) can be altered by the conditioning circuit. For example, the conditioning circuit can change the voltage, current, frequency, phase, magnitude, intensity, waveform, and the like, of the current that is received from the power source and/or the connecting assembly. The modified current can be the examination signal that is electrically injected into the component being examined by the application device. Additionally or alternatively, the control unit can form the examination signal by controlling the switch. For example, the examination signal can be formed by turning the switch on to allow current to flow from the conditioning circuit and/or the power source to the application device.

In an embodiment, the control unit may control the conditioning circuit to form the examination signal. For example, the control unit may control the conditioning circuit to change the voltage, current, frequency, phase, magnitude, intensity, waveform, and the like, of the current that is received from the power source and/or the connecting assembly to form the examination signal. The examination signal optionally may be a waveform that includes multiple frequencies. The examination signal may include multiple harmonics or overtones. The examination signal may be a square wave or the like.

The examination signal is conducted through the application device to the component being examined, and is electrically injected into a conductive portion of the component being examined. For example, the examination signal may be conducted into a conductive rail of the component being examined. In another embodiment, the application device may not directly engage (e.g., touch) the component being examined, but may be wirelessly coupled with the component being examined to electrically inject the examination signal into the component being examined (e.g., via induction).

The conductive portion of the component being examined that extends between the first and second vehicles during travel of the vehicle system may form a circuit through which the examination signal may be conducted. The first vehicle can be coupled (e.g., coupled physically, coupled wirelessly, among others) to the circuit by the application device. The power source (e.g., the onboard power source and/or the off-board electrified conductive pathway) can transfer power (e.g., the examination signal) through the circuit toward the second vehicle.

By way of example and not limitation, the first vehicle can be coupled to a track of the route, and the track can form at least part of the circuit that extends and conductively couples one or more components of the examining system on the first vehicle with one or more components of the examining system on the second vehicle.

In an embodiment, the control unit includes or represents a manager component. Such a manager component can be configured to activate a transmission of electric current into the component being examined via the application device. In another instance, the manager component can activate or deactivate a transfer of the portion of power from the onboard and/or off-board power source to the application device, such as by controlling the switch and/or conditioning circuit. Moreover, the manager component can adjust parameter(s) associated with the portion of power that is transferred to the component being examined. For instance, the manager component can adjust an amount of power transferred, a frequency at which the power is transferred (e.g., a pulsed power delivery, AC power, among others), a duration of time the portion of power is transferred, among others. Such parameter(s) can be adjusted by the manager component based on at least one of a geographic location of the vehicle or the device or an identification of the device (e.g., type, location, make, model, among others).

The manager component can leverage a geographic location of the vehicle or the device to adjust a parameter for the portion of power that can be transferred to the device from the power source. For instance, the amount of power transferred can be adjusted by the manager component based on the device power input. By way of example, the portion of power transferred can meet or be below the device power input to reduce risk of damage to the device. In another example, the geographic location of the vehicle and/or the device can be utilized to identify a particular device and, in turn, a power input for such device. The geographic location of the vehicle and/or the device can be ascertained by a location on a track circuit, identification of the track circuit, Global Positioning Service (GPS), among others.

The detection unit disposed onboard the second vehicle as shown in FIG. 2 may monitor the component being examined to attempt to detect the examination signal that is injected into the component being examined by the first vehicle. The detection unit is coupled with the detection device. In an embodiment, the detection device includes at least a portion of the vehicle power system, such as the pantograph, brush or shoe that engages with the conductive body. The detection device, or at least a component thereof, may slide along an upper and/or side surface of a conductive pathway and both monitor the state or health of the pathway as well as conduct electrical power to the vehicle propulsion system. In one embodiment, the detection device can include a conductive portion of a wheel of the second vehicle, such as the conductive outer periphery or circumference of the wheel that engages the component being examined as the second vehicle travels along the route. In another embodiment, the detection device may be inductively coupled with the component being examined without engaging or touching the route or any component that engages the component being examined. The detection device may receive electric current that is being conducted in or through the component being examined (e.g., from or by the current injected into the component being examined by the application device). In one embodiment, the detection unit may include one or more sensors suitable to monitor at least electrical characteristics.

The detection unit monitors one or more electrical characteristics of the component being examined using the detection device. For example, the voltage of a direct current conducted by the component being examined may be detected by monitoring the voltage conducted along the component being examined to the detection device. In another example, the current (e.g., frequency, amps, phases, or the like) of an alternating current or RF signal being conducted by the component being examined may be detected by monitoring the current conducted along the component being examined to the detection device. As another example, the signal-to-noise ratio of a signal being conducted by the detection device from the component being examined may be detected by the detection unit examining the signal conducted by the detection device (e.g., a received signal) and comparing the received signal to a designated signal. For example, the examination signal that is injected into the component being examined using the application device may include a designated signal or portion of a designated signal. The detection unit may compare the received signal that is conducted from the component being examined into the detection device with this designated signal to measure a signal-to-noise ratio of the received signal and/or a signal strength.

The detection unit determines one or more electrical characteristics of the signal that is received (e.g., picked up) by the detection device from the component being examined and reports the characteristics of the received signal to the identification unit. The one or more electrical characteristics may include voltage, current, frequency, phase, phase shift or difference, modulation, intensity, embedded signature, and the like. If no signal is received by the detection device, then the detection unit may report the absence of such a signal to the identification unit. For example, if the detection unit does not detect at least a designated voltage, designated current, or the like, as being received by the detection device, then the detection unit may not detect any received signal. Alternatively or additionally, the detection unit may communicate the detection of a signal that is received by the detection device only upon detection of the signal by the detection device.

In an embodiment, the detection unit may determine the characteristics of the signals received by the detection device in response to a notification received from the control unit in the first vehicle 202. For example, when the control unit is to cause the application device to inject the examination signal into the component being examined, the control unit may direct the communication unit to transmit a notification signal to the detection device via the communication unit of the second vehicle. The communication units may include respective antennas 232, 234 and associated circuitry for wirelessly communicating signals between the vehicles and/or with off-board locations. The communication unit may wirelessly transmit a notification to the detection unit that instructs the detection unit as to when the examination signal is to be input into the component being examined. Additionally or alternatively, the communication units may be connected via one or more wires, cables, and the like, such as a multiple unit (MU) cable, train line, or other conductive pathway(s), to allow communication between the communication units. In one embodiment, the communication units may communicate using AAR-4200 ECP.

The detection unit may begin monitoring signals received by the detection device. For example, the detection unit may not begin or resume monitoring the received signals of the detection device unless or until the detection unit is instructed that the control unit is causing the injection of the examination signal into the component being examined. Alternatively or additionally, the detection unit may periodically monitor the detection device for received signals and/or may monitor the detection device for received signals upon being manually prompted by an operator of the examining system.

The identification unit receives the characteristics of the received signal from the detection unit and determines if the characteristics indicate receipt of all or a portion of the examination signal injected into the component being examined by the first vehicle. Although the detection unit and the identification unit are shown as separate units, the detection unit and the identification unit may refer to the same unit. For example, the detection unit and the identification unit may be a single hardware component disposed onboard the second vehicle 204.

The identification unit examines the characteristics and determines if the characteristics indicate that the section of the component being examined disposed between the first vehicle 202 and the second vehicle 204 is damaged or at least partially damaged. For example, if the application device injected the examination signal into a track of the component being examined and one or more characteristics (e.g., voltage, current, frequency, intensity, signal-to-noise ratio, and the like) of the examination signal are not detected by the detection unit, then, the identification unit may determine that the section of the track that was disposed between the vehicles is broken or otherwise damaged such that the track cannot conduct the examination signal. Additionally or alternatively, the identification unit can examine the signal-to-noise ratio of the signal detected by the detection unit and determine if the section of the component being examined between the vehicles is potentially broken or damaged. For example, the identification unit may identify this section of the route as being broken or damaged if the signal-to-noise ratio of one or more (or at least a designated amount) of the received signals is less than a designated ratio.

The identification unit may include or be communicatively coupled (e.g., by one or more wired and/or wireless connections that allow communication) with a location determining unit that can determine the location of the vehicle and/or vehicle system. For example, the location determining unit may include a GPS unit or other device that can determine where the first vehicle and/or second vehicle are located along the route. The distance between the first vehicle and the second vehicle along the length of the vehicle system may be known to the identification unit, such as by inputting the distance into the identification unit using one or more input devices and/or via the communication unit.

The identification unit can identify which section of the component being examined is potentially damaged based on the location of the first vehicle and/or the second vehicle during transmission of the examination signal through the component being examined. For example, the identification unit can identify the section of the component being examined that is within a designated distance of the vehicle system, the first vehicle, and/or the second vehicle as the potentially damaged section when the identification unit determines that the examination signal is not received or at least has a decreased signal-to-noise ratio.

Additionally or alternatively, the identification unit can identify which section of the component being examined is potentially damaged based on the locations of the first vehicle and the second vehicle during transmission of the examination signal through the component being examined, the direction of travel of the vehicle system that includes the vehicles, the speed of the vehicle system, and/or a speed of propagation of the examination signal through the component being examined. The speed of propagation of the examination signal may be a designated speed that is based on one or more of the material(s) from which the component being examined is formed, the type of examination signal that is injected into the component being examined, and the like. In an embodiment, the identification unit may be notified when the examination signal is injected into the component being examined via the notification provided by the control unit. The identification unit can then determine which portion of the component being examined is disposed between the first vehicle and the second vehicle as the vehicle system moves along the component being examined during the time period that corresponds to when the examination signal is expected to be propagating through the component being examined between the vehicles as the vehicles move. This portion of the component being examined may be the section of the potentially damaged component that is identified.

One or more responsive actions may be initiated when the potentially damaged section of the component being examined is identified. For example, in response to identifying the potentially damaged portion of the route, the identification unit may notify the control unit via the communication units. The control unit and/or the identification unit can automatically slow down or stop movement of the vehicle system. For example, the control unit and/or identification unit can be communicatively coupled with one or more propulsion systems (e.g., engines, alternators/generators, motors, and the like) of one or more of the propulsion-generating vehicles in the vehicle system. The control unit and/or identification unit may automatically direct the propulsion systems to slow down and/or stop. Optionally, responsive to identifying a section of a cable as being potentially damaged, the control unit and/or identification unit can switch to a different source of electric current that does not involve the cable, as described above.

Figure 3:
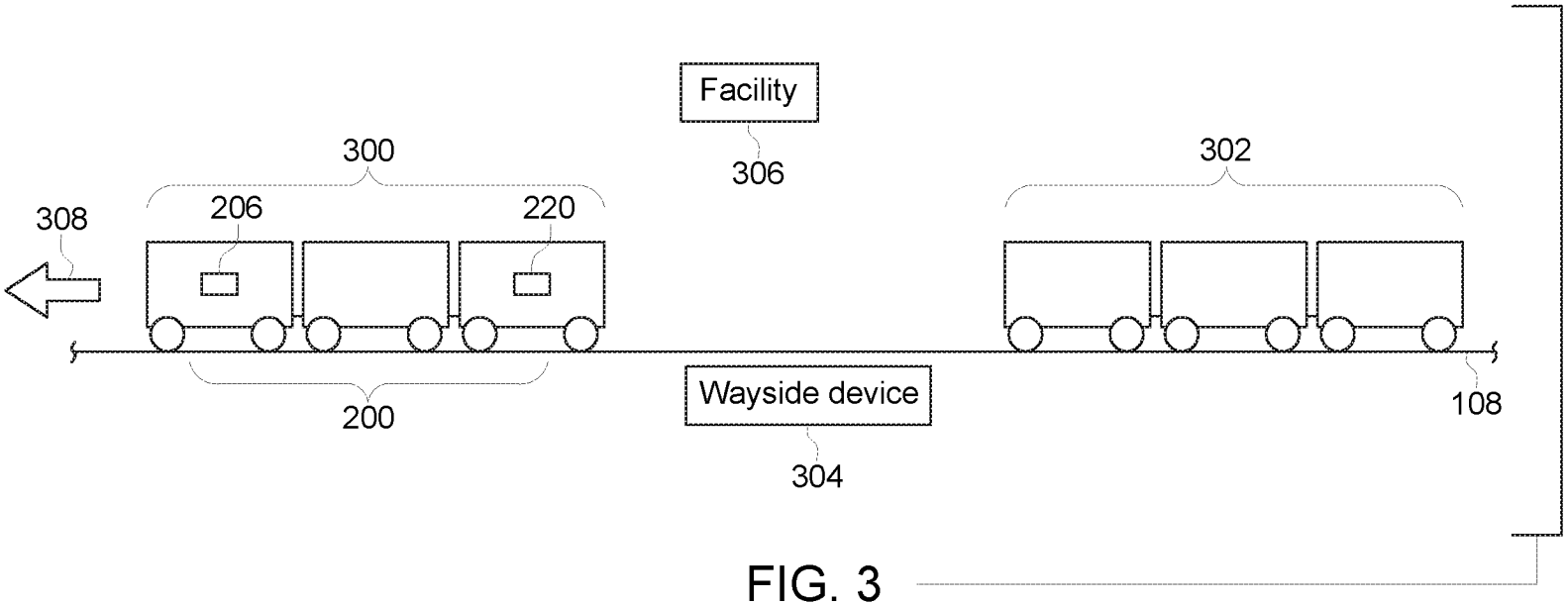
FIG. 3 illustrates a schematic diagram of an embodiment of plural vehicle systems traveling along the route.

With continued reference to FIG. 2, FIG. 3 illustrates a schematic diagram of an embodiment of plural vehicle systems 300, 302 traveling along the route. One or more of the vehicle systems shown in FIG. 3 may represent the vehicle system shown in FIG. 1 that includes the examining system. For example, at least a first vehicle system traveling along the route in a first direction 308 may include the examining system. The second vehicle system may be following the first vehicle system on the route, but spaced apart and separated from the first vehicle system.

In addition or as an alternate to the responsive actions that may be taken when a potentially damaged section of the route is identified, the examining system onboard the first vehicle system may automatically notify the second vehicle system. The control unit and/or the identification unit may wirelessly communicate (e.g., transmit or broadcast) a warning signal to the second vehicle system. The warning signal may notify the second vehicle system of the location of the potentially damaged section of the component being examined before the second vehicle system arrives at the potentially damaged section. The second vehicle system may be able to slow down, stop, or move to another route to avoid traveling over the potentially damaged section. As another example, the second vehicle system may switch to a different source of electric current responsive to the first vehicle system identifying a section of a catenary or electrified rail as damaged (prior to the second vehicle reaching the identified section). As another example, the second vehicle system may change operation to increase the amount of electric energy stored onboard the second vehicle system responsive to the first vehicle system identifying a section of a catenary or electrified rail as damaged. For example, the second vehicle system may reduce speed, reduce auxiliary loads (e.g., heating and/or cooling), or the like, to reduce the amount of electric energy discharged by the battery or battery cells. As another example, the second vehicle system may charge one or more onboard energy storage devices (e.g., batteries or battery cells) to increase the amount of electric energy stored onboard the second vehicle system responsive to the first vehicle system identifying a section of a catenary or electrified rail as damaged. For example, the second vehicle system may increase a state of charge of the batteries or battery cells prior to reaching the section of a catenary or electrified rail that is identified as potentially damaged. As another example, the first or second vehicle system may switch between which onboard sources of energy are used to power the vehicle system(s) responsive to identifying a section of a conductive pathway as damaged (where the pathway connects one of the sources, but not at least one other source) with the device(s) of the vehicle system that are powered. For example, a vehicle system may switch between powering traction motor(s) with a first battery module or stack to a second battery module or stack responsive to identifying a cable connected with the first battery module and the traction motor(s) as damaged.

Additionally or alternatively, the control unit and/or identification unit may communicate a warning signal to a stationary wayside device 304 in response to identifying a conductive component as being potentially damaged. The wayside device can be, for instance, wayside equipment, an electrical device, a client asset, a defect detection device, a device utilized with Positive Train Control (PTC), a signal system component(s), a device utilized with Automated Equipment Identification (AEI), among others. In one example, the wayside device can be a device utilized with AEI. AEI is an automated equipment identification mechanism that can aggregate data related to equipment for the vehicle. By way of example and not limitation, AEI can utilize passive radio frequency technology in which a tag (e.g., passive tag) is associated with the vehicle and a reader/receiver receives data from the tag when in geographic proximity thereto. The AEI device can be a reader or receiver that collects or stores data from a passive tag, a data store that stores data related to passive tag information received from a vehicle, an antenna that facilitates communication between the vehicle and a passive tag, among others. Such an AEI device may store an indication of where the potentially damaged section of the conductive component is located so that the second vehicle system may obtain this indication when the second vehicle system reads information from the AEI device.

In another example, the wayside device can be a signaling device for the vehicle. For instance, the wayside device can provide visual and/or audible warnings to provide warning to other entities such as other vehicle systems (e.g., the vehicle system 302) of the potentially damaged section of the conductive component. The signaling devices can be, but not limited to, a light, a motorized gate arm (e.g., motorized motion in a vertical plane), an audible warning device, among others.

In another example, the wayside device can be utilized with PTC. PTC can refer to communication-based/processor-based vehicle control technology that provides a system capable of reliably and functionally preventing collisions between vehicle systems, over speed derailments, incursions into established work zone limits, and the movement of a vehicle system through a route switch in the improper position. PTC systems can perform other additional specified functions. Such a PTC device can provide warnings to the second vehicle system that cause the second vehicle system to automatically slow and/or stop, among other responsive actions, when the second vehicle system 204 approaches the location of the potentially damaged section of the conductive component. Optionally, the PTC system or device can be another type of positive control system or device that notifies vehicles whether the vehicle can enter into an upcoming segment of a route, can travel faster than a designated speed, etc. Responsive to receiving a signal from an off-board component of a PTC or other positive control system, a vehicle may enter into the route segment, move faster than the designated speed, and so on. But if no such signal is received, the vehicle may automatically prevent itself (e.g., the onboard controller or control system) from entering the route segment, from moving faster than the designated speed, and so on. As another option, a negative control system can be used that notifies vehicles whether the vehicle cannot enter into an upcoming segment of a route, travel faster than a designated speed, etc. Responsive to receiving a signal from an off-board component of a negative control system, a vehicle may automatically prevent itself from entering the route segment, from moving faster than the designated speed, and so on. But if no such signal is received, then the vehicle may enter the route segment, move faster than the designated speed, and so on. The detection of a potentially damaged or damaged portion of a conductive component (e.g., of the route, the cable, wire, etc.) may be communicated to the positive control system or negative control system, with this information then used to direct vehicles to change travel or other operation to avoid the potentially damaged or damaged portion of the component.

In another example, the wayside device can act as a beacon or other transmitting or broadcasting device other than a PTC device that communicates warnings to other vehicles or vehicle systems traveling on the route of the identified section of the conductive component that is potentially damaged.

The control unit and/or identification unit may communicate a repair signal to an off-board facility 306 in response to identifying a section of the conductive component as being potentially damaged. The facility can represent a location, such as a dispatch or repair center, that is located off-board of the vehicle systems. The repair signal may include or represent a request for further inspection and/or repair of the conductive component at the potentially damaged section. Upon receipt of the repair signal, the facility may dispatch one or more persons and/or equipment to the location of the potentially damaged section of the to inspect and/or repair the conductive component at the location.

Additionally or alternatively, the control unit and/or identification unit may notify an operator of the vehicle system of the potentially damaged section of the conductive component and suggest the operator initiate one or more of the responsive actions described herein.

In another embodiment, the examining system may identify the potentially damaged section of the conductive component using the wayside device. For example, the detection device, the detection unit, and the communication unit may be located at or included in the wayside device. The control unit on the vehicle system may determine when the vehicle system is within a designated distance of the wayside device based on an input or known location of the wayside device and the monitored location of the vehicle system (e.g., from data obtained from a location determination unit). Upon traveling within a designated distance of the wayside device, the control unit may cause the examination signal to be injected into the conductive component. The wayside device can monitor one or more electrical characteristics of the conductive component similar to the second vehicle 204 described above. If the electrical characteristics indicate that the section of the conductive component between the vehicle system and the wayside device is damaged or broken, the wayside device can initiate one or more responsive actions, such as by directing the vehicle system to automatically slow down and/or stop, warning other vehicle systems traveling on or toward the conductive component, requesting inspection and/or repair of the potentially damaged section of the conductive component, and the like.

Figure 5:
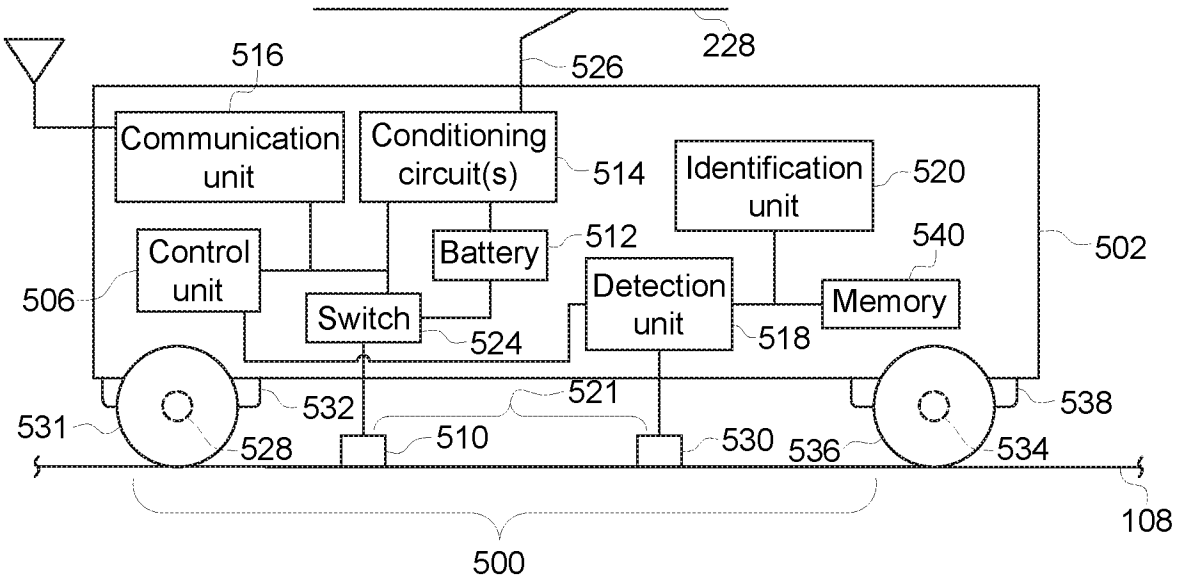
FIG. 5 is a schematic illustration of an embodiment of an examining system.

FIG. 5 is a schematic illustration of an embodiment of an examining system. The examining system 500 may represent the examining system shown in FIG. 1. In contrast to the examining system shown in FIG. 2, the examining system is disposed within a single vehicle 502 in a vehicle system that may include one or more additional vehicles mechanically coupled with the vehicle. The vehicle may represent a propulsion-generating or non-propulsion-generating vehicle of the vehicle system shown in FIG. 1.

The examining system includes an identification unit 520 and a signal communication system 521. The identification unit may be similar to or represent the identification unit shown in FIG. 2. The signal communication system includes at least one application device and at least one detection device and/or unit. In the illustrated embodiment, the signal communication system includes one application device 510 and one detection device 530. The application device and the detection device may be similar to or represent the application device and the detection device, respectively (both shown in FIG. 2). The application device and the detection device may be a pair of transmit and receive coils in different, discrete housings that are spaced apart from each other, as shown in FIG. 5. Alternatively, the application device and the detection device may be a pair of transmit and receive coils held in a common housing. In another alternative embodiment, the application device and the detection device include a same coil, where the coil is configured to inject at least one examination signal into the conductive component and is also configured to monitor one or more electrical characteristics of the conductive component in response to the injection of the at least one examination signal.

In other embodiments shown and described below, the signal communication system may include two or more application devices and/or two or more detection devices or units. Although not indicated in FIG. 5, in addition to the application device and the detection device, the signal communication system may further include one or more switches 524 (which may be similar to or represent the switches shown in FIG. 2), a control unit 506 (which may be similar to or represent the control unit shown in FIG. 2), one or more conditioning circuits 514 (which may be similar to or represent the circuits shown in FIG. 2), an onboard power source 512 ("Battery" in FIG. 5, which may be similar to or represent the power source shown in FIG. 2), and/or one or more detection units 518 (which may be similar to or represent the detection unit shown in FIG. 2). The illustrated embodiment of the examining system may further include a communication unit 516 (which may be similar to or represent the communication unit shown in FIG. 2). As shown in FIG. 5, these components of the examining system are disposed onboard a single vehicle of a vehicle system, although one or more of the components may be disposed onboard a different vehicle of the vehicle system from other components of the examining system. As described above, the control unit 506 controls supply of electric current to the application device that engages or is inductively coupled with the conductive component as the vehicle travels along the conductive component. The application device is conductively coupled with the switch 524 that is controlled by the control unit 506 so that the control unit 506 can turn on or off the flow of electric current through the application device to the conductive component. The power source 512 is coupled with the switch 524 so that the control unit 506 can control when the electric energy stored in the power source 512 and/or the electric current generated by the power source 512 is conveyed as electric current to the conductive component via the application device.

The conditioning circuit 514 may be coupled with a connecting assembly 526 that is similar to or represents the connecting assembly shown in FIG. 2. The connecting assembly 526 receives electric current from an off-board source, such as the electrified conductive pathway. Electric current can be conveyed from the electrified portion of the conductive component through the connecting assembly 526 and to the conditioning circuit 514.

The electric current that is conveyed to the conditioning circuit 514 from the power source 512 and/or the off-board source can be altered by the conditioning circuit 514. The modified current can be the examination signal that is electrically injected into the conductive component by the application device. Optionally, the control unit 506 can form the examination signal by controlling the switch 524, as described above. Optionally, the control unit 506 may control the conditioning circuit 514 to form the examination signal, also as described above.

The examination signal is conducted through the application device to the conductive component, and is electrically injected into a conductive portion of the conductive component. The portion of the conductive component that extends between the application device and the detection device of the vehicle during travel may form a track circuit through which the examination signal may be conducted.

The control unit 506 may include or represent a manager component. Such a manager component can be configured to activate a transmission of electric current into the conductive component via the application device. In another instance, the manager component can activate or deactivate a transfer of the portion of power from the onboard and/or off-board power source to the application device, such as by controlling the switch and/or conditioning circuit. Moreover, the manager component can adjust parameter(s) associated with the portion of power that is transferred to the conductive component.

The detection unit 518 monitors the conductive component to attempt to detect the examination signal that is injected into the conductive component by the application device. In one example, the detection unit 518 may follow behind the application device along a direction of travel of the vehicle. The detection unit 518 is coupled with the detection device that engages or is inductively coupled with the conductive component, as described above.

The detection unit 518 monitors one or more electrical characteristics of the conductive component using the detection device. The detection unit 518 may compare the received signal that is conducted from the conductive component into the detection device with this designated signal to measure a signal-to-noise ratio of the received signal. The detection unit 518 determines one or more electrical characteristics of the signal by the detection device from the conductive component and reports the characteristics of the received signal to the identification unit. If no signal is received by the detection device, then the detection unit 518 may report the absence of such a signal to the identification unit. In an embodiment, the detection unit 518 may determine the characteristics of the signals received by the detection device in response to a notification received from the control unit 506, as described above.

The detection unit 518 may begin monitoring signals received by the detection device. For example, the detection unit 518 may not begin or resume monitoring the received signals of the detection device unless or until the detection unit 518 is instructed that the control unit 506 is causing the injection of the examination signal into the conductive component. Alternatively or additionally, the detection unit 518 may periodically monitor the detection device for received signals and/or may monitor the detection device for received signals upon being manually prompted by an operator of the examining system.

In one example, the application device includes a first axle 528 and/or a first wheel 531 that is connected to the axle 528 of the vehicle. The axle 528 and wheel 531 may be connected to a first truck 532 of the vehicle. The application device may be conductively coupled with the conductive component (e.g., by directly engaging the conductive component) to inject the examination signal into the conductive component via the axle 528 and the wheel 531, or via the wheel 531 alone. The detection device may include a second axle 534 and/or a second wheel 536 that is connected to the axle 534 of the vehicle. The axle 534 and wheel 536 may be connected to a second truck 538 of the vehicle. The detection device may monitor the electrical characteristics of the conductive component via the axle 534 and the wheel 536, or via the wheel 536 alone. Optionally, the axle 534 and/or wheel 536 may inject the signal while the other axle 528 and/or wheel 531 monitors the electrical characteristics.

The identification unit receives the one or more characteristics of the received signal from the detection unit 518 and determines if the characteristics indicate receipt of all or a portion of the examination signal injected into the conductive component by the application device. The identification unit interprets the one or more characteristics monitored by the detection unit 518 to determine a state of the conductive component. The identification unit examines the characteristics and determines if the characteristics indicate that a test section of the conductive component disposed between the application device and the detection device is in a non-damaged state, is in a damaged or at least partially damaged state, or is in a non-damaged state that indicates the presence of an electrical short, as described below.

The identification unit may include or be communicatively coupled with a location determining unit that can determine the location of the vehicle. The distance between the application device and the detection device along the length of the vehicle may be known to the identification unit, such as by inputting the distance into the identification unit using one or more input devices and/or via the communication unit 516.

The identification unit can identify which section of the conductive component is potentially damaged based on the location of the vehicle during transmission of the examination signal through the conductive component, the direction of travel of the vehicle, the speed of the vehicle, and/or a speed of propagation of the examination signal through the conductive component, as described above.

One or more responsive actions may be initiated when the potentially damaged section of the conductive component is identified. For example, in response to identifying the potentially damaged portion of the conductive component, the identification unit may notify the control unit 506. The control unit 506 and/or the identification unit can automatically slow down or stop movement of the vehicle and/or the vehicle system that includes the vehicle. For example, the control unit 506 and/or identification unit can be communicatively coupled with one or more propulsion systems (e.g., engines, alternators/generators, motors, and the like) of one or more of the propulsion-generating vehicles in the vehicle system. The control unit 506 and/or identification unit may automatically direct the propulsion systems to slow down and/or stop.

Figure 4:
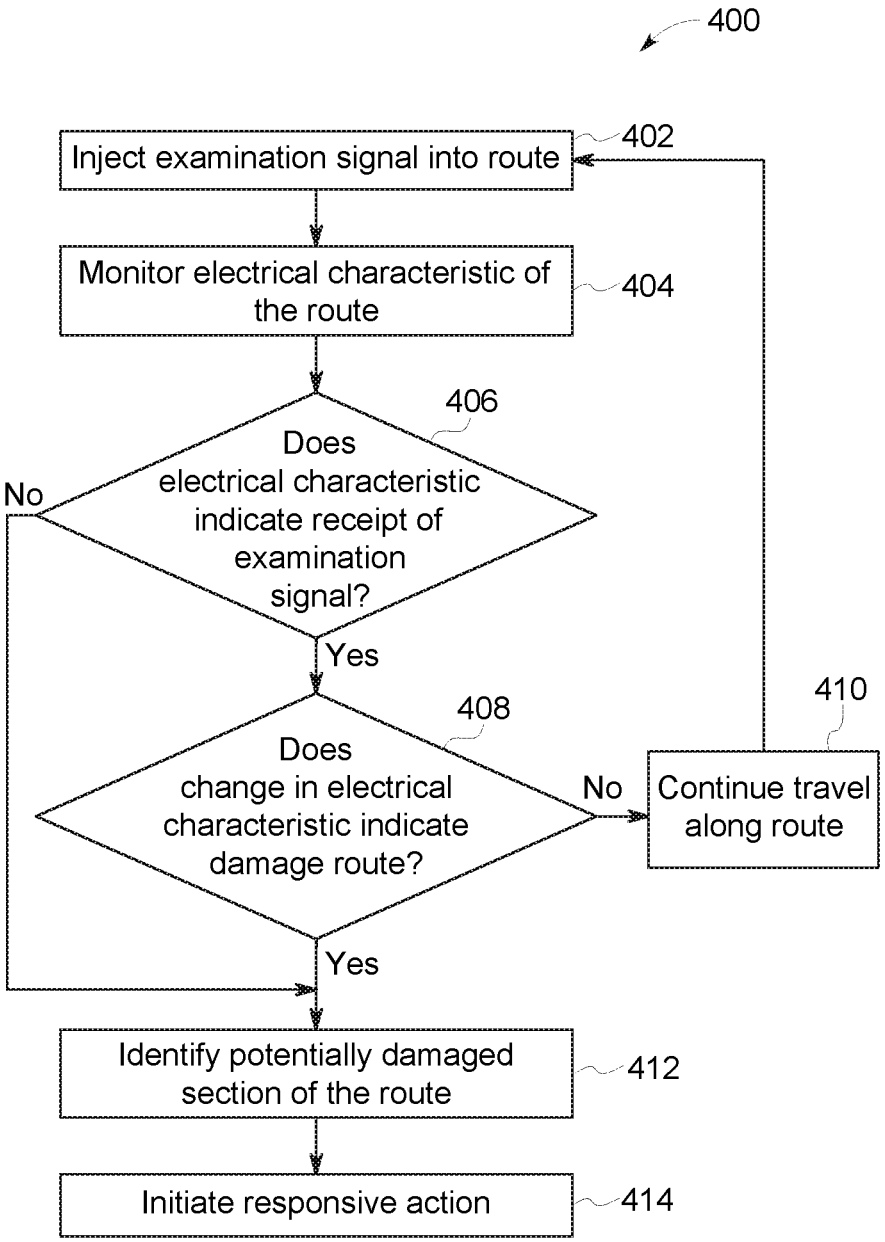
FIG. 4 is a flowchart of an embodiment of a method for examining a route being traveled by a vehicle system from onboard the vehicle system.

FIG. 4 is a flowchart of an embodiment of a method 400 for examining a conductive component being traveled by a vehicle system from onboard the vehicle system. The method may be used in conjunction with one or more embodiments of the vehicle systems and/or examining systems described herein. Alternatively, the method 400 may be implemented with another system.

At step 402, an examination signal is injected into the conductive component being traveled by the vehicle system at a first vehicle. For example, a direct current, alternating current, RF signal, or another signal may be conductively and/or inductively injected into a portion of the conductive component, such as a rail of the route, a catenary, a cable, or the like.

At step 404, one or more electrical characteristics of the conductive component are monitored at another, second vehicle in the same vehicle system. For example, the conductive component may be monitored to determine if any voltage or current is being conducted by the conductive component.

At step 406, a determination is made as to whether the one or more monitored electrical characteristics indicate receipt of the examination signal. For example, if a direct current, alternating current, or RF signal is detected in the conductive component, then the detected current or signal may indicate that the examination signal is conducted through the conductive component from the first vehicle to the second vehicle in the same vehicle system. As a result, the conductive component may be substantially intact between the first and second vehicles. Optionally, the examination signal may be conducted through the conductive component between components joined to the same vehicle. Thus, the conductive component may be substantially intact between the components of the same vehicle. Flow of the method may proceed toward step 408. On the other hand, if no direct current, alternating current, or RF signal is detected in the conductive component, then the absence of the current or signal may indicate that the examination signal is not conducted through the conductive component from the first vehicle to the second vehicle in the same vehicle system or between components of the same vehicle. As a result, the conductive component may be broken between the first and second vehicles, or between the components of the same vehicle. Flow of the method may then proceed toward step 412.

At step 408, a determination is made as to whether a change in the one or more monitored electrical characteristics indicates damage to the conductive component. For example, a change in the examination signal between when the signal was injected into the conductive component and when the examination signal is detected may be determined. This change may reflect a decrease in voltage, a decrease in current, a change in frequency and/or phase, a decrease in a signal-to-noise ratio, or the like. The change can indicate that the examination signal was conducted through the conductive component, but that damage to the conductive component may have altered the signal. For example, if the change in voltage, current, frequency, phase, signal-to-noise ratio, or the like, of the injected examination signal to the detected examination signal exceeds a designated threshold amount (or if the monitored characteristic decreased below a designated threshold), then the change may indicate damage to the conductive component, but not a complete break in the conductive component. Thus, flow of the method can proceed to step 412.

On the other hand, if the change in voltage, amps, frequency, phase, signal-to-noise ratio, or the like, of the injected examination signal to the detected examination signal does not exceed the designated threshold amount (and/or if the monitored characteristic does not decrease below a designated threshold), then the change may not indicate damage to the conductive component. As a result, flow of the method can proceed toward step 410.

At step 410, the test section of the conductive component that is between the first and second vehicles in the vehicle system or between the components of the same vehicle is not identified as potentially damaged, and the vehicle system may continue to travel along the conductive component. Additionally examination signals may be injected into the conductive component at other locations as the vehicle system moves along the conductive component.

At step 412, the section of the conductive component that is or was disposed between the first and second vehicles, or between the components of the same vehicle, is identified as a potentially damaged section of the conductive component. For example, due to the failure of the examination signal to be detected and/or the change in the examination signal that is detected, the conductive component may be broken and/or damaged between the first vehicle and the second vehicle, or between the components of the same vehicle.

At step 414, one or more responsive actions may be initiated in response to identifying the potentially damaged section of the conductive component. As described above, these actions can include, but are not limited to, automatically and/or manually slowing or stopping movement of the vehicle system, warning other vehicle systems about the potentially damaged section of the conductive component, notifying wayside devices of the potentially damaged section of the conductive component, requesting inspection and/or repair of the potentially damaged section of the conductive component, and the like.

In one or more embodiments, an examining system and method may be used to identify electrical shorts, or short circuits, on a conductive component. While the description that follows describes examination of a route, one or more embodiments of this subject matter also may be used to examine other conductive bodies, such as catenaries, electrified rails, cables, wires, or the like. Reference to a route is not intended to limit all embodiments of the claimed subject matter to inspection of a route unless a claim is clearly and unambiguously limited to examination of a route. The identification of short circuits may allow for the differentiation of a short circuit on a non-damaged section of the route from a broken or deteriorated track on a damaged section of the route. The differentiation of short circuits from open circuits caused by various types of damage to the route provides identification of false alarms. Detecting a false alarm preserves the time and costs associated with attempting to locate and repair a section of the route that is not actually damaged. For example, referring to the method 400 above at step 408, a change in the monitored electrical characteristics may indicate that the test section of the route includes an electrical short that short circuits the two tracks together. For example, an increase in the amplitude of monitored voltage or current and/or a phase shift may indicate the presence of an electrical short. The electrical short provides a circuit path between the two tracks, which effectively reduces the circuit path of the propagating examination signal between the point of injection and the place of detection, which results in an increased voltage and/or current and/or the phase shift.

Figure 6:
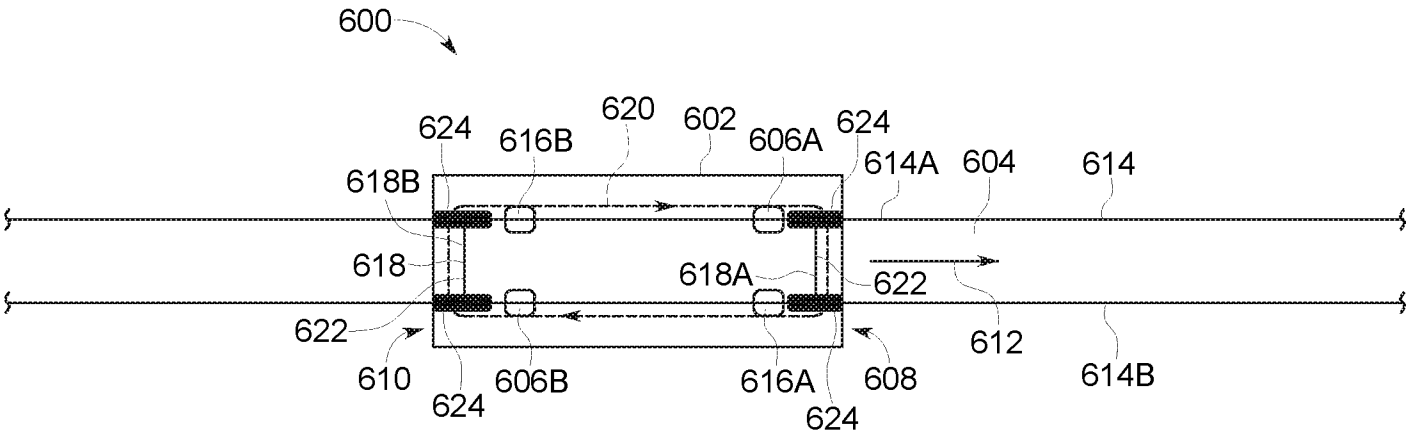
FIG. 6 is a schematic illustration of an embodiment of an examining system on a vehicle of a vehicle system traveling along a route.

FIG. 6 is a schematic illustration of an embodiment of an examining system 600 on a vehicle 602 of a vehicle system (not shown) traveling along a route 604. The examining system may represent the examining system shown in FIG. 1 and/or the examining system shown in FIG. 2. In contrast to the examining system, the examining system may be disposed within a single vehicle. The vehicle may represent at least one of the vehicles of the vehicle system shown in FIG. 1. FIG. 6 may be a top-down view looking at least partially through the vehicle. The examining system may be utilized to identify short circuits and breaks on a route, such as a railway track, for example. The vehicle may be one of multiple vehicles of the vehicle system, so the vehicle may be referred to herein as a first vehicle. While the description that follows describes examination of a route, one or more embodiments of this subject matter also may be used to examine other conductive bodies, such as catenaries, electrified rails, cables, wires, or the like, that are arranged in parallel or with sections of each that are arranged or may be arranged in parallel in an electric circuit. Reference to a route is not intended to limit all embodiments of the claimed subject matter to inspection of a route unless a claim is clearly and unambiguously limited to examination of a route.

The vehicle may include multiple transmitters or application devices 606 disposed onboard the vehicle. The application devices may be positioned at spaced apart locations along the length of the vehicle. For example, a first application device 606A may be located closer to a front end 608 of the vehicle relative to a second application device 606B located closer to a rear end 610 of the vehicle. The designations of "front" and "rear" may be based on the direction of travel of the vehicle along the route.

The route may include conductive rails 614 in parallel, and the application devices are configured to be conductively and/or inductively coupled with at least one conductive rail along the route. For example, the conductive rails may be rails in a railway context. In an embodiment, the first application device is configured to be conductively and/or inductively coupled with a first conductive rail 614A, and the second application device is configured to be conductively and/or inductively coupled with a second conductive rail 614B. As such, the application devices may be disposed on the vehicle diagonally from each other. The application devices are utilized to electrically inject at least one examination signal into the route. For example, the first application device may be used to inject a first examination signal into the first conductive rail of the route. Likewise, the second application device may be used to inject a second examination signal into the second conductive rail of the route. Optionally, the signals may be injected into other conductive bodies, such as electrified rails, catenaries, parallel cables, or the like.

The vehicle also includes multiple receiver coils or detection units disposed onboard the vehicle. The detection units 616 are positioned at spaced apart locations along the length of the vehicle. For example, a first detection unit 616A may be located towards the front end of the vehicle relative to a second detection unit 616B located closer to the rear end of the vehicle. The detection units are configured to monitor one or more electrical characteristics of the route along the conductive rails in response to the examination signals being injected into the route. The electrical characteristics that are monitored may include a current, a phase shift, a modulation, a frequency, a voltage, an impedance, and the like. For example, the first detection unit may be configured to monitor one or more electrical characteristics of the route along the second rail, and the second detection unit may be configured to monitor one or more electrical characteristics of the route along the first rail. As such, the detection units may be disposed on the vehicle diagonally from each other. In an embodiment, each of the application devices and the detection units may define individual corners of a test section of the vehicle. Optionally, the application devices and/or the detection units may be staggered in location along the length and/or width of the vehicle. Optionally, the application device 606A and detection unit 616A and/or the application device 606B and detection unit 616B may be disposed along the same rail. The application devices and/or detection units may be disposed on the vehicle at other locations in other embodiments.

In an embodiment, two of the conductive rails (e.g., rails 614A and 614B) may be conductively and/or inductively coupled to each other through multiple shunts 618 along the length of the vehicle. For example, the vehicle may include two shunts, with one shunt 618A located closer to the front of the vehicle relative to the other shunt 618B. In an embodiment, the shunts are conductive and together with the rails define an electrically conductive test loop 620. The conductive test loop represents a track circuit or circuit path along the conductive rails between the shunts. The test loop may move along the rails as the vehicle travels along the route in the direction 612. Therefore, the section of the conductive rails defining part of the conductive test loop changes as the vehicle progresses on a trip along the route.

In an embodiment, the application devices and the detection units are in electrical contact with the conductive test loop. For example, the application device 606A may be in electrical contact with rail 614A and/or shunt 618A; the application device 606B may be in electrical contact with rail 614B and/or shunt 618B; the detection unit 616A may be in electrical contact with rail 614B and/or shunt 618A; and the detection unit 616B may be in electrical contact with rail 614A and/or shunt 618B.

The two shunts 618A, 618B may be first and second trucks 532, 538 disposed on a rail vehicle. Each truck includes an axle 622 interconnecting two wheels 624. Each wheel contacts a respective one of the rails. The wheels and the axle of each of the trucks may electrically connect (e.g., short) the rails to define respective ends of the conductive test loop. For example, the injected first and second examination signals may circulate the conductive test loop 620 along the length of a section of the first rail 614A, through the wheels and axle of the shunt 618A to the second rail 614B, along a section of the second rail 614B, and across the shunt 618B, returning to the first rail 614A.

In an embodiment, alternating current transmitted from the vehicle is injected into the route at two or more points through the rails and received at different locations on the vehicle. For example, the first and second application devices may be used to inject the first and second examination signals into respective first and second rails. One or more electrical characteristics in response to the injected examination signals may be received at the first and second detection units. Each examination signal may have a unique identifier so the signals can be distinguished from each other at the detection units. For example, the unique identifier of the first examination signal may have a base frequency, a phase, a modulation, an embedded signature, and/or the like, that differs from the unique identifier of the second examination signal.

In an embodiment, the examining system may be used to more precisely locate faults on track circuits in railway signaling systems, and to differentiate between track features. For example, the system may be used to distinguish broken tracks (e.g., rails) versus crossing shunt devices, non-insulated switches, scrap metal connected across the rails, and other situations or devices that might produce an electrical short (e.g., short circuit) when a current is applied to the conductive rails along the route. In typical track circuits looking for damaged sections of routes, an electrical short may appear as similar to a break, creating a false alarm. The examining system also may be configured to distinguish breaks in the route due to damage from intentional, non-damaged "breaks" in the route, such as insulated joints and turnouts (e.g., track switches), which simulate actual breaks but do not short the conductive test loop when traversed by a vehicle system having the examining system.

In an embodiment, when there is no break or short circuit on the route and the rails are electrically contiguous, the injected examination signals circulate the length of the test loop and are received by all detection units present on the test loop. Therefore, both detection units receive both the first and second examination signals when there is no electrical break or electrical short on the route within the section of the route defining the test loop.

As discussed further below, when the vehicle passes over an electrical short (e.g., a device or a condition of a section of the route that causes a short circuit when a current is applied along the section of the route), two additional conductive current loops or conductive short loops are formed. The two additional conductive short loops have electrical characteristics that are unique to a short circuit (e.g., as opposed to electrical characteristics of an open circuit caused by a break in a rail). For example, the electrical characteristics of the current circulating the first conductive short loop may have an amplitude that is an inverse derivative of the amplitude of the second additional current loop as the electrical short is traversed by the vehicle. In addition, the amplitude of the current along the original conductive test loop spanning the periphery of the test section diminishes considerably while the vehicle traverses the electrical short. All of the one or more electrical characteristics in the original and additional current loops may be received and/or monitored by the detection units. Sensing the two additional short loops may provide a clear differentiator to identify that the loss of current in the original test loop is the result of a short circuit and not an electrical break in the rail. Analysis of the electrical characteristics of the additional short loops relative to the vehicle motion and/or location may provide more precision in locating the short circuit within the span of the test section.

In an alternative embodiment, the examining system includes the two spaced-apart detection units defining a test section of the route therebetween, but only includes one of the application devices, such as only the first application device. The detection units are each configured to monitor one or more electrical characteristics of at least one of the conductive rails proximate to the respective detection unit in response to at least one examination signal being electrically injected into at least one of the conductive rails by the first application device. In another alternative embodiment, the examining system includes the two spaced-apart detection units, but does not include either of the application devices. For example, the examination signal may be derived from an inherent electrical current of a traction motor (not shown) of the vehicle (or another vehicle of the vehicle system). The examination signal may be injected into at least one of the conductive rails via a conductive and/or inductive electrical connection between the traction motor and the one or both conductive rails, such as a conductive connection through the wheels. In other embodiments, the examination signal may be derived from electrical currents of other motors of the vehicle or may be an electrical current injected into the rails from a wayside device.

Regardless of whether the examining system includes one application device or no application devices, the identification unit may examine the one or more electrical characteristics monitored by the first and second detection units to determine a status or integrity of the test section of the conductive portion (e.g., the route, a catenary, a powered or electrified rail, a cable or wire, etc.) based on receipt of the signal. For example, the identification unit can determine whether the electrical characteristic(s) indicate receipt of the examination signal both the first and second detection units, neither of the first or second detection units, or only one of the first or second detection units. The status or integrity of the test section may be potentially compromised (e.g., potentially damaged), uncompromised (e.g., neither damaged nor includes an electrical short), or partially compromised (e.g., not damaged but includes an electrical short). The status of the test section is potentially compromised responsive to neither of the first or second detection units receiving the examination signal. This can indicate an open circuit loop. For example, if the component (e.g., a rail of the route, a cable, a wire, etc.) is broken, there may not be a continuous circuit for the loop (e.g., the circuit is open). The status or integrity of the test section may be determined to be neither damaged nor includes the electrical short responsive to both first and second detection units receiving the examination signal. This can indicate a closed circuit loop with no breaks or interruptions. The status or integrity of the test section may be determined as not damaged but including an electrical short responsive to only one of the first or second detection units receiving the examination signal, indicating one open sub-loop and one closed sub-loop within the loop.

In an alternative embodiment, the vehicle includes the two spaced-apart application devices defining a test section of the route therebetween, but only includes one of the detection units, such as only the first detection unit. The first and second application devices are configured to electrically inject the first and second examination signals, respectively, into the corresponding conductive rails that the application devices are coupled to. The first detection unit is configured to monitor one or more electrical characteristics of at least one of the conductive rails in response to the first and second examination signals being injected into the rails.

In this embodiment, the identification unit may examine the one or more electrical characteristics monitored by the first detection unit to determine a status of the test section of the route based on whether the one or more electrical characteristics indicate receipt by the first detection unit of both the first and second examination signals, neither the first or second examination signals, or only one of the first or second examination signals. The status of the test section may be potentially damaged or compromised responsive to the one or more electrical characteristics indicate receipt by the first detection unit of neither the first nor second examination signals, indicating an open circuit loop. The status of the test section may be neither damaged nor includes an electrical short when the one or more electrical characteristics indicate receipt by the detection unit A of both the first and second examination signals, indicating a closed circuit loop. The status of the test section is not damaged and includes an electrical short when the one or more electrical characteristics indicate receipt by the detection unit A of only one of the first or second examination signals, indicating one open circuit sub-loop and one closed circuit sub-loop within the loop.

Additionally, or alternatively, the identification unit may determine that the test section of the route includes an electrical short by detecting a change in a phase difference between the first and second examination signals. For example, the identification unit may compare a detected phase difference between the first and second examination signals that is detected by the first detection unit to a known phase difference between the first and second examination signals. The known phase difference may be a phase difference between the examination signals upon injecting the signals into the route or may be a detected phase difference between the examination signals along sections of the route that are known to be not damaged and free of electrical shorts. Thus, if the one of more electrical characteristics monitored by the first detection unit indicate that the phase difference between the first and second examination signals is similar to the known phase difference, such that the change in phase difference is negligible or within a threshold value that compensates for variations due to noise, etc., then the status of the test section of route may be non-damaged and free of an electrical short. If the detected phase difference varies from the known phase difference by more than the designated threshold value (such that the change in phase difference exceeds the designated threshold), the status of the test section of route may be non-damaged and includes an electrical short. If the test section of the route is potentially damaged, the one or more monitored electrical characteristics may indicate that the examination signals were not received by the first detection unit, so the phase difference between the first and second examination signals is not detected.

In another embodiment, the vehicle includes one application device, such as the first application device, and one detection unit, such as the first detection unit. The application device is disposed proximate to the detection unit. For example, the application device and the detection unit may be located on opposite rails at similar positions along the length of the vehicle between the two shunts, as shown in FIG. 6, or may be located on the same rail proximate to each other. The application device is configured to electrically inject at least one examination signal into the rails, and the detection unit is configured to monitor one or more electrical characteristics of the rails in response to the at least one examination signal being injected into the conductive test loop 620.

In this embodiment, the identification unit may examine the one or more electrical characteristics monitored by the detection unit to determine a status of a test section of the route that extends between the shunts. The identification unit may determine that the status of the test section is potentially damaged when the one or more electrical characteristics indicate that the at least one examination signal is not received by the detection unit. The status of the test section may be neither damaged nor include an electrical short while the one or more electrical characteristics indicate that the at least one examination signal is received by the detection unit. The status of the test section may be not damaged but include an electrical short when the one or more electrical characteristics indicate a phase shift in the at least one examination signal and/or an increased amplitude of the at least one examination signal. The amplitude may be increased over a base line amplitude that is detected or measured when the status of the test section is not damaged and does not include an electrical short. The increased amplitude may gradually increase from the base line amplitude, such as when the detection unit and application device of the signal communication system move towards the electrical short in the route, and may gradually decrease towards the base line amplitude, such as when the detection unit and application device move away from the electrical short.

Figure 7:
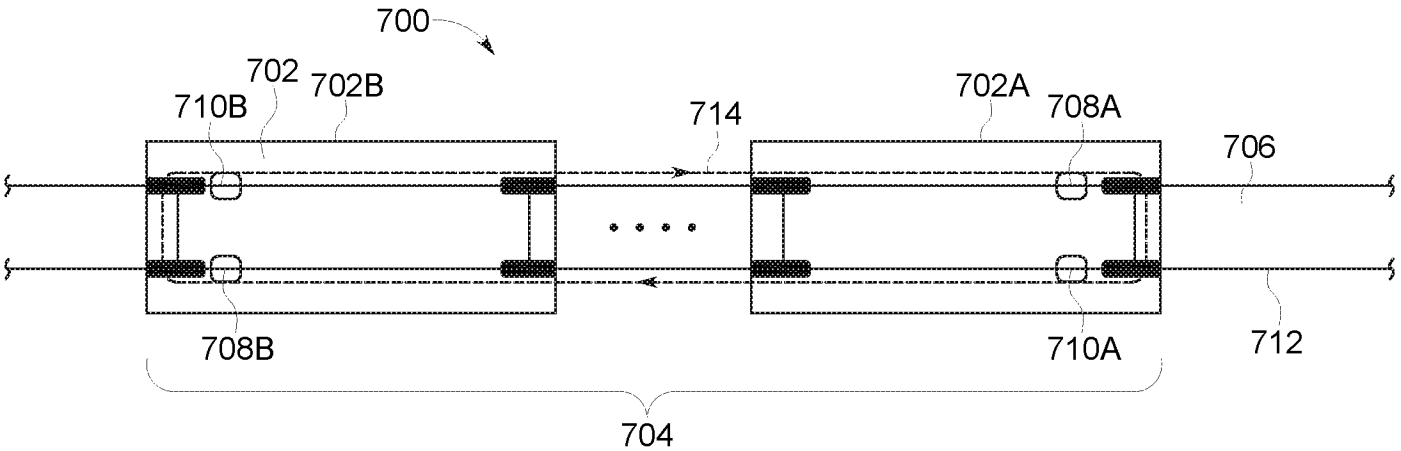
FIG. 7 is a schematic illustration of an embodiment of an examining system disposed on multiple vehicles of a vehicle system traveling along a route.

FIG. 7 is a schematic illustration of an embodiment of an examining system 700 disposed on multiple vehicles 702 of a vehicle system 704 traveling along a route 706. The examining system may represent the examining system shown in FIG. 6. In contrast to the examining system shown in FIG. 6, the examining system shown in FIG. 7 may be disposed on multiple vehicles in the vehicle system.

In an embodiment, the examining system includes a first application device 708A that may be disposed on a first vehicle 702A of the vehicle system, and a second application device 708B that may be disposed on a second vehicle 702B of the vehicle system. The application devices may be conductively and/or inductively coupled with different conductive bodies 712 (e.g., rails, cables, catenaries, etc.). In one embodiment, the application devices may be disposed diagonally relative to a direction of travel of the vehicle system. The first and second vehicles may be directly coupled, or may be indirectly coupled, having one or more additional vehicles coupled in between the vehicles. Optionally the vehicles may each be either one of the propulsion-generating or non-propulsion-generating vehicles shown in FIG. 1. Optionally, the second vehicle may trail the first vehicle during travel of the vehicle system along the route.

The examining system also includes a first detection unit 710A configured to be disposed on the first vehicle of the vehicle system, and a second detection unit 710B configured to be disposed on the second vehicle of the vehicle system. The first and second detection units may monitor electrical characteristics of different conductive bodies along the route. This may be done so that the detection units are oriented diagonally along the vehicle system. The location of the first application device and/or first detection unit along the length of the first vehicle is optional, as well as the location of the second application device and/or second detection unit along the length of the second vehicle. However, the location of the application devices may affect the length of a current loop that defines a test loop 714. For example, the test loop may span a greater length of the route than the test loop shown in FIG. 6. Increasing the length of the test loop may increase the amount of signal loss as the electrical examination signals are diverted along alternative conductive paths, which diminishes the capability of the detection units to identify or determine the electrical characteristics. Optionally, the application devices and detection units may be disposed on adjacent vehicles and proximate to the coupling mechanism that couples the adjacent vehicles, such that the defined conductive test loop may be smaller in length than the conductive test loop shown in FIG. 6 onboard the single vehicle.

Figure 8:
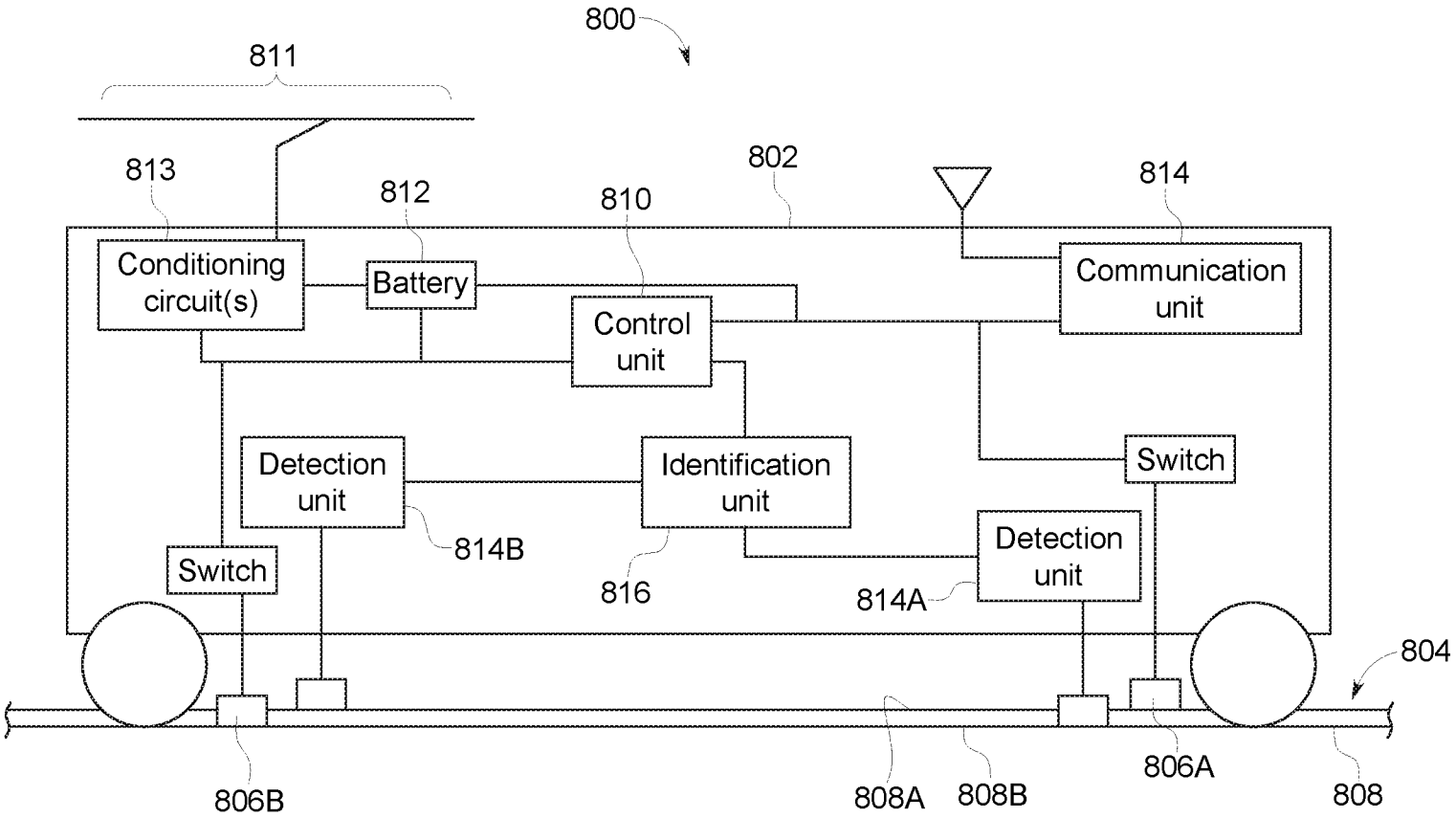
FIG. 8 is a schematic diagram of an embodiment of an examining system on a vehicle of a vehicle system on a route.

FIG. 8 is a schematic diagram of an embodiment of an examining system 800 on a vehicle 802 of a vehicle system (not shown) on a route 804. The examining system may represent one or more of the other examining systems described herein. In contrast to the examining system shown in FIG. 2, the examining system shown in FIG. 8 may be disposed within a single vehicle. The vehicle shown in FIG. 1 may represent at least one of the propulsion-generating or non-propulsion-generating vehicles shown in FIG. 1.

The examining system includes a first application device 806A that is conductively and/or inductively coupled to a first conductive body 808A along the route (e.g., a rail, catenary, or the like), and a second application device 806B that is conductively and/or inductively coupled to a second conductive body 808B along the route. A control unit 810 may control supply of electric current from one or more power sources 811 (e.g., battery 812 and/or conditioning circuits 813) to the first and second application devices to electrically inject examination signals into the conductive bodies. For example, the control unit may control the application of a first examination signal into the first conductive body via the first application device and the application of a second examination signal into the second conductive body via the second application device.

The control unit may control application of a designated direct current, a designated alternating current, and/or a designated radio frequency signal of each of the first and second examination signals from the power source to the conductive bodies of the route. For example, the power source may be an onboard energy storage device (e.g., battery, capacitor, flywheel, fuel cell, etc.) and the control unit may inject the first and second examination signals into the conductive bodies by controlling when electric current is conducted from the onboard energy storage device to the first and second application devices. Alternatively or in addition, the power source may include an off-board energy storage device 811 (e.g., catenary and conditioning circuits) and the control unit may inject the first and second examination signals into the conductive bodies by controlling when electric current is conducted from the off-board energy storage device to the first and second application devices.

The vehicle also may include a first detection unit 814A that may monitor one or more electrical characteristics of the second conductive body, and a second detection unit 814B that may monitor one or more electrical characteristics of the first conductive body. An identification unit 816 is disposed onboard the vehicle and may examine the one or more electrical characteristics of the conductive bodies monitored by the detection units to determine whether a section of the bodies is potentially damaged based on the one or more electrical characteristics. As used herein, "potentially damaged" means that the section of the bodies may be damaged, worn or deteriorated, or the integrity of adjacent components may be deteriorated (such as worn or cracked insulation). The identification unit may determine whether the section of the bodies is damaged by distinguishing between one or more electrical characteristics that indicate damage to the section of the bodies and one or more electrical characteristics that indicate an electrical short on the section of the route.

The examining system can include or be connected with a communication unit 814, which can represent one or more of the communication units described above. The identification unit and/or control unit can communicate an inspection signal to one or more off-board locations using the communication unit to notify the off-board location(s) of the detection of damage to the bodies (or the absence of damage).

Figure 9:
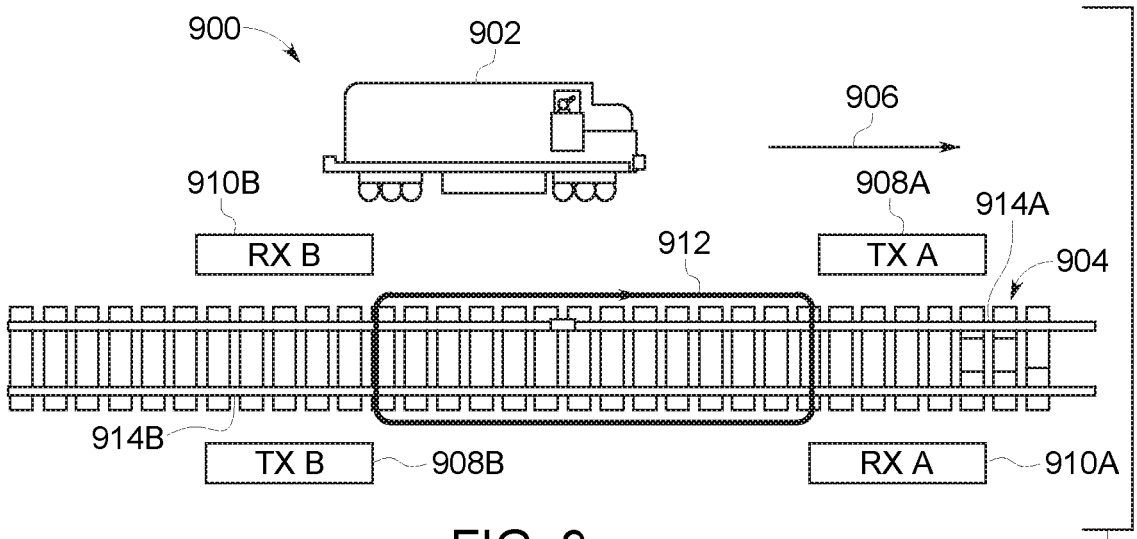
FIG. 9 is a schematic illustration of an embodiment of an examining system on a vehicle as the vehicle travels along a route.
Figure 10:
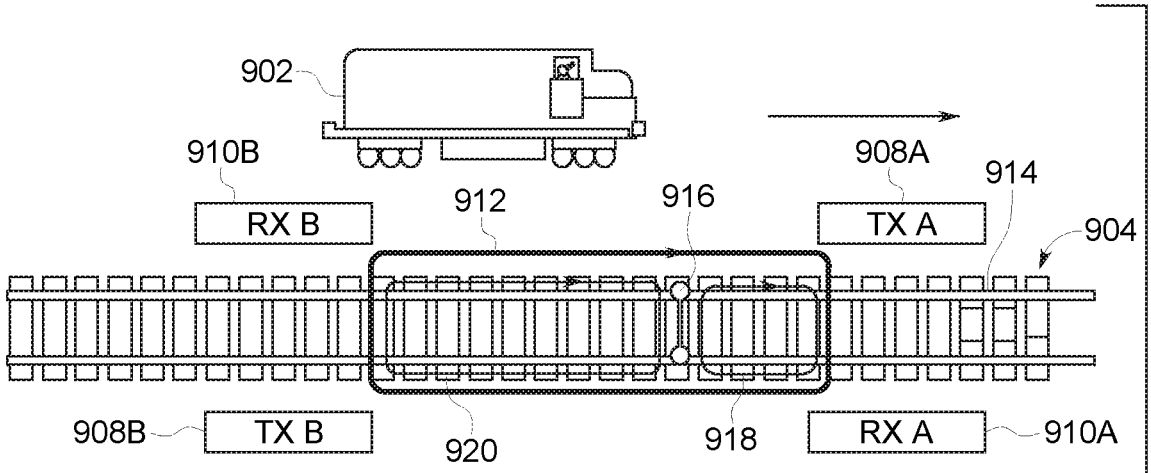
FIG. 10 is another schematic illustration of an embodiment of an examining system on a vehicle as the vehicle travels along a route.
Figure 11:
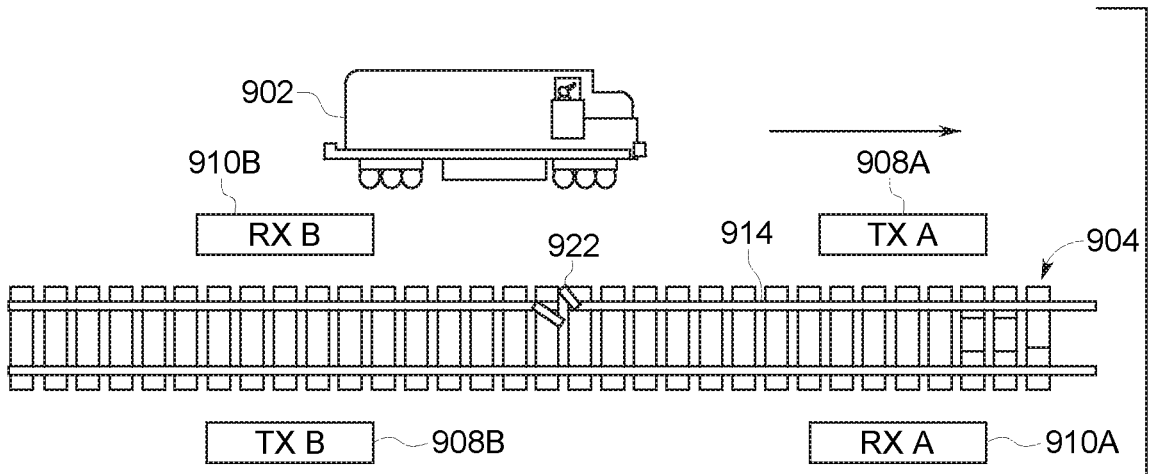
FIG. 11 is another schematic illustration of an embodiment of an examining system on a vehicle as the vehicle travels along a route.

FIGS. 9 through 11 are schematic illustrations of an embodiment of an examining system 900 on a vehicle 902 as the vehicle travels along a route 904. The examining system may be one or more of the examining systems described herein. The vehicle may be one or more of the vehicles described herein. FIGS. 9 through 11 illustrate various conditions that the vehicle may encounter while traversing in a travel direction 906 along the route.

The vehicle includes two transmitters or application units or devices 908A and 908B, and two receivers or detection units 910A and 910B onboard the vehicle. The application units and detection units are positioned along a conductive loop 912 defined by shunts on the vehicle and conductive portions (e.g., rails) of the route between the shunts. For example, the vehicle may include six axles, each axle attached to two wheels in electrical contact with the rails and forming a shunt. Optionally, the conductive loop may be bounded between the inner most axles (e.g., between the third and fourth axles) to reduce the amount of signal loss through the other axles and/or the vehicle frame. As such, the third and fourth axles define the ends of the conductive loop, and the rails define the segments of the conductive loop that connect the ends.

The conductive loop defines a test loop (e.g., test section) for evaluating the integrity of the conductive bodies (e.g., detecting faults in the route and distinguishing damaged rails from short circuit false alarms). As the vehicle traverses the route, a first examination signal is injected into a first rail of the route from the first application unit, and a second examination signal is injected into a second track of the route from the second application unit. The first and second examination signals may be injected into the route simultaneously, concurrently, or in a staggered sequence. The first and second examination signals can each have a unique identifier to distinguish the first examination signal from the second examination signal as the signals circulate the test loop. The unique identifier of the first examination signal may include a frequency, a modulation, an embedded signature, and/or the like, that differs from the unique identifier of the second examination signal. For example, the first examination signal may have a higher frequency and/or a different embedded signature than the second examination signal. Alternatively, the examination signals may have different frequencies to allow for differentiation of the signals from each other. For example, the first examination signal may be injected into the route at a frequency of 4.6 kilohertz (kHz), or another frequency, while the second examination signal is injected into the route at a frequency of 3.8 kHz (or another frequency). In one embodiment, the signals may have different identifiers and different frequencies.

In FIG. 9, the vehicle traverses over a section of the route that is intact (e.g., not damaged) and does not have an electrical short. Since there is no electrical short or electrical break on the route within the area of the conductive test loop, which is the area between two designated shunts (e.g., axles) of the vehicle, the first and second examination signals both circulate a full length of the test loop. As such, the first examination signal current transmitted by the first application device is detected by both the first detection device and the second detection device as the first examination signal current flows around the test loop. Although the second examination signal is injected into the route at a different location, the second examination signal current circulates the test loop with the first examination signal current, and is likewise detected by both detection devices. Each of the detection devices may be configured to detect one or more electrical characteristics along the route proximate to the respective detection device. Therefore, when the section of route is free of shorts and breaks, the electrical characteristics received by each of the detection devices include the unique signatures of each of the first and second examination signals.

In FIG. 10, the vehicle traverses over a section of the route that includes an electrical short 916. The electrical short may be a device on the route or condition of the route that conductively and/or inductively couples the conductive bodies (e.g., conductively couples the rails, conductively couples a rail with another conductive body, such as a catenary, or the like). The electrical short may cause current injected in one conductive body to flow through the short to the other conductive body instead of flowing along the full length of the conductive test loop and crossing between the conductive bodies at the shunts. For example, the short may be a piece of scrap metal or other extraneous conductive device positioned across the rails, a non-insulated signal crossing or switch, an insulated switch or joint in the rails that is non-insulated due to wear or damage, and the like. As the vehicle traverses along route over the electrical short, such that the short is at least temporarily located between the shunts within the area defined by the test loop, the test loop may short circuit.

As the vehicle traverses over the electrical short, the electrical short diverts the current flow of the first and second examination signals that circulate the test loop to additional loops. For example, the first examination signal may be diverted by the short to circulate primarily along a first conductive short loop 918 that is newly-defined along a section of the route between the first application device and the electrical short. Similarly, the second examination signal may be diverted to circulate primarily along a second conductive short loop 920 that is newly-defined along a section of the route between the electrical short and the second application device. Only the first examining signal that was transmitted by the first application device significantly traverses the first short loop, and only the second examination signal that was transmitted by the second application device significantly traverses the second short loop.

Thus, the one or more electrical characteristics of the route received and/or monitored by first detection unit may only indicate a presence of the first examination signal. Likewise, the electrical characteristics of the route received and/or monitored by second detection unit may only indicate a presence of the second examining signal. As used herein, "indicat[ing] a presence of" an examination signal means that the received electrical characteristics include more than a mere threshold signal-to-noise ratio of the unique identifier indicative of the respective examination signal that is more than electrical noise. For example, since the electrical characteristics received by the second detection unit may only indicate a presence of the second examination signal, the second examination signal exceeds the threshold signal-to-noise ratio of the received electrical characteristics, but the first examination signal does not exceed the threshold. The first examination signal may not be significantly received at the second detection unit because most the first examination signal current originating at the first detection unit or device may get diverted along the first short loop before traversing the length of the test loop to the second detection device. As such, the electrical characteristics with the unique identifiers indicative of the first examination signal received at the second detection device may be significantly diminished when the vehicle traverses the electrical short.

The peripheral size and/or area of the first and second conductive short loops may have an inverse correlation at the vehicle traverses the electrical short. For example, the first short loop increases in size while the second short loop decreases in size as the test loop of the vehicle overcomes and passes the short. It is noted that the first and second short loops are only formed when the short is located within the boundaries or area covered by the test loop. Therefore, received electrical characteristics that indicate the examination signals are circulating the first and second conductive short loops signify that the section includes an electrical short (e.g., as opposed to a section that is damaged or is fully intact without an electrical short).

In FIG. 11, the vehicle traverses over a section of the route with a conductive body that includes damage or wear, such as an electrical break 922. The electrical break may be damage or wear to one or both conductive bodies that cuts off (e.g., or significantly reduces) the electrically conductive path. Examples of damage may be a broken rail, disconnected lengths of rails, a loose cable, and the like. As such, when a section of the route includes an electrical break, the section of the route forms an open circuit, and current generally does not flow along an open circuit. In some breaks, it may be possible for inductive current to traverse slight breaks, but the amount of current would be greatly reduced as opposed to a non-broken conductive section of the route.

As the vehicle traverses over the electrical break such that the break is located within the boundaries of the test loop (e.g., between designated shunts of the vehicle that define the ends of the test loop), the test loop may be broken, forming an open circuit. As such, the injected first and second examination signals do not circulate the test loop nor along any short loops. The first and second detection units do not receive any significant electrical characteristics in response to the first and second examination signals because the signal current do not flow along the broken test loop. Once, the vehicle passes beyond the break, subsequently injected first and second examination signals may circulate the test section as shown in FIG. 9. It is noted that the vehicle may traverse an electrical break caused by damage to the route without derailing. Some breaks may support vehicular traffic for an amount of time until the damage increases beyond a threshold.

As shown in FIG. 9 through 11, the electrical characteristics along the route that are detected by the detection units may differ whether the vehicle traverses over a section of the route having an electrical short (shown in FIG. 10), an electrical break (shown in FIG. 11), or is electrically contiguous (shown in FIG. 9). The examining system may be configured to distinguish between one or more electrical characteristics that indicate a damaged section of the route and one or more electrical characteristics that indicate a non-damaged section of the route having an electrical short, as discussed further herein.

Figure 12:
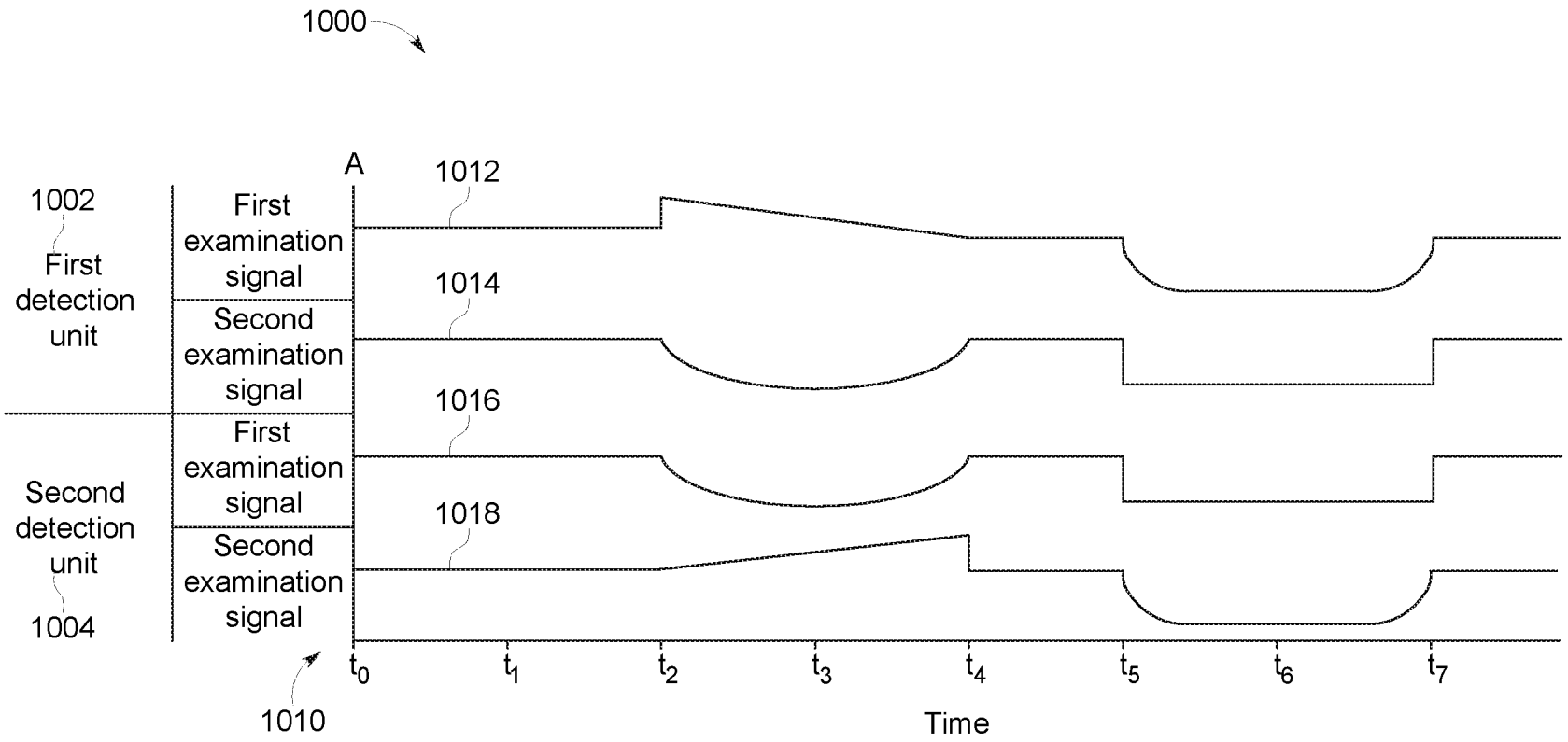
FIG. 12 illustrates electrical signals monitored by an examining system on a vehicle system as the vehicle system travels along a route.

FIG. 12 illustrates electrical signals 1000 monitored by an examining system on a vehicle system as the vehicle system travels along a route. The examining system may be one or more of the examining systems described herein. The vehicle system may include vehicle 902 traveling along the route 904 (both shown in FIG. 9). The electrical signals are one or more electrical characteristics that are received by a first detection unit 1002 and a second detection unit 1002. The electrical signals are received in response to the transmission or injection of a first examination signal and a second examination signal into the route. The first and second examination signals may each include a unique identifier that allows the examining system to distinguish electrical characteristics of a monitored current that are indicative of the first examination signal from electrical characteristics indicative of the second examination signal, even if an electrical current includes both examination signals.

In FIG. 12, the electrical signals are graphically displayed on a graph 1010 plotting amplitude (A) of the signals over time (t). For example, the graph may graphically illustrate the monitored electrical characteristics in response to the first and second examination signals while the vehicle travels along the route and encounters the various route conditions described with reference to FIG. 9. The graph may be displayed on a display device for an operator onboard the vehicle and/or may be transmitted to an off-board location such as a dispatch or repair facility. The first electrical signal 1012 represents the electrical characteristics in response to (e.g., indicative of the first examination signal that are received by the first detection unit. The second electrical signal 1014 represents the electrical characteristics in response to (e.g., indicative of the second examination signal that are received by the first detection unit. The third electrical signal 1016 represents the electrical characteristics in response to (e.g., indicative of the first examination signal that are received by the second detection unit 4. The fourth electrical signal 1018 represents the electrical characteristics in response to (e.g., indicative of) the second examination signal that are received by the second detection unit.

Between times t0 and t2, the electrical signals indicate that both examination signals are being received by both detection units. Therefore, the signals are circulating the length of the conductive primary test loop 912 (shown in FIGS. 9 and 10). At a time t1, the vehicle is traversing over a section of the route that is intact and does not have an electrical short, as shown in FIG. 9. The amplitudes of the electrical signals may be relatively constant at a baseline amplitude for each of the signals. The base line amplitudes need not be the same for each of the signals, such that the electrical signal may have a different base line amplitude than at least one of the other electrical signals 1014-1018.

At time t2, the vehicle traverses over an electrical short. As shown in FIG. 12, immediately after t2, the amplitude of the electrical signal 1012 indicative of the first examination signal received by the first detection unit increases by a significant gain and then gradually decreases towards the base line amplitude. The amplitude of the electrical signal 1014 indicative of the second examination signal received by the first detection unit drops below the base line amplitude for the electrical signal 1014. As such, the electrical characteristics received at the first detection unit 2 indicate a greater significance or proportion of the first examination signal (e.g., due to the first electrical signal circulating newly-defined loop 918 in FIG. 10), while less significance or proportion of the second examination signal than compared to the respective base line levels. At the second detection unit at time t2, the electrical signal 1016 indicative of the first examination signal drops in like manner to the electrical signal received by the first detection unit. The electrical signal 1018 indicative of the second examination signal gradually increases in amplitude above the base line amplitude from time t2 to t4 as the test loop passes the electrical short.

These electrical characteristics from time t2 to t4 indicate that the electrical short defines new circuit loops within the primary test loop (shown in FIGS. 9 and 10). The amplitude of the examination signals that were injected proximate to the respective detection units increase relative to the base line amplitudes, while the amplitude of the examination signals that were injected on the other side of the test loop (and spaced apart) from the respective detection units decrease (or drop) relative to the base line amplitudes. For example the amplitude of the electrical signal 1012 increases by a step right away due to the first examination signal injected by the first application device circulating the newly-defined short loop or sub-loop 918 in FIG. 10 and being received by the first detection unit that is proximate to the first application device. The amplitude of the electrical signal 1012 gradually decreases towards the base line amplitude as the examining system moves relative to the electrical short because the electrical short gets further from the first application device and the first detection unit and the size of the sub-loop increases. The electrical signal 1018 also increases relative to the base line amplitude due to the second examination signal injected by the second application device circulating the newly-defined short loop or sub-loop and being received by the second detection unit that is proximate to the second application device. The amplitude of the electrical signal 1018 gradually increases away from the base line amplitude (until time t4) as the examining system moves relative to the electrical short because the electrical short gets closer to the second application device and second detection unit and the size of the sub-loop 920 decreases. The amplitude of an examination signal may be higher for a smaller circuit loop because less of the signal attenuates along the circuit before reaching the corresponding detection unit than an examination signal in a larger circuit loop. The positive slope of the electrical signal 1018 may be inverse from the negative slope of the electrical signal 1012. For example, the amplitude of the electrical signal 1012 monitored by the first detection device may be an inverse derivative of the amplitude of the electrical signal 1018 monitored by the second detection device. This inverse relationship is due to the movement of the vehicle relative to the stationary electrical short along the route. Referring also to FIG. 10, time t3 may represent the electrical signals 1012-1018 when the electrical short 916 bisects the test loop 912, and the short loops 918, 920 have the same or similar size.

At time t4, the test section (e.g., loop) of the vehicle passes beyond the electrical short. Between times t4 and t5, the electrical signals on the graph indicate that both the first and second examination signals once again circulate the primary test loop, as shown in FIG. 9.

At time t5, the vehicle traverses over an electrical break in the route. As shown in FIG. 12, immediately after t5, the amplitude of each of the electrical signals 1012-1018 decreases or drops by a significant step. Throughout the length of time for the test section to pass the electrical break in the route, represented as between times t5 and t7, all four signals 1012-1018 are at a low or at least attenuated amplitude, indicating that the first and second examination signals are not circulating the test loop due to the electrical break in the route. Time t6 may represent the location of the electrical break 922 relative to the examining system as shown in FIG. 11.

In an embodiment, the identification unit may be configured to use the received electrical signals to determine whether a section of the route traversed by the vehicle is potentially damaged, meaning that the section may be damaged or at least deteriorated. For example, based on the recorded waveforms of the electrical signals between times t2-t4 and t5-t7, the identification unit may identify the section of the route traversed between times t2-t4 as being non-damaged but having an electrical short and the section of route traversed between times t5-t7 as being damaged. For example, it is clear in the graph that the receiver coils or detection units both lose signal when the vehicle transits the damaged section of the route between times t5-t7. However, when crossing the short on the route between times t2-t4, the first detection unit loses the second examination signal, as shown on the electrical signal 1014, and the electrical signal 1018 representing second examination signal received by the second detection unit increases in amplitude as the short is transited. Thus, there is a noticeable distinction between a break in the track versus features that short the route. Optionally, a vehicle operator may view the graph on a display and manually identify sections of the route as being damaged or non-damaged but having an electrical short based on the recorded waveforms of the electrical signals.

In an embodiment, the examining system may be further used to distinguish between non-damaged track features by the received electrical signals. For example, wide band shunts (e.g., capacitors) may behave similar to hard wire highway crossing shunts, except an additional phase shift may be identified depending on the frequencies of the first and second examination signals. Narrow band (e.g., tuned) shunts may impact the electrical signals by exhibiting larger phase and amplitude differences responsive to the relation of the tuned shunt frequency and the frequencies of the examination signals.

The examining system may also distinguish electrical circuit breaks due to damage from electrical breaks (e.g., pseudo-breaks) due to intentional track features, such as insulated joints and turnouts (e.g., track switches). In turnouts, in specific areas, only a single pair of transmit and receive coils (e.g., a single application device and detection unit located along one conductive track) may be able to inject current (e.g., an examination signal). The pair on the opposite track (e.g., rail) may be traversing a "fouling circuit," where the opposite track is electrically connected at only one end, rather than part of the circulating current loop.

Regarding insulated joints, for example, distinguishing insulated joints from broken rails may be accomplished by an extended signal absence in the primary test loop caused by the addition of a dead section loop. As is known in the art, railroad standards typically indicate the required stagger of insulated joints to be 32 in. to 56 in. In addition to the insulated joint providing a pseudo-break with an extended length, detection may be enhanced by identifying location specific signatures of signaling equipment connected to the insulated joints, such as batteries, track relays, electronic track circuitry, and the like. The location specific signatures of the signaling equipment may be received in the monitored electrical characteristics in response to the current circulating the newly-defined short loops 918, 920 (shown in FIG. 9) through the connected equipment. For example, signaling equipment that is typically found near an insulated joint may have a specific electrical signature or identifier, such as a frequency, modulation, embedded signature, and the like, that allows the examination system to identify the signaling equipment in the monitored electrical characteristics. Identifying signaling equipment typically found near an insulated joint provides an indication that the vehicle is traversing over an insulated joint in the route, and not a damaged section of the route.

In the alternative embodiment described with reference to FIG. 6 in which the examining system includes at least two detection units that are spaced apart from each other but less than two application devices (such as zero or one) such that only one examination signal is injected into the route, the monitored electrical characteristics along the route by the two detection units may be shown in a graph similar to graph. For example, the graph may include the plotted electrical signals 1012 and 1016, where the electrical signal 1012 represents the examination signal detected by or received at the first detection unit 2, and the electrical signal 1016 represents the examination signal detected by or received at the second detection unit. Using only the plotted amplitudes of the electrical signals 1012 and 1016 (instead of also 1014 and 1018), the identification unit may determine the status of the route. Between times t0 and t2, both signals 1012 and 1016 are constant (with a slope of zero) at base line values. Thus, the one or more electrical characteristics indicate that both detection units receive the examination signal, and the identification unit determines that the section of the route is non-damaged and does not include an electrical short. Between times t2- and t4, the first detection unit detects an increased amplitude of the examination signal above the base line (although the slope is negative), while the second detection unit detects a drop in the amplitude of the examination signal. Thus, the one or more electrical characteristics indicate that the first detection unit receives the examination signal, but the second detection unit does not, and the identification unit determines that the section of the route includes an electrical short. Finally, between times t5 and t7, both the first and second detection units detect drops in the amplitude of the examination signal. Thus, the one or more electrical characteristics indicate that neither of the detection units receive the examination signal, and the identification unit determines that the section of the route is potentially damaged. Alternatively, the examination signal may be the second examination signal shown in the graph such that the electrical signals are the plotted electrical signals 1014 and 1018 instead of 1012 and 1016.

In the alternative embodiment described with reference to FIG. 6 in which the examining system includes at least two application devices that are spaced apart from each other but only one detection unit, the monitored electrical characteristics along the route by the detection unit may be shown in a graph similar to graph. For example, the graph may include the plotted electrical signals 1012 and 1014, where the electrical signal 1012 represents the first examination signal injected by the first application device (such as application device in FIG. 6) and detected by the detection unit (such as detection unit 616A in FIG. 6), and the electrical signal 1014 represents the second examination signal injected by the second application device (such as application device 606B in FIG. 6) and detected by the same detection unit. Using only the plotted amplitudes of the electrical signals 1012 and 1014 (instead of also 1016 and 1018), the identification unit may determine the status of the route. For example, between times t0 and t2, both signals 1012 and 1014 are constant at the base line values, indicating that the detection unit receives both the first and second examination signals, so the section of the route is non-damaged. Between times t2 and t4, the one or more electrical characteristics monitored by the detection unit indicate an increased amplitude of the first examination signal above the base line and a decreased amplitude of the second examination signal below the base line. Thus, during this time period the detection unit only receives the first examination signal and not the second examination signal (beyond a trace or negligible amount), which indicates that the section of the route may include an electrical short. For example, referring to FIG. 6, the first application device is on the same side of the electrical short as the detection unit, so the first examination signal is received by the detection unit and the amplitude of the electrical signals associated with the first examination signal is increased over the base line amplitude due to the sub-loop created by the electrical short. However, the second application device is on an opposite side of the electrical short from the first detection unit 616A, so the second examination signal circulates a different sub-loop and is not received by the first detection unit, resulting in the amplitude drop in the plotted signal 1014 over this time period. Finally, between times t5 and t7, the one or more electrical characteristics monitored by the detection unit indicate drops in the amplitudes of the both the first and second examination signals, so neither of the examination signals are received by the detection unit. Thus, the section of the route is potentially damaged, which causes an open circuit loop and explains the lack of receipt by the detection unit of either of the examination signals. Alternatively, the detection unit may be the detection unit 1004 shown in the graph such that the electrical signals are the plotted electrical signals 1016 and 1018 instead of 1012 and 1014.

In the alternative embodiment described with reference to FIG. 6 in which the examining system includes only one application device and only one detection unit, the monitored electrical characteristics along the route by the detection unit may be shown in a graph similar to graph. For example, the graph may include the plotted electrical signal 1012, where the electrical signal 1012 represents the examination signal injected by the application device (such as first application device 606A shown in FIG. 6) and detected by the detection unit (such as detection unit 616A shown in FIG. 6). Using the electrical signal 1012 (instead of also 1014, 1016, and 1018), the identification unit may determine the status of the route. For example, between times t0 and t2, the signal 1012 is constant at the base line value, indicating that the detection unit receives the examination signal, so the section of the route is non-damaged. Between times t2 and t4, the one or more electrical characteristics monitored by the detection unit indicate an increased amplitude of the examination signal above the base line, which further indicates that the section of the route includes an electrical short. Finally, between times t5 and t7, the one or more electrical characteristics monitored by the detection unit indicate a drop in the amplitude of the examination signal, so the examination signal is not received by the detection unit. Thus, the section of the route is potentially damaged, which causes an open circuit loop. Alternatively, the detection unit may be the detection unit shown in the graph (such as the second detection unit 616B shown in FIG. 6) and the electrical signal is the plotted electrical signal 1018 (injected by the second application device 606B shown in FIG. 9) instead of 1012. Thus, the detection unit may be proximate to the application device to obtain the plotted electrical signals 1012 and 1018. For example, an application device that is spaced apart from the detection device along a length of the vehicle or vehicle system may result in the plotted electrical signals 1014 or 1016, which both show drops in amplitude when the examining system traverses both a damaged section of the route and an electrical short. A spaced-apart arrangement between the detection unit and the application unit that provides one of the plotted signals 1014, 1016 is not useful in distinguishing between these two states of the route, unless the plotted signal 1014 or 1016 is interpreted in combination with other monitored electrical characteristics, such as phase or modulation, for example.

Figure 13:
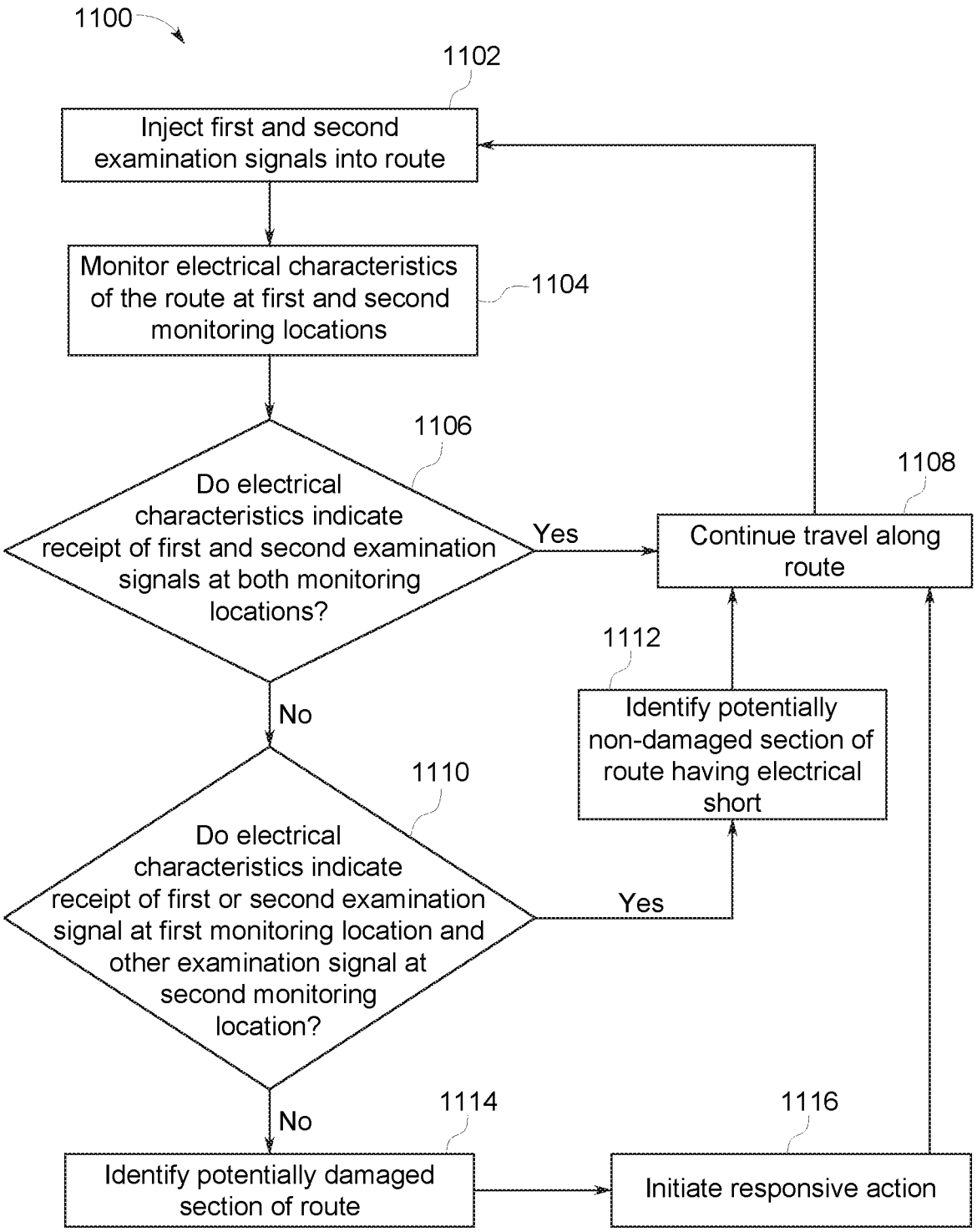
FIG. 13 is a flowchart of an embodiment of a method for examining a route being traveled by a vehicle system from onboard the vehicle system.

FIG. 13 is a flowchart of an embodiment of a method 1100 for examining a conductive body along or included in a route being traveled by a vehicle system from onboard the vehicle system. The method may be used in conjunction with one or more embodiments of the vehicle systems and/or examining systems described herein. Alternatively, the method may be implemented with another system.

At step 1102, first and second examination signals are electrically injected into conductive bodies (e.g., rails) of the route being traveled by the vehicle system. The first examination signal may be injected using a first vehicle of the vehicle system. The second examination signal may be injected using the first vehicle at a rearward or frontward location of the first vehicle relative to where the first examination signal is injected. Optionally, the first examination signal may be injected using the first vehicle, and the second examination signal may be injected using a second vehicle in the vehicle system. Electrically injecting the first and second examination signals into the conductive tracks may include applying a designated direct current, a designated alternating current, and/or a designated radio frequency signal to at least one conductive track of the route. The first and second examination signals may be transmitted into different conductive tracks, such as opposing parallel tracks.

At step 1104, one or more electrical characteristics of the route are monitored at first and second monitoring locations. The monitoring locations may be onboard the first vehicle in response to the first and second examination signals being injected into the conductive tracks. The first monitoring location may be positioned closer to the front of the first vehicle relative to the second monitoring location. Detection units may be located at the first and second monitoring locations. Electrical characteristics of the route may be monitored along one conductive track at the first monitoring location; the electrical characteristics of the route may be monitored along a different conductive track at the second monitoring location. Optionally, a notification may be communicated to the first and second monitoring locations when the first and second examination signals are injected into the route. Monitoring the electrical characteristics of the route may be performed responsive to receiving the notification.

At step 1106, a determination is made as to whether one or more monitored electrical characteristics indicate receipt of both the first and second examination signals at both monitoring locations. For example, if both examination signals are monitored in the electrical characteristics at both monitoring locations, then both examination signals are circulating the conductive test loop. As such, the circuit of the test loop is intact. But, if each of the monitoring locations monitors electrical characteristics indicating only one or none of the examination signals, then the circuit of the test loop may be affected by an electrical break or an electrical short. If the electrical characteristics do indicate receipt of both first and second examination signals at both monitoring locations, flow of the method may proceed toward step 1108.

At step 1108, the vehicle continues to travel along the route. Flow of the method then proceeds back toward step 1102 where the first and second examination signals are once again injected into the conductive tracks, and the method repeats. The method may be repeated by proceeding to step 1108, or there may be a wait period, such as 1 second, 2 seconds, or 5 seconds, before re-injecting the examination signals.

Referring back to step 1106, if the electrical characteristics indicate that both examination signals are not received at both monitoring locations, then flow of the method proceeds to step 1110. At step 1110, a determination is made as to whether one or more monitored electrical characteristics indicate a presence of only the first or the second examination signal at the first monitoring location and a presence of only the other examination signal at the second monitoring location. For example, the electrical characteristics received at the first monitoring location may indicate a presence of only the first examination signal, and not the second examination signal. Likewise, the electrical characteristics received at the second monitoring location may indicate a presence of only the second examination signal, and not the first examination signal. As described herein, "indicat[ing] a presence of" an examination signal means that the received electrical characteristics include more than a mere threshold signal-to-noise ratio of the unique identifier indicative of the respective examination signal that is more than electrical noise.

This determination may be used to distinguish between electrical characteristics that indicate the section of the route is damaged and electrical characteristics that indicate the section of the route is not damaged but may have an electrical short. For example, since the first and second examination signals are not both received at each of the monitoring locations, the route may be identified as being potentially damaged due to a broken track that is causing an open circuit. However, an electrical short may also cause one or both monitoring locations to not receive both examination signals, potentially resulting in a false alarm. Therefore, this determination is made to distinguish an electrical short from an electrical break.

For example, if neither examination signal is received at either of the monitoring locations as the vehicle system traverses over the section of the route, the electrical characteristics may indicate that the section of the route is damaged (e.g., broken). Alternatively, the section may be not damaged but including an electrical short if the one or more electrical characteristics monitored at one of the monitoring locations indicate a presence of only one of the examination signals. This indication may be strengthened if the electrical characteristics monitored at the other monitoring location indicate a presence of only the other examination signal. Additionally, a non-damaged section of the route having an electrical short may also be indicated if an amplitude of the electrical characteristics monitored at the first monitoring location is an inverse derivative of an amplitude of the electrical characteristics monitored at the second monitoring location as the vehicle system traverses over the section of the route. If the monitored electrical characteristics indicate significant receipt of only one examination signal at the first monitoring location and only the other examination signal at the second monitoring location, then flow of the method proceeds toward step 1112.

At step 1112, the section of the route is identified as being non-damaged but having an electrical short. In response, the notification of the identified section of the route including an electrical short may be communicated off-board and/or stored in a database onboard the vehicle system. The location of the electrical short may be determined more precisely by comparing a location of the vehicle over time to the inverse derivatives of the monitored amplitudes of the electrical characteristics monitored at the monitoring locations. For example, the electrical short may have been equidistant from the two monitoring locations when the inverse derivatives of the amplitude are monitored as being equal. Location information may be obtained from a location determining unit, such as a GPS device, located on or off-board the vehicle. After identifying the section as having an electrical short, the vehicle system continues to travel along the route at step 1108.

If the monitored electrical characteristics do not indicate significant receipt of only one examination signal at the first monitoring location and only the other examination signal at the second monitoring location, then flow of the method may proceed toward step 1114. At step 1114, the section of the route is identified as damaged. Since neither monitoring location receives electrical characteristics indicating at least one of the examination signals, it is likely that the vehicle is traversing over an electrical break in the route, which prevents most if not all the conduction of the examination signals along the test loop. The damaged section of the route may be disposed between the designated axles of the first vehicle that define ends of the test loop based on the one or more electrical characteristics monitored at the first and second monitoring locations. After identifying the section of the route as being damaged, flow proceeds toward step 1116.

At step 1116, responsive action is initiated in response to identifying that the section of the route is damaged. For example, the vehicle, such as through the control unit and/or identification unit, may be configured to automatically slow movement, automatically notify one or more other vehicle systems of the damaged section of the route, and/or automatically request inspection and/or repair of the damaged section of the route. A warning signal may be communicated to an off-board location that is configured to notify a recipient of the damaged section of the route. A repair signal to request repair of the damaged section of the route may be communicated off-board as well. The warning and/or repair signals may be communicated by at least one of the control unit or the identification unit located onboard the vehicle. Furthermore, the responsive action may include determining a location of the damaged section of the route by obtaining location information of the vehicle from a location determining unit during the time that the first and second examination signals are injected into the route. The calculated location of the electrical break in the route may be communicated to the off-board location as part of the warning and/or repair signal. Optionally, responsive actions, such as sending warning signals, repair signals, and/or changing operational settings of the vehicle, may be at least initiated manually by a vehicle operator onboard the vehicle or a dispatcher located at an off-board facility.

In addition or as an alternate to using one or more embodiments of the route examination systems described herein to detect damaged sections of a route, one or more embodiments of the route examination systems may be used to determine location information about the vehicles on which the route examination systems are disposed. The location information can include a determination of which route of several different routes on which the vehicle is currently disposed, a determination of the location of the vehicle on a route, a direction of travel of the vehicle along the route, and/or a speed at which the vehicle is moving along the route.

Figure 14:
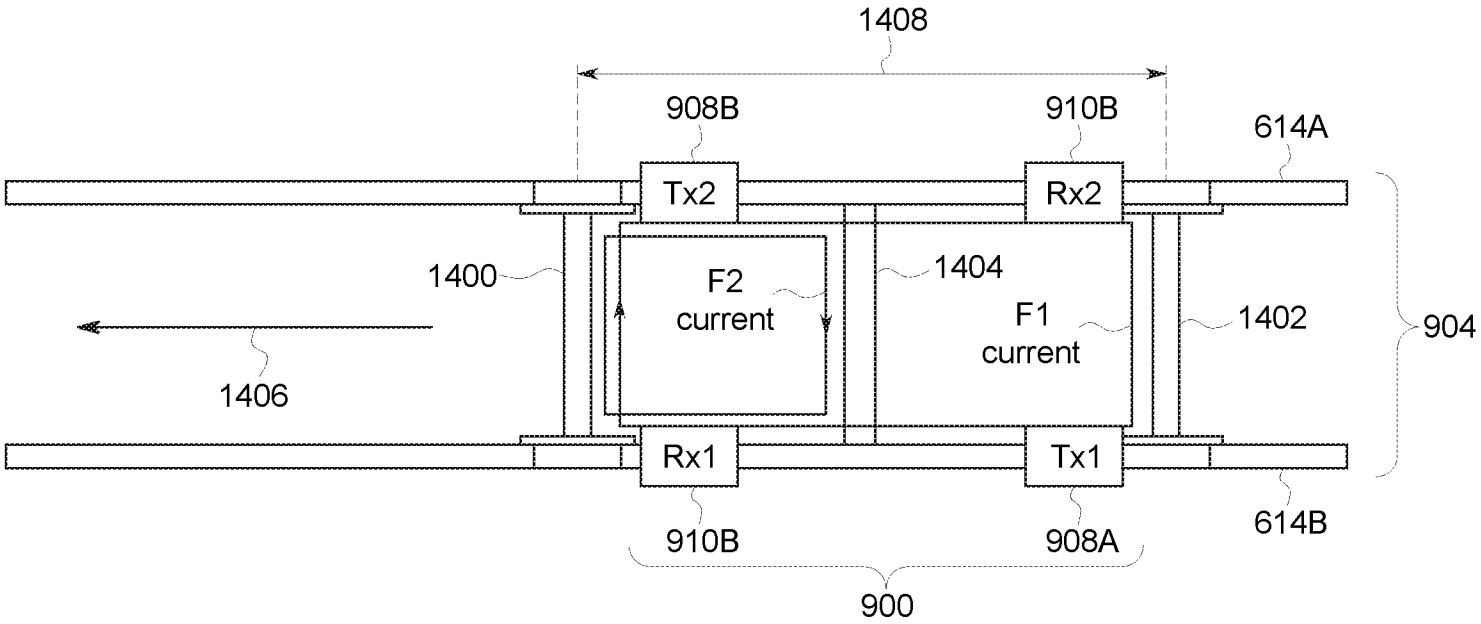
FIG. 14 is a schematic illustration of an embodiment of the examining system on the vehicle as the vehicle travels along the route.

FIG. 14 is a schematic illustration of an embodiment of the examining system shown in FIG. 9 on the vehicle as the vehicle travels along the route. While only two axles 1400, 1402 ("Axle 3" and "Axle 4" in FIG. 14) are shown in FIG. 14, the vehicle may include a different number of axles and/or axles other than the third and fourth axles of the vehicle may be used.

The route can be formed from the conductive bodies described above (e.g., the rails). The route can include one or more frequency tuned shunts 1404 that extend between the conductive bodies. A frequency tuned shunt can form a conductive pathway or short between the conductive bodies of the route for an electric signal that is conducted in the bodies at a frequency to which the shunt is tuned. For example, the shunt shown in FIG. 14 is tuned to a frequency of 3.8 kHz. An electric signal having a frequency of 3.8 kHz that is conducted along the first conductive body (e.g., the rail 614A) also may be conducted through the shunt to the second conductive body (e.g., the rail 614B) and/or such a signal may be conducted from the second body to the first body through the shunt). Electric signals having other frequencies (e.g., 4.6 kHz or another frequency), however, will not be conducted by the shunt, or will be conducted to a lesser degree (e.g., attenuated). As a result, a signal having a frequency to which the shunt may be tuned (referred to as a tuned frequency) that is injected into the first conductive body by the second application unit 908B ("Tx2" in FIG. 14) will be conducted along a circuit loop or path that includes the first conductive body, the first axle 1400, the second conductive body 614B, and the shunt. This signal is detected by the second detection unit ("Rx1" in FIG. 14). Similarly, a signal having the tuned frequency that is injected into the second conductive body by the first application unit ("Tx1" in FIG. 14) will be conducted along a circuit loop or path that includes the second conductive body, the second axle 1402, the first conductive body, and the shunt. In one embodiment, one or more of the detection units may detect signals having different frequencies.

A signal that has a frequency other than the tuned frequency and that is injected into the first conductive body by the second application unit may be conducted along a circuit loop or path that includes the first conductive body, the first axle, the second conductive body, and the second axle, but that does not include the shunt. Similarly, a signal that has a frequency other than the tuned frequency and that is injected into the second conductive body by the first application unit may be conducted along a circuit loop or path that includes the second conductive body, the second axle, the first conductive body, and the first axle, but that does not include the shunt. A shunt that is tuned to multiple frequencies, such as 3.8 kHz and 4.6 kHz, or a range of frequencies that include 3.8 kHz and 4.6 kHz, will conduct the signals. For example, a shunt that is tuned to a range of frequencies that include both 3.8 kHz and 4.6 kHz will conduct signals having frequencies of 3.8 kHz or 4.6 kHz between the conductive bodies.

One or more frequency tuned shunts can be disposed across routes at designated locations to calibrate the location of vehicles traveling along the routes. The frequency tuned shunts can be read by the examining systems described herein to define a specific location of the vehicle on the route. This can allow for accurate calibration of location of the vehicle when combined with a location determining system of the vehicle (e.g., a global positioning system receiver, wireless transceiver, or the like), and can increase the accuracy of the location of the vehicle when using a dead reckoning technique and/or when another locating method is unavailable. The detection of the frequency tuned shunts also can also be used to determine which route of several different routes on which a vehicle is currently located.

The examining system can use multiple different frequencies to test the route beneath the vehicle for damage. By placing an element such as a frequency tuned shunt on the route that responds to one or a combination of the frequencies, and placing such elements at planned differences in spacing along the route, codes can be generated to convey information about the specific location to the vehicle in an economical and reliable manner.

Figure 15:
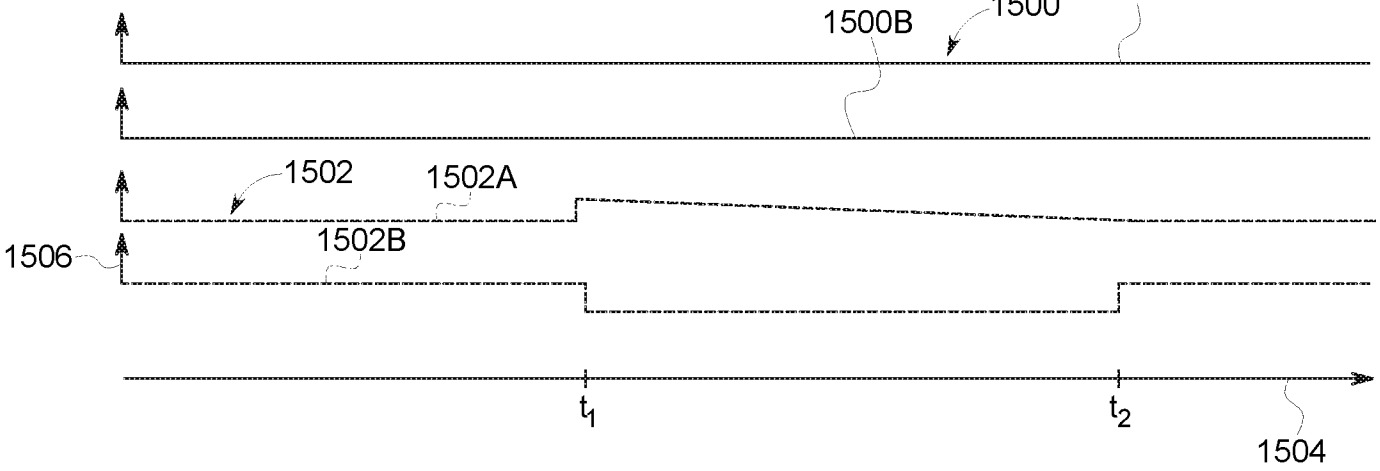
FIG. 15 illustrates electrical characteristics that may be monitored by the examining system on a vehicle system as the vehicle system travels along the route according to one example.

FIG. 15 illustrates a first set of electrical characteristics 1500 (e.g., first and second electrical characteristics 1500A, 1500B) and a second set of electrical characteristics 1502 (e.g., third and fourth electrical characteristics 1502A, 1502B) of the route that may be monitored by the examining system on a vehicle system as the vehicle system travels along the route according to one example. The electrical characteristics are shown alongside a horizontal axis 1504 representative of time or distance along the route and vertical axes 1506 representative of magnitudes of the electrical characteristics (as measured by the detection units shown in FIG. 14). The first set of electrical characteristics represent the magnitudes of first and second signals injected into the conductive bodies of the route by the application units, as detected by the detection units during travel of the vehicle system over the frequency tuned shunt.

The first application unit can inject a first signal having a frequency that is not the tuned frequency of the shunt (or that is outside of the range of tuned frequencies of the shunt). The second application unit can inject a second signal having the tuned frequency of the shunt (or that is within the range of tuned frequencies of the shunt). The first detection unit can detect magnitudes of the first and second signals as conducted to the first detection unit through the first conductive body and the second detection unit can detect magnitudes of the first and second signals as conducted to the second detection unit through the second conductive body. The first electrical characteristic represents the magnitudes of the first signal (the non-tuned frequency signal) as detected by the second detection unit and the second electrical characteristic represents the magnitudes of the first signal as detected by the first detection unit. The third electrical characteristic represents the magnitudes of the second signal (the tuned frequency signal) as detected by the second detection unit and the fourth electrical characteristic represents the magnitudes of the second signal as detected by the first detection unit.

A time t1 indicates when the first axle (e.g., a leading axle) passes the shunt as the vehicle system travels along a direction of travel 1406 shown in FIG. 14. A time t2 indicates when the second axle (e.g., a trailing axle) passes the shunt as the vehicle system travels along the direction of travel. The time period including and between the times t1 and t2 represents when the shunt is disposed between the leading and trailing axles.

Prior to the leading axle passing over the shunt (e.g., before the time t1), the first and second signals are conducted through a circuit formed from the axles and the sections of the conductive bodies (e.g., rails) that extend from and between the axles. As a result, the magnitudes of the electrical characteristics do not appreciably change (e.g., the electrical characteristics may not change in magnitude or the changes in the magnitude may be caused by noise or outside interference).

Upon the leading axle passing the shunt, however, different circuits are formed for the different first and second signals, depending on the frequencies of the signals. For example, for the first signal (the non-tuned frequency signal), the circuit through which the first signal is conducted to the detection units does not change. Thus, the magnitudes of the first and second electrical characteristics do not appreciably change. For the second signal (the tuned frequency signal), the shunt conducts the second signal, and a smaller, different circuit is formed. The circuit that conducts the second signal includes the leading axle, the shunt, and the sections of the conductive bodies extending from the leading axle to the shunt. This circuit for the second signal also can prevent the second signal from being conducted to the first detection unit. The smaller circuit that includes the shunt can prevent the second signal from reaching and being detected by the first detection unit.

The second detection unit detects an increase in the second signal at or near the time t1, as indicated by the increase in the third electrical characteristic shown in FIG. 15. This increase may be caused by decreased electrical impedance in the circuit formed from the leading axle, the shunt, and the sections of the conductive bodies extending from the leading axle to the shunt. For example, because this circuit is shorter than the circuit that does not include the shunt, the electrical impedance may be less.

The first detection unit may no longer be able to detect the second signal after time t1 due to the circuit formed with the shunt. The circuit formed with the shunt can prevent the second signal from being conducted in the first conductive body. The first detection unit may detect a decrease or elimination of the second signal, as represented by the decrease in the fourth electrical characteristic at time t1.

As the vehicle moves over the shunt, the leading axle moves farther from the shunt. This increasing distance from the leading axle to the shunt increases the size of the circuit that includes the leading axle and the shunt. The impedance of the circuit through which the third electrical characteristic is conducted increases from time t1 to time t2. The increasing impedance can decrease the magnitude of the second signal (as detected by the second detection unit). As a result, the magnitude of the third electrical characteristic detected by the second detection unit decreases from time t1 to time t2. With respect to the first detection unit, because the shunt continues to prevent the second signal from being conducted to the first detection unit, the magnitude of the fourth electrical characteristics remain reduced, as shown in FIG. 15.

Once the vehicle system has moved over the shunt and the shunt is no longer between the axles (e.g., after time t2), the second signal is again conducted through the circuit that does not include the shunt and that is formed from the axles and the sections of the conductive bodies extending between the axles. The magnitude of the second signal as detected by the second detection unit may return to a level that was measured prior to time t1. Because the shunt is no longer preventing the first detection unit from detecting the second signal after time t2, the value of the fourth electrical characteristic may increase back to the level that existed prior to the time t1.

The examining system can analyze two or more of the electrical characteristics to differentiate detection of a frequency tuned shunt from detection of a damaged section of the conductive bodies and/or the presence of another shunt on the route. A break 922 in a rail in the route may result in two or more signals 1012, 1014, 1016, 1018 as detected by the detection units to decrease during concurrent times, as shown in FIG. 12 during the time period extending from time t5 to time t7. In contrast, only one of the first through fourth electrical characteristics decreases during passage of the vehicle system over the shunt. The control unit and/or identification unit can determine how many of the first through fourth electrical characteristics decrease at a time to determine whether the vehicle system is traveling over a damaged section of a conductive body of the route or over a frequency tuned shunt. A shunt 916 that is not a frequency tuned shunt may cause two or more (or all) of the signals 1012, 1014, 1016, 1018 to increase and/or decrease during passage over the shunt 916, as shown in FIG. 12 during the time period from time t2 to the time t4. In contrast, only the signals detected by a single detection unit (e.g., the second detection unit) may change during passage over a frequency tuned shunt. Therefore, if signals detected by two or more detection units change, then the shunt that is detected may not be a frequency tuned shunt. If signals detected by the same detection unit change, but the signals detected by another detection unit do not change, then the shunt that is detected may be a frequency tuned shunt.

The examining systems described herein can examine the electrical characteristics to determine a variety of information about the vehicle system and/or the route, in addition to or as an alternate to detecting damage to the conductive bodies. As one example, the control unit and/or identification unit can identify which route the vehicle system is traveling along. Different routes may have frequency tuned shunts in different locations and/or sequences. The location of the shunts and/or sequences of the shunts may be unique to the routes such that, upon detecting the shunts, the examining systems can determine which route the vehicle system is traveling along.

For example, a first route may have a first shunt tuned to a first frequency and a second route may have a second shunt tuned to a second frequency that differs from the first frequency. The examining system can inject signals having one or more of the first or second frequencies to attempt to detect the first and/or second shunt. Upon detecting one or more of the changes in the electrical characteristics, the examining system can determine that the vehicle system traveled over the first or second shunt. If the examining system is injecting an electrical test signal having the first frequency into the route and the examining system detects the changes in the signal that are similar to the changes in the electrical characteristics, the examining system can determine that the vehicle system passed over the first shunt. The first route may be associated with the first shunt in a memory 540 of the examining system (shown in FIG. 5, such as a memory of the control unit, identification unit, or the like, and/or as communicated to the examining system) such that, upon detecting the first shunt, the examining system determines that the vehicle system is on the first route.

If the examining system is injecting the electrical test signal having the first frequency into the route and the examining system does not detect the changes in the signal that are similar to the changes in the electrical characteristics, the examining system can determine that the vehicle system has not passed over the first shunt. The examining system can then determine that the vehicle system is not on the first route.

If the examining system is injecting an electrical test signal having the second frequency into the route and the examining system detects the changes in the signal that are similar to the changes in the electrical characteristics, the examining system can determine that the vehicle system passed over the second shunt. The second route may be associated with the second shunt such that, upon detecting the second shunt, the examining system determines that the vehicle system is on the second route. If the examining system is injecting the electrical test signal having the second frequency into the route and the examining system does not detect the changes in the signal that are similar to the changes in the electrical characteristics, the examining system can determine that the vehicle system has not passed over the second shunt. The examining system can then determine that the vehicle system is not on the second route.

Additionally or alternatively, different routes may be associated with different sequences of two or more frequency tuned shunts. A sequence of shunts can represent an order in which the shunts are encountered by a vehicle system traveling over the sequence of shunts, and optionally may include the frequencies to which the shunts are tuned and/or distances between the shunts. Each different combination of a sequence of locations of shunts and/or frequencies of the shunts may represent a distinct or unique pattern. Different patterns may be associated with or otherwise representative of different routes and/or different locations along the routes. For example, Table 1 below represents different sequences of shunts in different routes:

TABLE 1

| Route | Shunt Sequence |
|---|---|
| 1 | A, A, A, A |
| 2 | A, A, A, B |
| 3 | A, A, B, A |
| 4 | A, B, A, A |
| 5 | B, A, A, A |
| 6 | A, A, B, B |
| 7 | A, B, B, A |
| 8 | B, B, A, A |
| 9 | A, B, B, B |
| 10 | B, B, B, A |
| 11 | A, B, A, B |
| 12 | B, A, B, A |

TABLE 1-continued

| Route | Shunt Sequence |
|---|---|
| 13 | B, B, B, B |
| 14 | B, B, A, B |
| 15 | B, A, B, B |
| 16 | B, A, A, B |

The letters A and B represent different frequencies to which the shunts are tuned. While each sequence of the shunts in Table 1 includes four shunts, alternatively, one or more of the sequences may include a different number of shunts. While the sequences only include two different frequencies, optionally, one or more sequences may include more frequencies.

The examining system can track the order in which different shunts are detected by the vehicle system to determine which route that the vehicle system is traveling along. For example, if the examining system detects a shunt tuned to frequency B, followed by another shunt tuned to frequency B, followed by another shunt tuned to frequency A, followed by a shunt tuned to frequency A, then the examining system can determine that the vehicle system is on the eighth route listed above.

Optionally, the examining system can determine a heading or direction in which the vehicle or vehicle system is moving based on the detected order of the shunts. For example, if the examining system is aware that the vehicle or vehicle system is on the third route and the examining system detects the order of shunts as A, A, B, A, then the examining system may determine that the vehicle or vehicle system is moving in a first direction. But if the examining system is aware that the vehicle or vehicle system is on the third route and the examining system detects the order of shunts as A, B, A, A, then the examining system may determine that the vehicle or vehicle system is moving in a second direction that is opposite the first direction.

A shunt sequence optionally may include distances between shunts. Table 2 below illustrates examples of shunt sequences that also include distances:

| Route | Shunt Sequence |
|---|---|
| 9 | A, 50 m, A |
| 10 | A, 30 m, B |
| 11 | A, 100 m, A |
| 12 | B, 20 m, A, 30 m, A |

The numbers 50 m, 30 m, and so on, listed between the letters A and/or B represent distances between shunts tuned to the A or B frequency. The examining system can detect the shunts tuned to the different frequencies, the order in which these shunts are detected, and the distance between the shunts, to determine which route the vehicle system is traveling along.

Using the detection of one or more frequency tuned shunts to determine which route the vehicle system is traveling along can be useful for the control unit to differentiate between different routes that are closely spaced together. Some routes may be sufficiently close to each other that the resolution of other location determining systems (e.g., global positioning systems, wireless triangulation, etc.) may not be able to differentiate between which of the different routes that the vehicle system is traveling along. At times, the vehicle system may not be able to rely on such other location determining systems, such as when the vehicle system is traveling in a tunnel, in valleys, urban areas, or the like. The detection of a frequency tuned shunt associated with a route can allow the examining systems to determine which route the vehicle system is on when the other location determining systems may be unable to determine which route the vehicle system is traveling on.

In another example, the control unit and/or identification unit can determine where the vehicle system is located along a route using detection of one or more shunts. Different locations along the routes may have frequency tuned shunts in different locations and/or sequences. The location of the shunts and/or sequences of the shunts may be correlated to the locations along the routes such that, upon detecting the shunts, the controller may determine the vehicle system location.

For example, a first location along a route may have a first shunt tuned to a first frequency and a second location along the route may have a second shunt tuned to a second frequency. The examining system can inject signals having one or more of the first or second frequencies to attempt to detect the first and/or second shunt. Upon detecting one or more of the changes in the electrical characteristics, the examining system can determine that the vehicle system traveled over the first or second shunt. If the examining system is injecting an electrical test signal having the first frequency into the route and the examining system detects the changes in the signal that are similar to the changes in the electrical characteristics, the examining system can determine that the vehicle system passed over the first shunt. The first location along the route may be associated with the first shunt in the memory of the examining system such that, upon detecting the first shunt, the examining system determines that the vehicle system is at the location along the first route associated with the first shunt.

If the examining system is injecting the electrical test signal having the first frequency into the route and the examining system does not detect the changes in the signal that are similar to the changes in the electrical characteristics, the examining system can determine that the vehicle system has not passed over the first shunt. The examining system can then determine that the vehicle system is not located at the location on the first route that is associated with the first shunt.

If the examining system is injecting an electrical test signal having the second frequency into the pathway and the examining system detects the changes in the signal that are similar to the changes in the electrical characteristics, the examining system can determine that the vehicle system passed over the second shunt. The second location along the pathway may be associated with the second shunt such that, upon detecting the second shunt, the examining system determines that the vehicle system is at the location on the pathway associated with the second shunt. If the examining system is injecting the electrical test signal having the second frequency into the pathway and the examining system does not detect the changes in the signal that are similar to the changes in the electrical characteristics 1A and/or 1B, the examining system can determine that the vehicle system has not passed over the second shunt. The examining system can then determine that the vehicle system is not at the location along the pathway that is associated with the second shunt.

Additionally or alternatively, different locations along the pathway may be associated with different sequences of two or more frequency tuned shunts. Similar to as described above, detection of shunts in a sequence associated with a designated location along the pathway can allow for the examining system to determine where the vehicle system is located relative to the pathway. The controller may compare that determination with other location information (such as GPS coordinates) to identify discrepancies or perform calibration operations. The controller may use location information to identify faults, damage or wear in the conductive pathways that are being inspected by the system.

Using the detection of one or more frequency tuned shunts to determine where the vehicle system is located along a pathway can be useful for the control unit to determine where the vehicle system is located. As described above, the vehicle system may not be able to rely on other location determining systems to determine where the vehicle system is located. Additionally, the examining system can determine the location of the vehicle system to assist in calibrating or updating a location that is based on a dead reckoning technique. For example, if the vehicle system is using dead reckoning to determine where the vehicle system is located, determination of the location of the vehicle system using the shunts can serve as a check or update on the location as determined using dead reckoning.

The determined location of the vehicle system may be used to calibrate or update other location determining systems of the vehicle system, such as global positioning system receivers, wireless transceivers, or the like. Some location determining systems may be unable to provide locations of the vehicle system after initialization of the location determining systems. For example, after turning the vehicle system and/or the location determining systems on, the location determining systems may be unable to determine the locations of the vehicle systems for a period of time that the location determining systems are initializing. The detection of frequency tuned shunts during this initialization can allow for the vehicle systems to determine the locations of the vehicle systems during the initialization.

Optionally, the failure to detect a frequency tuned shunt in a designated location can be used by the examining system to determine that the shunt is damaged or has been removed. Because the locations of the frequency tuned shunts may be stored in the memory of the vehicle system and/or communicated to the vehicle system, the failure to detect a frequency tuned shunt at the designated location of the shunt can serve to notify the examining system that the shunt is damaged and/or has been removed. The examining system and/or control unit can then notify an operator of the vehicle system of the damaged and/or missing shunt, can cause the communication unit to automatically send a signal to a scheduling or dispatch facility to schedule inspection, repair, or replacement of the shunt, or the like.

In another example, the control unit and/or identification unit can determine a direction of travel of the vehicle system responsive to detecting one or more frequency tuned shunts. Upon detecting the changes in the electrical characteristics that indicate presence of a frequency tuned shunt, the identification unit can examine one or more examples of the electrical characteristics to determine a direction of travel. The identification unit can examine changes in the electrical characteristics to determine the direction of travel. The changes can be represented by the slope of the electrical characteristics, a trend in the electrical characteristics, or the like. If the electrical characteristic has a negative slope, trend, or is decreasing over time between time t1 and t2, then this can indicate that the vehicle system has the direction of travel shown in FIG. 14. But, if the electrical characteristic has a positive slope between time t1 and t2, the slope can indicate that the vehicle system has an opposite direction of travel.

In another example, the control unit and/or identification unit can determine a moving speed of the vehicle system responsive to detecting one or more frequency tuned shunts. In one example, the examining system can determine the time period elapsed between time t1 and t2 based on the changes in the third and/or fourth electrical characteristics that indicate detection of the shunt. Based on the elapsed time period and a separation distance 1408 (shown in FIG. 14) between the leading and trailing axles, the control unit and/or identification unit can calculate a moving speed of the vehicle system. For example, if the separation distance is 397 inches (e.g., ten meters) and the time period between t1 and t2 is 1.13 seconds, then the examining system can determine that the vehicle system is traveling at approximately twenty miles per hour (e.g., 32 kilometers per hour).

In another example, the control unit and/or identification unit can determine a moving speed of the vehicle system responsive to detecting one or more frequency tuned shunts. In one example, the examining system can determine the slope of the third electrical characteristic between the time t1 and the time t2. Larger absolute values of the slopes may be associated with faster speeds of the vehicle system than smaller absolute values of the slopes. Different absolute values of slopes may be associated with different speeds in the memory of the examining system and/or as communicated to the examining system. The control unit and/or identification unit can determine the absolute value of the slope in the third electrical characteristic and compare the determined slope to absolute values of the slopes associated with different speeds to determine how fast the vehicle system is moving.

Figure 16:
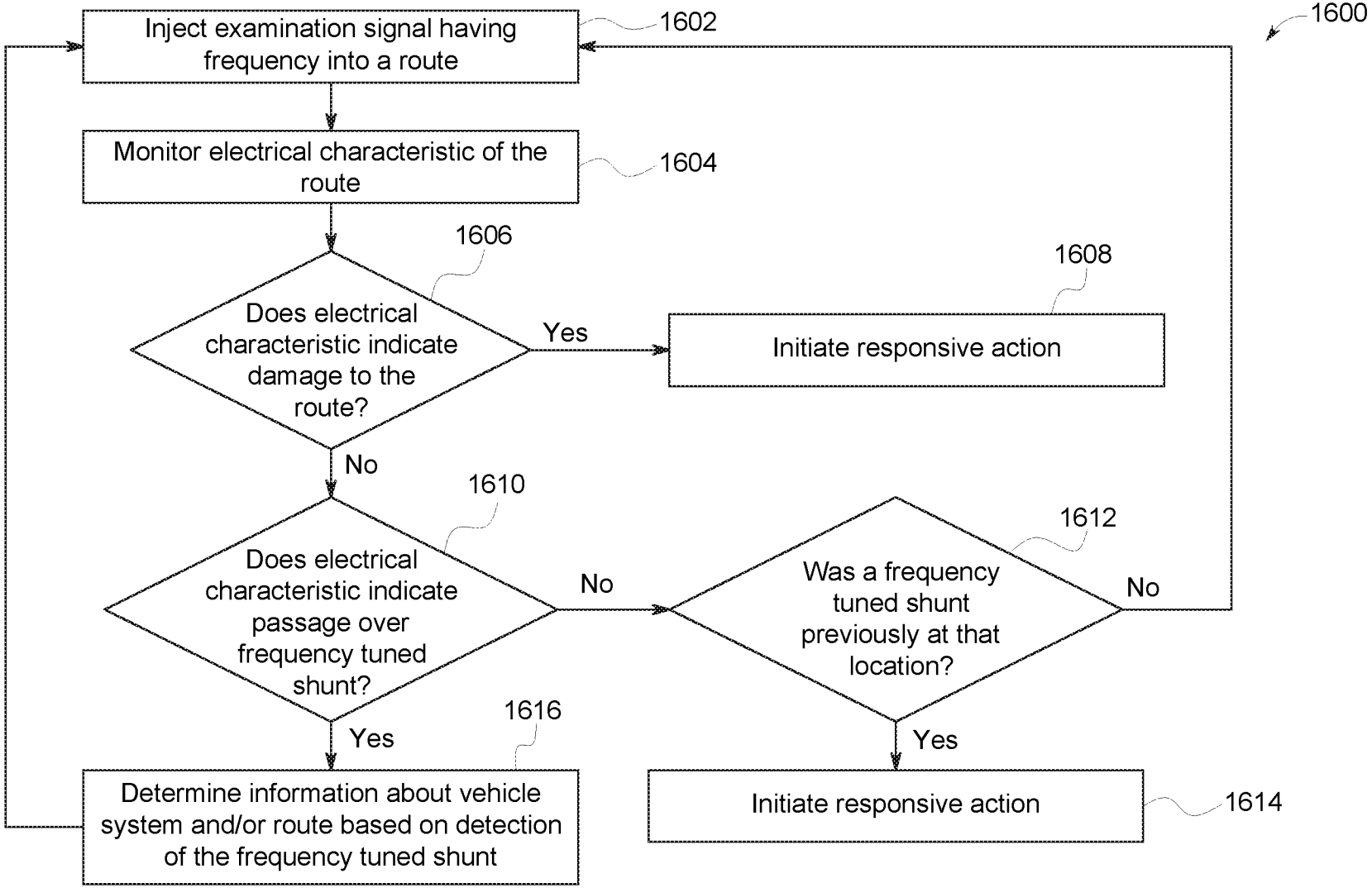
FIG. 16 illustrates a flowchart of one embodiment of a method for examining a route and/or determining information about the route and/or a vehicle system.

FIG. 16 illustrates a flowchart of one embodiment of a method 1600 for examining a pathway and/or determining information about the pathway and/or a vehicle system. The method may be performed by one or more embodiments of the examining systems described herein to detect damage to a pathway, detect a shunt on the pathway, and/or determine information about the pathway and/or a vehicle system traveling on the pathway.

At step 1602, an examination signal having a designated frequency is injected into the pathway. The examination signal may have a frequency associated with one or more frequency tuned shunts. Optionally multiple examination signals may be injected into the pathway. For example, different signals having different frequencies associated with frequency tuned shunts may be injected into the pathway.

At step 1604, one or more electrical characteristics of the pathway are monitored. For example, the voltages, currents, resistances, impedances, or the like, of the pathway may be monitored, as described herein. At step 1606, the one or more electrical characteristics that are monitored may be examined to determine if the one or more electrical characteristics indicate damage to the pathway, as described above. Optionally, the one or more electrical characteristics may be examined to determine if a shunt (e.g., other than a frequency tuned shunt) is on the pathway, as described above. If the one or more electrical characteristics indicate damage to the pathway, flow of the method may proceed toward step 1608. Otherwise, flow of the method can proceed toward step 1610. At step 1608, one or more responsive actions may be initiated to detection of the damage to the pathway, as described above.

At step 1610, a determination is made as to whether the one or more electrical characteristics indicate passage of the vehicle system over a frequency tuned shunt. As described above, the characteristic can be examined as one or more of the electrical characteristics shown in FIG. 15. If the characteristic indicates movement over the frequency tuned shunt, then flow of the method can proceed toward step 1616. Otherwise, flow of the method can proceed toward step 1612.

At step 1612, a determination is made as to whether a frequency tuned shunt previously was at the location of the vehicle. For example, if no frequency tuned shunt was detected at a location, but a frequency tuned shunt is supposed to be at the location, then the failure to detect the shunt can indicate that the shunt is damaged or removed. Thus, flow of the method can proceed toward step 1614. If a frequency tuned shunt is not known to have previously been at that location, however, then flow of the method can return toward step 1602 or the method can terminate.

At step 1614, one or more responsive actions can be implemented responsive to the failure to detect the shunt. For example, an operator of the vehicle system may be notified, a message may be communicated to an off-board location to automatically schedule inspection, repair, or replacement of the frequency tuned shunt, etc.

At step 1616, information about the vehicle system and/or pathway is determined based on detection of the frequency tuned shunt. As described above, the pathway on which the vehicle is traveling may be identified, the location of the vehicle system along the pathway may be determined, the direction of travel of the vehicle system, the speed of the vehicle system, etc., may be determined based on detection of one or more frequency tuned shunts. Flow of the method may return to step 1602, or the method may terminate.

Another feature of the inventive subject matter described herein provides a safe method of vehicle-based damaged component (e.g., broken rail, damaged catenary, damaged cable, etc.) detection to an off-board location (e.g., a back office control system). In one embodiment, in contrast to having the route or pathway examination systems described herein disposed onboard a propulsion-generating vehicle (e.g., a locomotive, automobile, etc.), the route examination systems may be disposed onboard a non-propulsion-generating vehicle, such as a rail car (e.g., ore cart), trailer, etc. For example, the route examination system may be placed on a trailing end of a vehicle system (e.g., the back end of the vehicle system along a direction of travel of the vehicle system). The route examination system may be on the trailing end of the vehicle system instead of the leading end or the middle of a vehicle system to allow for the examination system to be able to detect wear or damage (e.g., conductive rail breaks, loose overhead catenary) in the pathway that is caused by passage of that vehicle system along the pathway. Placing the route examination system at the front or leading end or elsewhere in the vehicle system may result in damage to the pathway created by the portion of the vehicle system that trails the examination system going undetected.

The vehicle systems having route examination systems may report the absence (or presence) of damage to the pathway to an off-board location, such as a back office (also referred to as a dispatch facility or scheduling facility). For example, the route examination system may communicate an inspection signal indicative of no detected damage over a designated segment of the pathway, such as the portion of the pathway recently passed by the vehicle system having the route examination system. This inspection signal can be communicated to the off-board facility to indicate that no damage to the pathway was detected in the traveled segment of the pathway. The off-board facility can communicate approval signals to other vehicle systems traveling toward or scheduled to travel over the same segment of the pathway at a later time to notify the other vehicle systems that it is safe to travel over the segment of the pathway.

The off-board facility may periodically or irregularly send the approval signals to the vehicles traveling toward or scheduled to travel over the segment of the route. As long as the vehicle systems receive the approval signals, the vehicle systems may continue to travel along the route. But, in the absence of receiving an approval signal indicating that an upcoming segment of a pathway is not damaged, a vehicle system may change movement, such as by stopping movement, traveling onto another, different route, or slowing movement upon reaching or coming within a designated distance of a route segment for which an approval signal was not received. This can ensure the safe travel of the vehicle systems even if communication with the off-board facility is lost or interrupted. For example, if a vehicle system is unable to communicate with the off-board facility (thereby resulting in the vehicle system not receiving an approval signal for an upcoming segment of the route), the vehicle system may assume that the upcoming segment of the pathway is damaged or potentially damaged and may change movement accordingly. As another example, if a leading vehicle system (e.g., a vehicle system traveling ahead of a trailing vehicle system along the same route) loses communication with the off-board facility, the off-board facility and/or trailing vehicle system may assume that the pathway is not damaged up to the location along the route where the leading vehicle system was when communication between the leading vehicle system and the off-board facility was lost. The off-board facility and/or the trailing vehicle system may also assume that the pathway is damaged at or subsequent to the location where communication was lost.

At least one technical effect of the inventive subject matter described herein includes automatically changing the movement of a vehicle system that is headed toward a damaged segment of pathway or that loses communication with an off-board facility that monitors damaged pathways to prevent the vehicle system from being damaged or increasing damage to the pathway.

Figure 17:
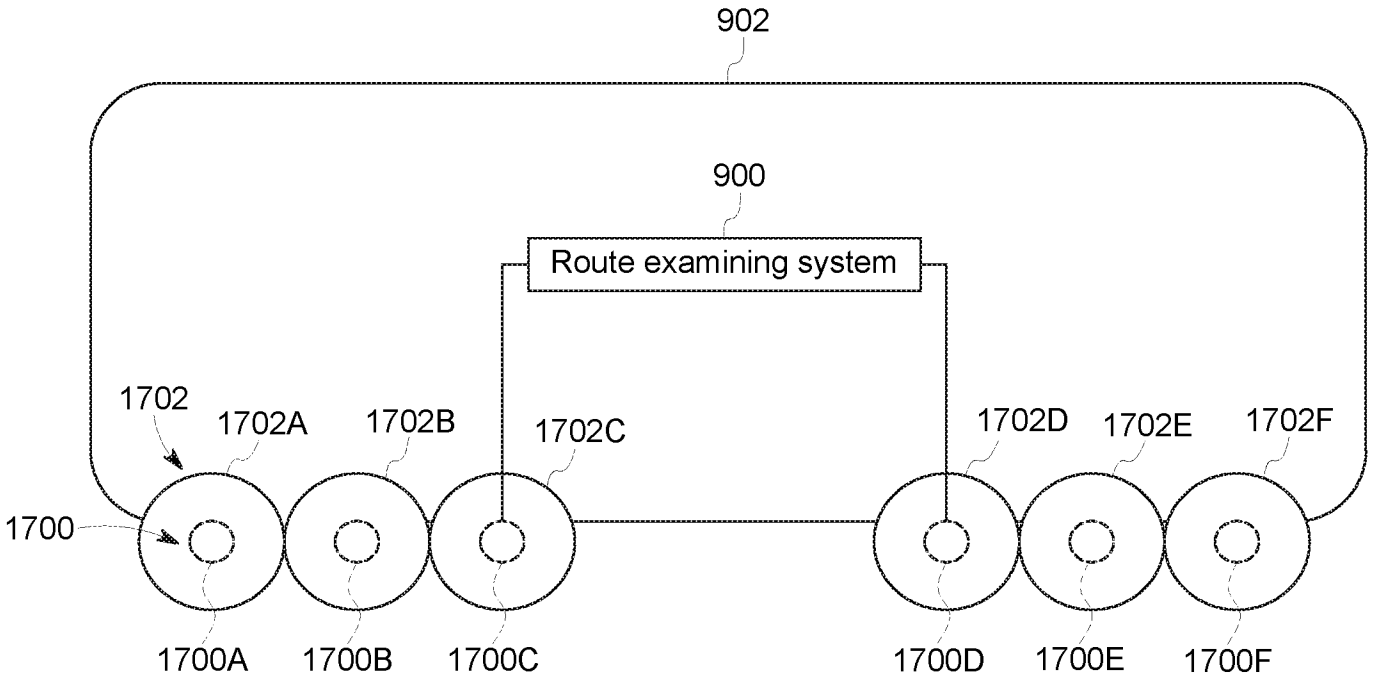
FIG. 17 illustrates the vehicle shown in FIG. 9 according to one embodiment.

FIG. 17 illustrates a vehicle according to one embodiment. The vehicle may represent a multiple axle propulsion-generating vehicle, such as a locomotive, in one example. As described above, the vehicle includes the examining system shown in more detail in FIG. 9. The examining system includes two transmitters or application units (e.g., 908A and 908B shown in FIG. 9) and two receivers or detection units (e.g., 910A and 910B shown in FIG. 9) positioned along the conductive loop defined by shunts on the vehicle and rails of the pathway between the shunts.

The shunts may be formed by axles 1700 (e.g., axles 1700A-F) and wheels 1702 (e.g., wheels 1702A-F) of the vehicle. For example, the vehicle may include six sets of axles and wheels, with each axle attached to multiple wheels in contact with the conductive rail to form a shunt. As shown in FIG. 17, the axles and wheels may be grouped together into two sets, with the axles 1700A-C and the wheels 1702A-C in one set located closer together than the other axles 1700D-F and wheels 1702D-F, and the axles 1700D-F and the wheels 1702D-F in the other set located closer together than the other axles 1700A-C and wheels 1702A-C. The axles and wheels forming the two shunts in the conductive loop used by the route examination system may be the axle and corresponding wheels in each set that are closest to the other set of axles and wheels. For example, the route examination system may conduct current to inspect the route through the conductive loop that includes a first cross-route shunt formed by the third axle 1700C and the wheels 1702C in one set, and that includes a second cross-route shunt formed by the fourth axle 1D and the wheels 1702D in the other set. These axles 1700C, D and wheels 1702C, D may be used to prevent other axles and wheels from conducting the current between the rails. Alternatively, other axles and wheels may be used.

Although not shown in FIG. 17, the vehicle may include one or more onboard power sources for the route examination system that also generate or provide power for other components or systems. For example, the vehicle 90 may include an engine-generator or engine-alternator set that generates electric current to power traction motors as well as the route examination system, and/or other components or systems.

If, however, the route examination system is to be positioned onboard another type of vehicle, however, different wheels or axles may be used to form the shunts used by the route examination system to detect damage to the route.

Figure 18:
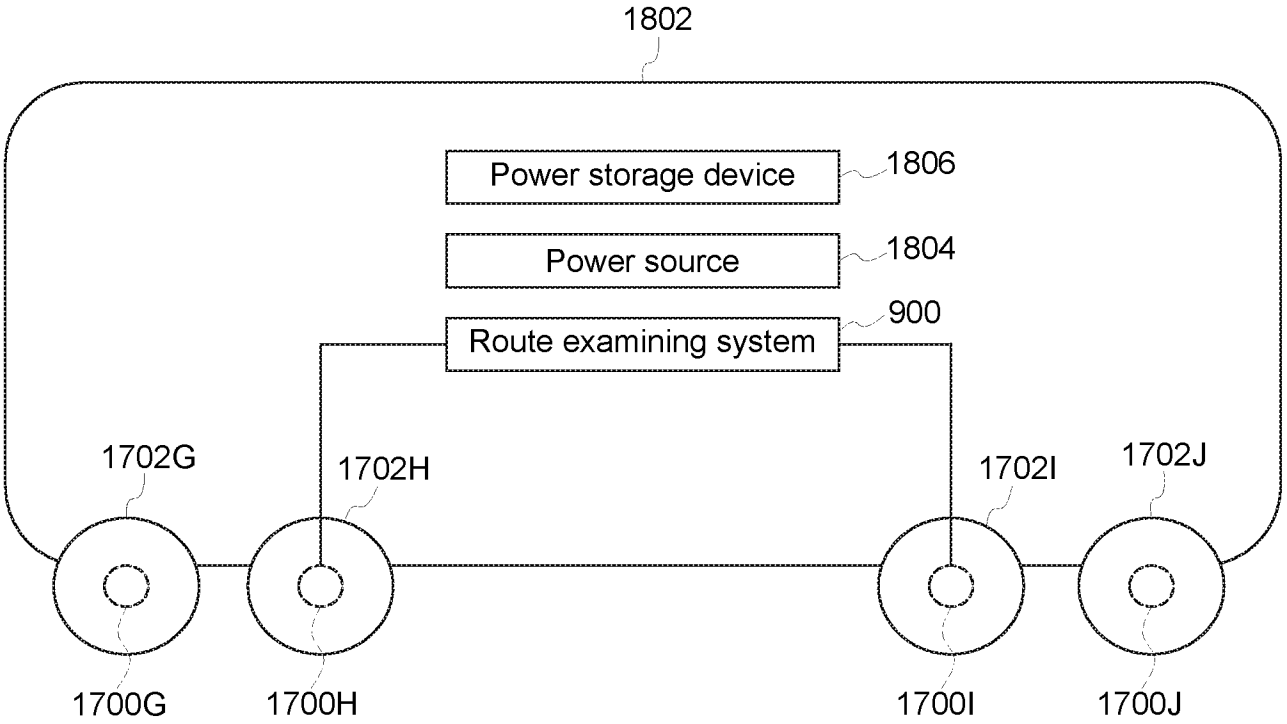
FIG. 18 illustrates a non-propulsion-generating vehicle according to one embodiment.

FIG. 18 illustrates a non-propulsion-generating vehicle 1802 according to one embodiment. The vehicle may represent a vehicle that does not propel itself, such as a rail car, ore cart, trailer, or the like. The vehicle may include the examining system shown in in FIG. 9.

The shunts may be formed by axles 1700 (e.g., axles 1700G-J) and wheels 1702 (e.g., wheels 1702G-J) of the vehicle. In contrast to the vehicle shown in FIG. 9, the vehicle shown in FIG. 18 may include a fewer number of wheel-axle sets, such as four sets. As shown in FIG. 18, the axles and wheels of the vehicle may be grouped together into two sets, with the axles 1700G, 1700H and the wheels 1702G, 1702H in one set located closer together than the other axles 1700I, 1700J and wheels 1702I, 1702J, and the axles 1700I, 1700J and the wheels 1702I, 1702J in the other set located closer together than the other axles 1700G, 1700H and wheels 1702G, 1702H. The axles and wheels forming the two shunts in the conductive loop used by the route examination system onboard the vehicle may be the axle and corresponding wheels in each set that are closest to the other set of axles and wheels.

For example, the route examination system onboard the vehicle may conduct current to inspect the route through the conductive loop that includes a first cross-route shunt formed by the second axle 1700H and the wheels 1702H in one set, and that includes a second cross-route shunt formed by the third axle 1700I and the wheels 1702J in the other set. These axles 1700H, 1700I and wheels 1702H, 1702I may be used to reduce the distance that the current is to travel through the rails of the route in the conductive loop, thereby reducing resistive losses from the current in the rails. Alternatively, other axles and wheels may be used.

In one embodiment, the route examination system on the vehicle is powered by an onboard power source 1804. The power source can represent one or more energy harvesting devices, such as one or more solar cells or photovoltaic devices, nano-antennas, fluid flow generators (e.g., generators that create electric current based on the movement of airflow, such as air in an air brake system of the vehicle), piezoelectric devices, generators in or connected with the bearings of the axles or wheels, or the like. Optionally, the route examination system may be coupled with another vehicle by a wired connection that supplies electric current to the route examination system. For example, the route examination system may be powered by current received from an electronically controlled pneumatic (ECP) brake line or other wired or cabled connection.

The vehicle may include a power storage device 1806 that stores electric current for use in powering the route examination system. The storage device can represent one or more batteries, capacitive devices, or the like, that store electric energy. The storage device may be used to store electric energy used to power the route examination system during time periods that the route examination system may be unable to receive sufficient energy from the power source to inspect the route.

The examining system can include or be connected with a communication unit, such as one or more of the communication units described above. The examining system can communicate an inspection signal to one or more off-board locations using the communication unit to notify the off-board location(s) of the absence of detection of damage to the route.

In one embodiment, the vehicle is dedicated to carrying the examining system, and may not carry other cargo. For example, the vehicle may only carry the equipment or components of the examining system (e.g., equipment, persons, or the like, that operate to examine the route), and may not carry other cargo that is not used to examine the route (e.g., ore, passengers not inspecting the route, coal, packaged goods, etc.).

Figure 19:
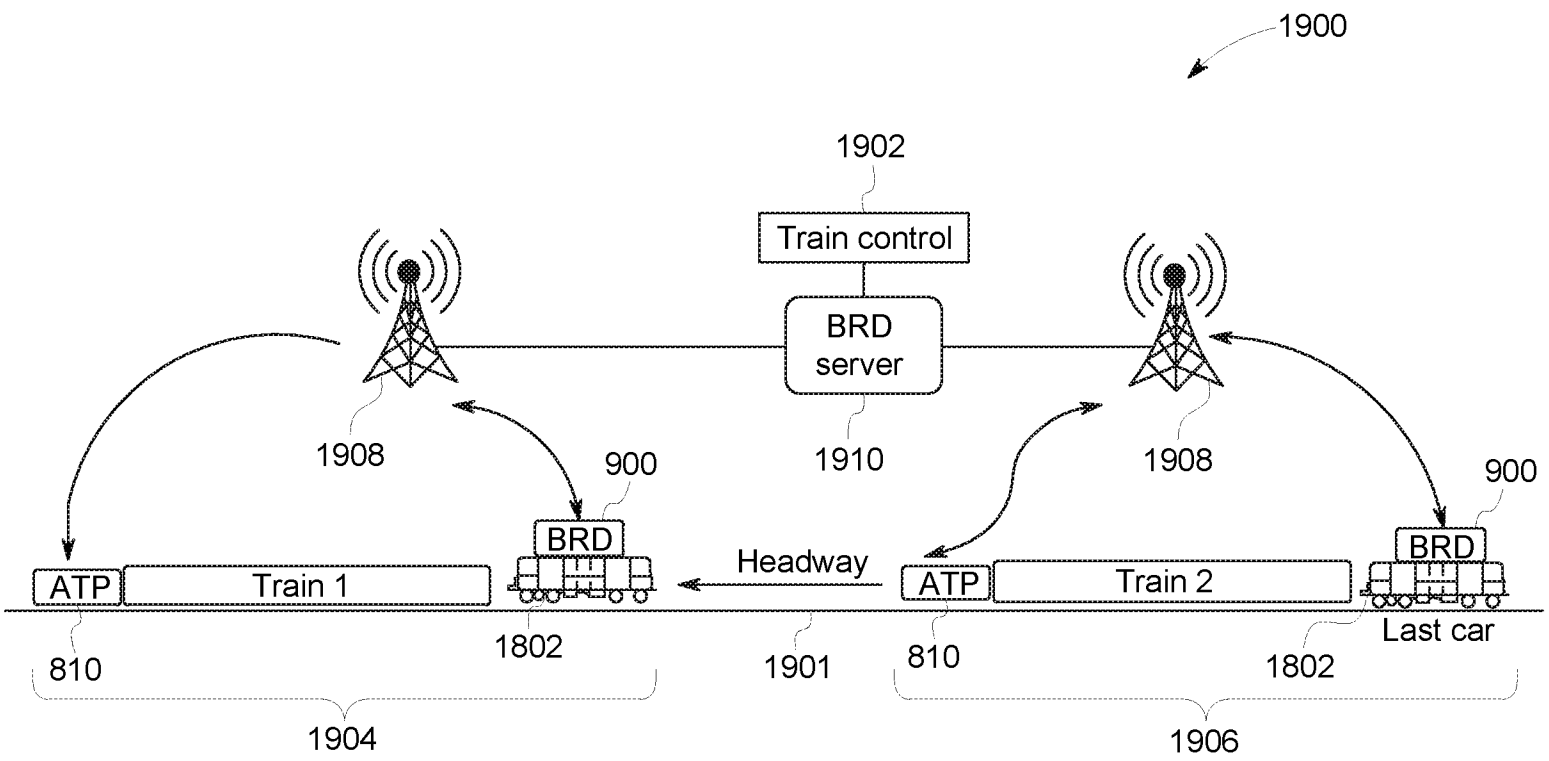
FIG. 19 illustrates one embodiment of a failsafe control system.

FIG. 19 illustrates one embodiment of a failsafe control system 1900. The failsafe control system communicates with several vehicles or vehicle systems to determine locations of damaged segments of routes being traveled upon by the vehicles or vehicle systems, and to prevent vehicles from traveling over segments of the routes determined to be damaged. The failsafe control system includes a failsafe controller 1902 ("Train Control" in FIG. 19) that communicates with plural vehicle systems 1904, 1906 traveling along one or more routes 1901. The failsafe controller can represent hardware circuitry that includes or is connected with one or more processors (e.g., microprocessors, field programmable gate arrays, integrated circuits, or the like) that perform the functions of the multi-vehicle controller 1902 described herein.

The failsafe controller is connected with one or more communication units 1908 by wired and/or wireless connections. Each of the communication units represents transceiving circuitry that includes and/or is connected with antennas for wirelessly communicating with the communication units onboard the vehicle systems 1904, 1906. In one embodiment, the communication units include cellular antennas that wirelessly communicate signals with the vehicle systems 1904, 1906.

The failsafe control system includes a memory device 1910 ("BRD Server" in FIG. 19), which can represent one or more servers, computer hard drives, databases, etc. The memory device can store data indicative or representative of locations of damaged segments of the routes, locations of last communications with the vehicle systems 1904, 1906, locations of route features that may be identified by the route examination systems ("BRD" in FIG. 19) onboard the vehicle systems 1904, 1906, and/or other information.

The failsafe controller can refer to an off-board controller, e.g., with associated communication circuitry, which, under designated situations where a leading vehicle system and a trailing vehicle system cannot communicate with one another or otherwise due to a communications failure, is configured to communicate one or more vehicle control or other safety-related signals to the leading vehicle system and/or the trailing vehicle system. The failsafe controller has designated default operations that may be automatically performed by the controller in the event of a failure of one or more other systems or components, such as due to two vehicle systems no longer being able to communicate with each other.

Each of the vehicle systems 1904, 1906 represents two or more vehicles traveling together along a route. For example, each of these vehicle systems can include at least one propulsion-generating vehicle and at least one non-propulsion-generating vehicle, such as the vehicle 1802 with the examining system disposed onboard. Alternatively, one or more of these vehicle systems may include only a single propulsion-generating vehicle having an examining system onboard. In one embodiment, the vehicle system 1906 may not include the examining system onboard.

In operation, one vehicle system 1904 (referred to as the leading vehicle system) may travel over the route prior to the other vehicle system 1906 (referred to as the trailing or subsequent vehicle system). The examining system onboard the leading vehicle system may communicate (e.g., periodically, irregularly, and/or upon operator demand) with the failsafe control system via the communication unit onboard the leading vehicle system and one or more of the communication units of the failsafe control system. The examining system may communicate inspection signals to the failsafe controller indicating that no damage to the route has been detected by the examining system responsive to or after the examining system fails to detect damage to the route. Optionally, the examining system can communicate the inspection signal to the trailing vehicle system or can communication the inspection signal to both the failsafe control system and the trailing vehicle system. These inspection signals may include or may be sent with additional data indicating the location and/or distance of the leading vehicle system when no damage was detected. The inspection signals can indicate that no damage to the route has been found by the examining system since at least the previously sent inspection signal.

Responsive to receiving an inspection signal indicating no damage to the conductive body or bodies (e.g., the route or a cable), the failsafe controller determines that the segment of the conductive body in the location traversed by the leading vehicle system between inspection signals is not damaged. For example, the segment of the route over which the leading vehicle system traveled over from the previously sent and received inspection signal to the most recently sent and received inspection signal may be identified by the failsafe controller as not including any damaged portions of the route. This segment of the route may be referred to as a safe route segment. Responsive to making this determination or identification, the failsafe controller can communicate an approval signal to the trailing vehicle system to inform the trailing vehicle system that the trailing vehicle system can continue traveling along the route and over the safe route segment.

But the inspection signal may indicate that the route inspection system onboard the leading vehicle system detected a damaged portion of the conductive body at an identified location or distance along the route. Responsive to receiving this inspection signal, the failsafe controller determines that the segment of the conductive body in the location traversed by the leading vehicle system between inspection signals is damaged. Damaged conductive bodies may not be safe for travel by the trailing vehicle system. For example, the segment of the route over which the leading vehicle system traveled over from the previously sent and received inspection signal to the most recently sent and received inspection signal may be identified by the failsafe controller as including one or more damaged portions of the route. This segment of the route may be referred to or identified as an unsafe or damaged route segment, even though only a portion and not the entire segment of the route may be damaged. Responsive to making this determination or identification, the failsafe controller can communicate a warning signal to the trailing vehicle system to inform the trailing vehicle system that the trailing vehicle system of the upcoming damaged segment of the route.

Responsive to receiving the warning signal, the control unit ("ATP" in FIG. 19) of the trailing vehicle system may implement one or more responsive actions. As one example, the control unit of the trailing vehicle system may automatically stop movement (e.g., at a current location and/or at a subsequent location before reaching the damaged route segment) to prevent the trailing vehicle system from traveling over the damaged route segment. As another example, the control unit of the trailing vehicle system may automatically slow movement (without stopping) during travel over the damaged route segment to avoid or eliminate the possibility of the trailing vehicle system derailing or increasing the damage to the route. As another example, the control unit of the trailing vehicle system may change which route is being traveled upon by communicating a signal to a switch that causes the switch to change state or positions, or otherwise changing routes (and thereby avoid travel over the damaged route segment).

In one embodiment, the failsafe controller can communicate with multiple vehicle systems to direct the vehicle systems to inspect segments of the route. For example, the failsafe controller can direct a first vehicle system to travel over a designated segment of the route to inspect the route segment based on the location of the first vehicle system. The failsafe controller can then direct a different, second vehicle system to travel over the same or a different segment of the route to inspect the route segment based on the location of the first vehicle system.

One or more vehicle systems may lose communication with the failsafe system. For example, one or more of the vehicle systems may be unable to send one or more inspection signals to the failsafe system due to wireless interference, faults in the communication unit onboard a vehicle system, faults in the examining system, or other causes. As another example, the failsafe system may not receive one or more inspection signals (e.g., at designated times or within a designated period of time) due to wireless interference, faults in the communication units, other faults in the failsafe system.

Responsive to such a communication loss, the failsafe controller may determine or assume that the route is damaged at or past the last known location of the vehicle system. For example, the leading vehicle system may successfully communicate an inspection signal (e.g., the inspection signal is sent by the leading vehicle system and received by the failsafe controller) at a first location or distance along the route, successfully communicate an inspection signal at a subsequent, different second location or distance along the route, but may not be able to complete communication of an inspection signal at a subsequent, different third location or distance along the route. Each of the successfully communicated inspection signals may indicate that no damage was detected by the examining system during the preceding segment of the route.

The failsafe controller can determine, based on the first and second inspection signals, that the route is not damaged in the segment of the route traversed by the leading vehicle system prior to sending the first inspection signal or in the segment of the route extending from (a) the location of the leading vehicle system when the first inspection signal was sent to (b) the location of the leading vehicle system when the second inspection signal was sent. But, due to the third inspection signal not being received by the failsafe controller, the failsafe controller may determine that the segment of the route starting at the location where the leading vehicle system sent the second inspection signal (e.g., the last successfully sent inspection signal) includes a damaged section of the route. The failsafe controller may assume that this section of the route is damaged to ensure that the loss of communication does not result in actual damage to the route being missed due to the communication loss. The failsafe controller may then communicate the warning signal to the trailing vehicle system, which can alter movement of the trailing vehicle system, as described above.

Optionally, the failsafe controller and/or the memory device can be entirely disposed onboard the vehicle 1802. For example, the failsafe controller can be located on the vehicle 1802 and can determine whether the segment of the route that the vehicle system recently traveled over (e.g., just completed travel over) is or is not damaged. The onboard failsafe controller can communicate this information or other control signals described herein to the other vehicle systems (e.g., the vehicle system 1906) for controlling movement of the other vehicle systems.

In one embodiment, the memory device of the failsafe system may include a database that maps locations of known features (e.g., anomalies) in the route that are not damaged portions of the route. It should be noted that databases or other sources of information (e.g., a database including locations of known anomalies due to causes other than damage, or a database including identified signatures associated with known non-damage anomalies, among others) may be maintained in one or more locations onboard the vehicle system and/or off-board the vehicle system in various embodiments.

As just one example, insulated joints may be identified as potentially damaged sections of the route by the examining system. By tracking the locations indicated by the first technique using a geographic reference (e.g., position along a length of a track with reference to a mile marker or other marker, GPS coordinates, or the like), the locations may be compared with known locations of insulated joints, those sections identified as potentially damaged that coincide with the location of an insulated joint may be eliminated as a false positive and/or identified for further analysis. In some embodiments, the examining system and/or the failsafe controller may access a database to further analyze a potentially damaged section of the route. For example, a potentially damaged section of the route 101 may be identified by the identification unit of the examining system as being located at a specific position as described by geographic information system (GIS) information, such as GPS information. The identified location may then be compared with known anomalies in a GIS information database. For example, the database may map locations (e.g., provide tabulated coordinates) of known unbonded rails, insulated joints, switch frogs, or the like, present along the route. The switch frog may be understood as occurring along a route where two tracks cross. A switch frog has a particular pattern of gaps and masses of metal that may result in an identifiably different signature of a detected examination signal relative to signatures due to features such as insulated joints or transverse breaks, among others. The examining system may be configured to determine if a potentially damaged section of the pathway or route 1901 identified by the identification unit coincides with a known feature to rule out false reports of damage due to the known feature.

In one embodiment, a memory device onboard the vehicle system may include a database or other memory structure that stores locations of known breaks in the conductivity of the pathway, as well as identifying information on the information stored in the database (e.g., a database version number). These breaks may include unbonded rails, insulated joints, switch frogs, etc. The examining system may compare a location of a detected break in the conductivity of the pathway with the stored locations of known breaks in the conductivity of the pathway in the database. The examining system may communicate the detection of breaks in conductivity that are not associated with the known breaks in conductivity stored in the database to the failsafe controller, along with locations of the detected breaks and the identifying information on the database. Optionally, the examining system may communicate the detection of breaks in conductivity that are associated with the known breaks in conductivity stored in the database to the failsafe controller, along with locations of the detected breaks and the identifying information on the database. The failsafe controller may examine the locations reported from the examining system and the identifying information of the database to determine whether the database being used by the examining system is current or otherwise accurately indicates locations of the known breaks in conductivity in the pathway. Some examining systems may have old, outdated, or otherwise incorrect databases that do not correctly identify the known breaks in conductivity in the pathway. Responsive to determining that the examining system is relying on or using an old, outdated, or otherwise incorrect database, the failsafe controller may determine that the detection (or absence of detecting) of breaks in conductivity in the pathway by the examining system cannot be safely relied on and not use the detection (or absence of detecting) of breaks in conductivity in the pathway by the examining system 90 to determine which segments of the pathway are safe to travel upon by following vehicle systems.

The failsafe controller may use the detection or lack of detection of known features in the pathway by the examining system onboard one or more of the vehicle systems to check on operation of the examining system. The failsafe controller can receive inspection signals from an examining system that either indicate that no damage to the pathway is identified by the examining system 900, or that indicate that damage to the pathway is identified by the system. The damage may be identified as a gap or break in conductivity in the conductive loop used by the examining system, as described above. If an examining system does not identify a known feature (e.g., insulative section of the pathway) as damage to the pathway (e.g., as a break in conductivity in the conductive test loop) in one or more locations, then the failsafe controller may determine that the examining system is not operating properly, and may need to be inspected, repaired, or replaced. Responsive to making such a determination, the failsafe controller can automatically communicate a repair signal to the vehicle system having the faulty examining system to direct the vehicle system to proceed to a repair facility. The failsafe controller also may assume that any section of the pathway that the vehicle system with the faulty examining system has yet to travel by has one or more damaged portions to prevent the failure to detect damage from risking travel of a subsequent (e.g., trailing) vehicle system, as described above.

The vehicle systems may report their location as collocated with faults, defects or damage as determined. Where a vehicle is traveling and drawing power from the conductive pathway, the fault, defect or damage may be sensed as a load, a drop in voltage, an increase in resistance, and the like. In one embodiment, the vehicle systems may determine the locations where defects are (or are not) detected using Global Navigation Satellite System (GNSS) receivers, such as GPS receivers. But, if the vehicle systems do not include GPS receivers or are unable to use the GPS receivers (e.g., due to a fault in the receivers or traveling in a location where the GPS receivers are unable to receive sufficient signals to determine the location of a vehicle system), other location-determining techniques may be used. For example, the vehicle systems may include radio frequency identification (RFID) readers that electromagnetically read locations or distances along a route from wayside tags or devices (e.g., AEI tags). As another example, the failsafe controller can determine the locations of the vehicle systems based on the location of the last automated switch through which the vehicle systems traveled. The vehicle systems can communicate an identity of this switch to the controller, and the controller can determine the location of the vehicle system based on the location of the switch, as stored in the memory device. The controller can determine the locations of the vehicle systems based on the location of the signaling equipment with which the vehicle systems communicated during movement of the vehicle systems by or near the signaling equipment. The vehicle systems can communicate an identity of the signaling equipment to the controller, and the controller can determine the location of the vehicle system based on the locations of the signaling equipment, as stored in the memory device. As another example, the vehicle systems may use wireless radio triangulation to determine the locations of the vehicles. As another example, the vehicle systems may include cameras and software that optically detects locations of the vehicle systems from signs or other features.

Figure 20:
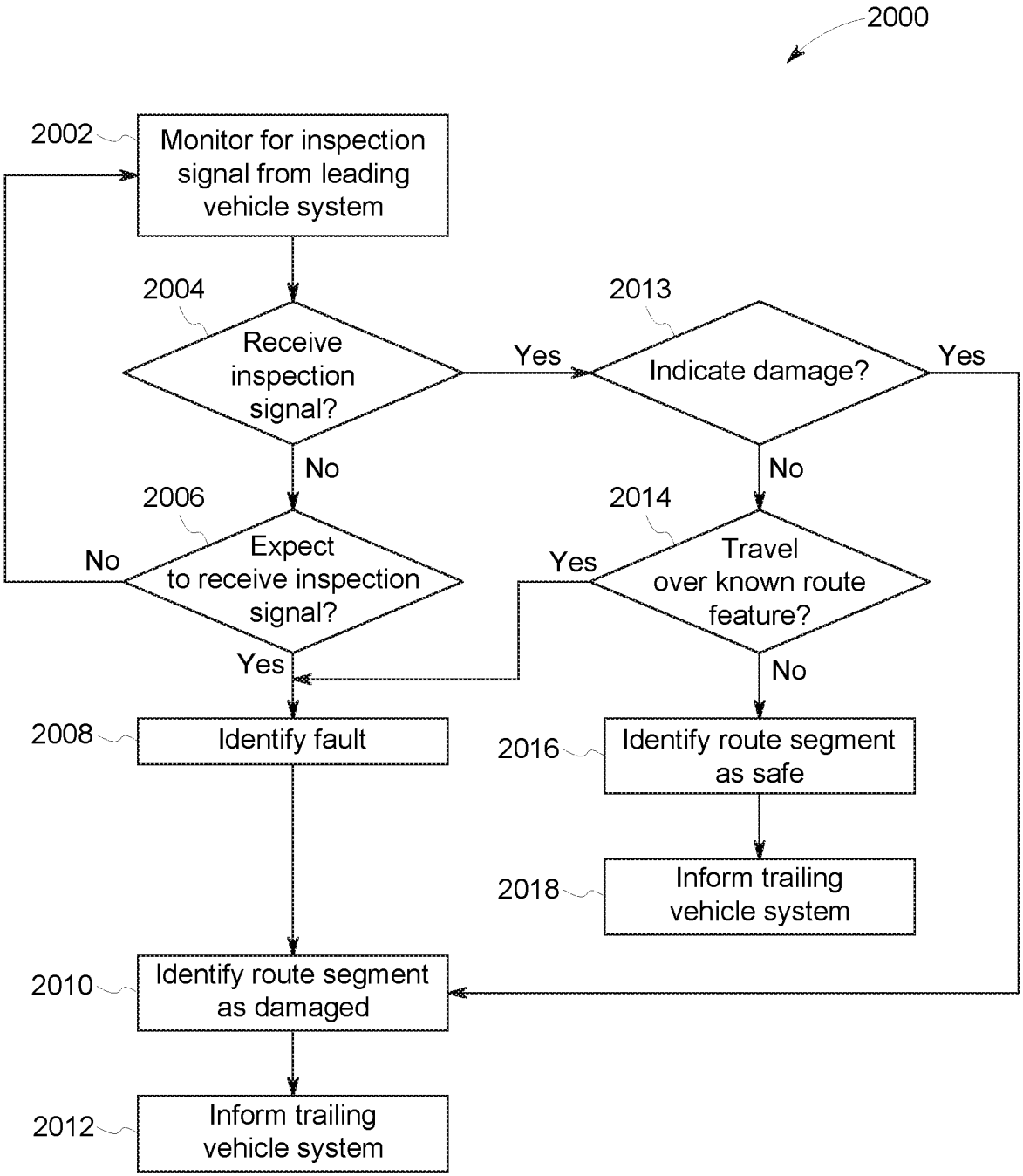
FIG. 20 illustrates a flowchart of one embodiment of a method for preventing travel of a vehicle system over a potentially damaged route.

FIG. 20 illustrates a flowchart of one embodiment of a method 2000 for preventing travel of a vehicle system over a potentially damaged pathway. The method may represent operations performed by the failsafe controller described above. In one embodiment, the method represents an algorithm that can be used to create one or more software applications for directing operation of the failsafe controller.

At step 2002, communication with a leading vehicle system is monitored. This monitoring can involve listening or determining whether one or more signals are received by the failsafe controller (e.g., via one or more of the communication units). At step 2004, a determination is made as to whether any inspection is received (e.g., by the failsafe controller) from the leading vehicle system. Such an inspection signal may indicate the detection or failure to detect damage to the pathway being traveled upon by the leading vehicle system, as well as the location or distance along the pathway of the leading vehicle system when the damage is detected, or the inspection signal is sent. If no inspection signal is received, then flow of the method may proceed toward step 2006. If an inspection signal is received at step 2004 (e.g., by the failsafe controller), then flow of the method may proceed toward step 2012 (described below).

At step 2006, a determination is made as to whether the inspection signal was expected to be received. In one embodiment, the failsafe controller may expect to receive an inspection signal at a designated frequency or at one or more designated time periods. If an inspection signal is not received at the expected or designated times, then the absence of receipt of the signal can indicate a communication loss with the leading vehicle system. Thus, flow of the method may proceed toward step 2008. If an inspection was not received and was not expected to be received, then flow of the method may return toward step 2002 to wait for receipt of an inspection signal (or to determine again that no inspection signal was received when such a signal was expected).

At step 2008, a fault in the failsafe system is identified. This fault can involve a communication loss between the leading vehicle system and the failsafe controller. The fault can be dangerous to travel of a trailing vehicle system because the leading vehicle system may be attempting to report a damaged pathway but due to the communication loss or other error, the leading vehicle system (e.g., the examining system onboard the leading vehicle system) is unable to communicate the inspection signal indicating damaged pathway to the failsafe controller.

At step 2010, a segment of the pathway is identified as damaged. For example, responsive to non-receipt of an expected inspection signal, the failsafe controller may determine a fault has occurred and determine that the segment of the pathway extending beyond the previously received inspection signal (that indicated no damage to the pathway) is damaged. The failsafe controller can assume that this segment of the pathway is damaged due to the absence of any inspection signals reporting damage or no damage to the pathway (since any previously received inspection signal). This can avoid the failsafe controller determining that a damaged pathway segment is not damaged due to a communication loss with the examining system on the leading vehicle system.

Optionally, at step 2012, a trailing vehicle system is informed of the damaged segment of the pathway (or the segment of the pathway determined to be damaged due to the communication loss). The failsafe controller can communicate a warning signal to the trailing vehicle system. Responsive to receiving this warning signal, the trailing vehicle system can change movement to avoid traveling over the damaged pathway segment or to travel over the damaged pathway segment or another pathway segment at a slower speed, as described above. Alternatively, the trailing vehicle system may be informed of the damaged segment of the pathway (or the fault) by not notifying the trailing vehicle system that the pathway segment is not damaged. For example, the control unit of the trailing vehicle system may assume that the pathway is damaged unless or until the control unit receives an approval signal from the failsafe controller. Flow of the method may return toward step 2002 to listen for receipt of one or more additional inspection signals (e.g., from the same or one or more other vehicle systems).

Returning to the description of the determination of whether an inspection signal is received at step 2004 and proceeding toward step 2013 responsive to receipt of an inspection signal, at step 2013, a determination is made as to whether the received inspection signal indicates damage to the pathway. The failsafe controller can examine the data included in the inspection signal to determine whether the examining system detected damage at an identified location on the pathway or distance along the pathway. If the inspection signal indicated damage, then flow of the method can proceed toward step 2010. As described above, at step 2010, a segment of the pathway is identified as damaged. For example, responsive to receipt of the inspection signal indicating damage on the pathway, the failsafe controller may determine that the segment of the pathway (e.g., extending from the location where a previous inspection signal indicated no damage to at least the location where the inspection signal indicated damage to the pathway) is damaged. The trailing vehicle system may be informed of this damaged pathway segment at step 2012 (or not be informed that the pathway segment is safe), and implement one or more responsive actions, as described above.

But, if it is determined at step 2013 that the received inspection signal does not indicate damage to the pathway, then flow of the method can proceed toward step 2014. At step 2014, a determination is made as to whether the leading vehicle system traveled over a segment of the pathway having a known feature. For example, the failsafe controller can determine the segment of the pathway near which the leading vehicle system traveled prior to receiving the inspection signal. If this segment is known to have one or more features that would be detected as damage—a break in conductivity in the route (e.g., insulated joints, frogs, switches, intersections, etc.), an increase in resistance, intermittent conductivity or shorts—then the failure of the examining system to indicate this feature as damage to the pathway may indicate that the examining system is damaged or not fully operational. As a result, flow of the method can proceed toward step 2008.

As described above, at step 2008, a fault in the failsafe system may be identified. This fault can involve fault in the examining system onboard the leading vehicle system. The fault can be dangerous to travel of a trailing vehicle system because the examining system onboard the leading vehicle system may be unable to identify breaks in the conductivity of the pathway as damaged portions of the pathway. Responsive to identifying the fault in the examining system, the failsafe controller may automatically schedule or send a signal to begin repair of the examining system. At step 2010, the segment of the pathway is identified as damaged. For example, responsive to the inspection signal not indicating damage to the pathway when the leading vehicle system traveled over a pathway segment having a feature that should have been identified as pathway damage, the failsafe controller may determine a fault has occurred and determine that the segment of the pathway extending beyond the previously received inspection signal is damaged. The failsafe controller can assume that this segment of the pathway is damaged due to the inability of the examining system to identify the known feature. Additionally, the failsafe controller may determine a type of damage and/or a severity of damage.

Returning to the description of step 2014, if the leading vehicle system did not travel over a known feature, then flow of the method can proceed toward step 2016. At step 2016, the segment of the pathway is identified as safe or is not identified as being damaged. The failsafe controller may decide that the pathway segment is not damaged or may avoid deciding that the pathway segment is damaged. At step 2018, the trailing vehicle system is informed that the pathway segment is not damaged. The failsafe controller may send an approval signal to the trailing vehicle system that indicates that the segment of the pathway extending backward from the location associated with the inspection signal (e.g., received at step 2004) is not damaged. The trailing vehicle system may continue traveling along this segment of the pathway. Flow of the method may return toward step 2002 to wait for receipt of one or more additional inspection signals.

In one example, an examining system is provided that includes one or more application devices that may be disposed onboard a vehicle system traveling along a route. The one or more application devices may be coupled with one or more conductive bodies extending along the route during movement of the vehicle system along the route. The one or more application devices may electrically conduct an examination signal into the one or more conductive bodies. The one or more conductive bodies may include one or more of a catenary, a third rail, or a cable extending along the route. The examining system may include one or more detection units that may be disposed onboard the vehicle system and that may monitor one or more electrical characteristics of the one or more conductive bodies in response to the examination signal being conducted into the one or more conductive bodies. The examining system may include an identification unit that may examine the one or more electrical characteristics of the one or more conductive bodies monitored by the one or more detection units to identify a compromised or damaged section of the one or more conductive bodies.

The one or more application devices may include a first application device and a second application device disposed at spaced apart locations along a length of the vehicle system. The one or more detection devices may include a first detection device and a second detection device disposed at spaced apart locations along a length of the vehicle system. The one or more application devices may electrically conduct the examination signal into the one or more conductive bodies with a unique identifier included in the examination signal. The unique identifier may include at least one of a frequency, a modulation, and/or an embedded signature.

The identification unit may identify the compromised section of the one or more conductive bodies responsive to the one or more electrical characteristics indicating no conduction of the examination signal through the one or more conductive bodies. The identification unit may identify the compromised section of the one or more conductive bodies based on detection of an electrical short connected with the one or more conductive bodies.

In another example, a method is provided that may include electrically conducting an examination signal into the one or more conductive bodies from onboard a vehicle as the vehicle traverses a pathway, monitoring one or more electrical characteristics of the one or more conductive bodies via the examination signal, and determining a compromised or damaged section of the one or more conductive bodies based at least in part on the examination signal.

The vehicle may be one of a plurality of vehicles in a vehicle system and the examination signal may be electrically conducted into or received from the one or more conductive bodies at spaced apart locations along a length of the vehicle system. The examination signal may be electrically conducted into the one or more conductive bodies with a unique identifier included in the examination signal and the unique identifier may include at least one of a frequency, a modulation, and/or an embedded signature.

The method also may include obtaining a location of the vehicle in response to a determination of a compromised or damaged section of the one or more conductive bodies. The method also may include determining the electrical characteristic of the conductive body. The electrical characteristics may include no conduction of the examination signal through the one or more conductive bodies. The electrical characteristics may include one or more of an increased electrical resistance, a decreased electrical resistance, a drop in voltage, a spike in voltage, and/or intermittent conductivity. The compromised section of the one or more conductive bodies may be identified based at least in part on detection of an electrical short connected with the one or more conductive bodies.

In another example, an examining system may include one or more detection units that may be disposed onboard a vehicle system. The detection unit(s) may couple with one or more conductive bodies that extend along a route while the vehicle system is moving along the route. The one or more detection units may monitor one or more electrical characteristics of the one or more conductive bodies during movement of the vehicle system. The one or more conductive bodies may include one or more of a catenary, a third rail, and/or a cable extending along the route. The examining system also may include an identification unit that may examine the one or more electrical characteristics of the one or more conductive bodies monitored by the one or more detection units to identify a compromised section of the one or more conductive bodies during movement of the vehicle system.

The one or more detection devices may include a first detection device and a second detection device disposed at spaced apart locations along a length of the vehicle system. The examining system also may include one or more application devices that may electrically conduct an examination signal into the one or more conductive bodies with a unique identifier included in the examination signal. The one or more detection devices may measure the one or more electrical characteristics responsive to the one or more application devices conducting the examination signal into the one or more conductive bodies.

The application device may be a pantograph. The examining system may include a controller that may determine, based at least in part on the electrical characteristics, if/whether the conductive body is compromised or if/whether the application device is compromised or uncoupled from the conductive body. The identification unit may identify the compromised section of the one or more conductive bodies based on detection of an electrical short connected with the one or more conductive bodies.

In one embodiment, the controllers or systems described herein may have a local data collection system deployed and may use machine learning to enable derivation-based learning outcomes. The controllers may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used making determinations, calculations, comparisons and behavior analytics, and the like.

In one embodiment, the controllers may include a policy engine that may apply one or more policies. These policies may be based at least in part on characteristics of a given item of equipment or environment. With respect to control policies, a neural network can receive input of a number of environmental and task-related parameters. These parameters may include, for example, operational input regarding operating equipment, data from various sensors, location and/or position data, and the like. The neural network can be trained to generate an output based on these inputs, with the output representing an action or sequence of actions that the equipment or system should take to accomplish the goal of the operation. During operation of one embodiment, a determination can occur by processing the inputs through the parameters of the neural network to generate a value at the output node designating that action as the desired action. This action may translate into a signal that causes the vehicle to operate. This may be accomplished via backpropagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes, which may be weighed relative to each other.

In any of the embodiments herein, the one or more application devices and/or the one or more detection units may include respective vehicle pantograph assemblies. Each pantograph assembly is an apparatus, e.g., mounted on the roof of a vehicle, to collect electrical power through contact with an overhead line or wire. Each pantograph assembly may include an articulating arm assembly, a lifting device attached to the vehicle and configured to extend and retract the arm assembly, and a conductive contact shoe positioned at the distal end of the arm assembly (i.e., the end of the arm assembly not connected to the lifting device). In one mode of operation, the lifting device is controlled to raise the arm assembly to cause the shoe to contact the overhead line, e.g., for a transfer of electrical power from the overhead line to the vehicle during movement of the vehicle. In another mode of operation, the lifting device is controlled to lower the arm assembly to cause the shoe to disengage from contact with the overhead line, e.g., in situations where electrical power is not needed, or where the pantograph assembly is damaged, or where it is necessary to transition from one block of overhead line to another. In such an embodiment, the system may be configured to electrically conduct the examination signal over the pantograph assembly in a manner where the examination signal, for example, is superimposed or otherwise coextensive with the electrical power signal conducted from the overhead line to the shoe and then down into the vehicle. This may be done, for example, by configuring the examination signal to have a different frequency or frequency bandwidth than the electrical power signal, e.g., 25 kV AC at 50-60 Hz for the electrical power signal vs. a signal in the megahertz range for the examination signal. In such an embodiment, the system may be configured to produce the examination signal, conduct the examination signal up a first pantograph assembly for conduction onto the overhead line though the shoe (the pantograph assembly thereby acting as, or being part of, the application device), receive electrical signals from the overhead line through a second pantograph assembly, and assess the received electricals signals relative to designated criteria to determine or identify a condition of the overhead line. The criteria may include whether the received electrical signals include signal portions corresponding to the examination signal (e.g., in the same frequency bandwidth), and if so, how those signal portions differ from the original examination signals.

In other embodiments, the one or more application devices and/or the one or more detection units may be wholly or partially disposed on respective pantograph assemblies that act as supports for positioning the application devices and/or the detection units by an overhead line. For example, the application devices and/or the detection units may have conductive members for contact with the overhead line which are electrically separate from the pantograph shoes, and with separate electrical connections (e.g., separate wires) that are electrically apart from, but potentially mechanically connected to, the pantograph arm assemblies, etc. When one of the pantographs is operated to put its shoe into contact with the overhead line, movement of the arm assembly also brings the conductive member of the application device or detection unit (as applicable) near the overhead line, for contact of the conductive member with the overhead line for conduction of the examination signal onto the line or wire. (Movement of the pantograph may bring the conductive member into contact with the overhead line, or the application device or detection unit may have a separate apparatus for controllable engagement and disengagement of the conductive member with the overhead line when the conductive member is positioned near the overhead line by the pantograph.)

Although embodiments are described herein where the one or more application devices and/or the one or more detection units include respective vehicle pantograph assemblies, they may alternatively include respective vehicle third-rail paddle systems. Each third-rail paddle system is an assembly (e.g., including a retractable or otherwise moveable, conductive paddle) that controllably establishes an electrical contact between a third rail and a vehicle, for the transfer of electrical power from the third rail to the vehicle when the vehicle is traveling along a route; the third rail is positioned along the route and provided with electricity from a public utility line or other offboard source of electrical power. For example, an examination signal may be conducted onto the third rail by way of the paddle, and detected by way of another paddle of another paddle system of the vehicle system, e.g., the examination signal is conducted onto the third rail by one paddle of one vehicle, and electrical signals received at another paddle of another vehicle are received and assessed relative to designated criteria for identifying a condition of the third rail, such as the third rail being damaged/compromised. The designated criteria may include assessing if any portion of the received electrical signals correspond to the examination signal, i.e., examination signal received or not, and if they do, assessing how the corresponding portion is changed relative to the examination signal as originally conducted onto the third rail. Minor attenuation commensurate with a voltage drop due to line resistance may indicate the third rail is not damaged. On the other hand, severe attenuation and/or changes in the frequency makeup of the received signal portion (of a magnitude or type greater than or otherwise relative to a designated threshold) may indicate damage to the third rail.

The above description is illustrative, and not restrictive. For example, the above-described embodiments (and/or examples thereof) may be used in combination with each other. In addition, modifications may be made to adapt a particular situation or material to the teachings of the inventive subject matter without departing from its scope. While the dimensions and types of materials described herein are intended to define the parameters of the inventive subject matter, they are not limiting but are exemplary embodiments. Many other embodiments will be apparent to one of ordinary skill in the art upon reviewing the above description. The scope of the inventive subject matter should be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

The foregoing description of certain embodiments of the inventive subject matter will be understood when read in conjunction with the appended drawings. To the extent that the figures illustrate diagrams of the functional blocks of various embodiments, the functional blocks are not necessarily indicative of the division between hardware circuitries. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" or "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system, comprising:

one or more application devices configured to be disposed onboard a vehicle system traveling along a route, the one or more application devices configured to be coupled with one or more conductive bodies extending along the route during movement of the vehicle system along the route, the one or more application devices configured to electrically conduct an examination signal into the one or more conductive bodies, and the examination signal configured to circulate through a closed loop positioned within a length of the vehicle system, the closed loop formed by the vehicle system and the one or more conductive bodies, and the length defined by a single grouping of one or more mechanically coupled vehicles of the vehicle system;

one or more detection units configured to be disposed onboard the vehicle system and to monitor one or more electrical characteristics of the one or more conductive bodies in response to the examination signal being conducted into the one or more conductive bodies; and an identification unit configured to examine the one or more electrical characteristics of the one or more conductive bodies monitored by the one or more detection units to identify a compromised or damaged section of the one or more conductive bodies, the compromised or damaged section of the one or more conductive bodies positioned within the length of the vehicle system.

2. The system of claim 1, wherein the one or more application devices include a first application device and a second application device disposed at spaced apart locations along a length of the vehicle system.

3. The system of claim 1, wherein the one or more detection units include a first detection unit and a second detection unit disposed at spaced apart locations along a length of the vehicle system.

4. The system of claim 1, wherein the one or more application devices are configured to electrically conduct the examination signal into the one or more conductive bodies with a unique identifier included in the examination signal.

5. The system of claim 4, wherein the unique identifier includes at least one of a frequency, a modulation, or an embedded signature.

6. The system of claim 1, wherein the identification unit is configured to identify the compromised or damaged section of the one or more conductive bodies responsive to the one or more electrical characteristics indicating no conduction of the examination signal through the one or more conductive bodies.

7. The system of claim 1, wherein the identification unit is configured to identify the compromised or damaged section of the one or more conductive bodies based on detection of an electrical short connected with the one or more conductive bodies.

8. The system of claim 1, wherein the one or more conductive bodies includes a catenary extending along the route.

9. The system of claim 1, wherein the one or more conductive bodies includes a third rail extending along the route.

10. The system of claim 1, wherein the one or more conductive bodies includes a cable extending along the route.

11. A method, comprising:

electrically conducting an examination signal into one or more conductive bodies from onboard a vehicle system as the vehicle system traverses a pathway, the examination signal configured to circulate through a closed loop positioned within a length of the vehicle system, the closed loop formed by the vehicle system and the one or more conductive bodies, and the length defined by a single grouping of one or more mechanically coupled vehicles of the vehicle system;

monitoring one or more electrical characteristics of the one or more conductive bodies via the examination signal; and determining a compromised or damaged section of the one or more conductive bodies based on the examination signal, the compromised or damaged section of the one or more conductive bodies positioned within the length of the vehicle system.

12. The method of claim 11, wherein the examination signal is electrically conducted into or received from the one or more conductive bodies at spaced apart locations along the length of the vehicle system.

13. The method of claim 11, wherein the examination signal is electrically conducted into the one or more conductive bodies with a unique identifier included in the examination signal, and wherein the unique identifier includes at least one of a frequency, a modulation, or an embedded signature.

14. The method of claim 11, further comprising obtaining a location of the vehicle system based on the determination of the compromised or damaged section of the one or more conductive bodies.

15. The method of claim 11, further comprising determining the one or more electrical characteristics of the one or more conductive bodies.

16. The method of claim 15, wherein the one or more electrical characteristics include no conduction of the examination signal through the one or more conductive bodies.

17. The method of claim 15, wherein the one or more electrical characteristics include one or more of an increased electrical resistance, a decreased electrical resistance, a drop in voltage, a spike in voltage, or intermittent conductivity.

18. The method of claim 11, wherein the compromised or damaged section of the one or more conductive bodies is determined based at least in part by detecting an electrical short connected with the one or more conductive bodies.

19. A system, comprising:

one or more detection units configured to be disposed onboard a vehicle system and to couple with one or more conductive bodies that extend along a route while the vehicle system is moving along the route, the one or more detection units configured to monitor a closed loop positioned within a length of the vehicle system to monitor one or more electrical characteristics of the one or more conductive bodies during movement of the vehicle system, the closed loop formed by the vehicle system and the one or more conductive bodies, and the length defined by a single grouping of one or more mechanically coupled vehicles of the vehicle system; and an identification unit configured to examine the one or more electrical characteristics of the one or more conductive bodies monitored by the one or more detection units to identify a compromised section of the one or more conductive bodies during movement of the vehicle system, the compromised or damaged section of the one or more conductive bodies positioned within the length of the vehicle system.

20. The system of claim 19, wherein the one or more detection units include a first detection unit and a second detection unit disposed at spaced apart locations along a length of the vehicle system.

21. The system of claim 19, further comprising one or more application devices configured to electrically conduct an examination signal into the one or more conductive bodies with a unique identifier included in the examination signal, the one or more detection units configured to measure the one or more electrical characteristics responsive to the one or more application devices conducting the examination signal into the one or more conductive bodies.

22. The system of claim 21, wherein the one or more application devices are a pantograph.

23. The system of claim 21, further comprising a controller configured to determine, based at least in part on the one or more electrical characteristics, if the one or more conductive bodies are compromised, if the one or more application devices are compromised, or if the one or more application devices are decoupled from the one or more conductive bodies.

24. The system of claim 19, wherein the identification unit is configured to identify the compromised section of the one or more conductive bodies based on detection of an electrical short connected with the one or more conductive bodies.

25. The system of claim 19, wherein the one or more conductive bodies includes a catenary extending along the route.

26. The system of claim 19, wherein the one or more conductive bodies includes a third rail extending along the route.

27. The system of claim 19, wherein the one or more conductive bodies includes a cable extending along the route.

* * * * *